US006378148B1

(12) United States Patent
Votel

(10) Patent No.: US 6,378,148 B1
(45) Date of Patent: Apr. 30, 2002

(54) PATIENT TRANSFER SYSTEM

(75) Inventor: Thomas W. Votel, Saint Paul, MN (US)

(73) Assignee: Ergodyne Corporation, Saint Paul, MN (US)

( * ) Notice: Subject to any disclaimer, the term of this patent is extended or adjusted under 35 U.S.C. 154(b) by 0 days.

(21) Appl. No.: 09/057,139

(22) Filed: Apr. 8, 1998

Related U.S. Application Data

(63) Continuation-in-part of application No. 08/713,412, filed on Sep. 13, 1996, now Pat. No. 5,890,238, which is a continuation-in-part of application No. 08/527,519, filed on Sep. 13, 1995, now Pat. No. 5,737,781

(60) Provisional application No. 60/043,208, filed on Apr. 8, 1997.

(51) Int. Cl.[7] ..... A61G 7/10

(52) U.S. Cl. ..... 5/81.1 HS; 5/81.1 R; 5/84.1; 5/88.1

(58) Field of Search ..... 5/81.1 C, 81.1 HS, 5/81.1 R, 83.1, 84.1, 86.1, 88.1, 89.1

(56) References Cited

U.S. PATENT DOCUMENTS

| | | | |
|---|---|---|---|
| 378,220 A | | 2/1888 | Staples et al. |
| 716,886 A | | 12/1902 | Goode |
| 1,263,611 A | | 4/1918 | Scroggin |
| 1,815,006 A | * | 7/1931 | Horsting, et al. |
| 2,093,231 A | | 9/1937 | Broadwell |

(List continued on next page.)

FOREIGN PATENT DOCUMENTS

| | | | |
|---|---|---|---|
| DE | 2 257 572 | * | 5/1974 |
| DE | 2 308 436 | * | 8/1974 |
| GB | 7869 | * | of 1895 |
| GB | 26017 | | of 1907 |
| GB | 10012 | | of 1909 |
| GB | 420697 | * | 12/1934 |
| GB | 2 068 850 A | * | 8/1981 |
| GB | 2139487 A | | 11/1994 |
| WO | WO 86/00221 | | 1/1986 |
| WO | WO 95/21600 | | 8/1995 |

OTHER PUBLICATIONS

AT 2000 Automatic Transfer System brochure, (1991).*

Godwin, M.P., et al., "Easy Transfer with the Long Board," Geriatric Nursing, p. 333, (1987).*

*Primary Examiner*—Robert G. Santos
(74) *Attorney, Agent, or Firm*—Patterson, Thuente, Skaar & Christensen, P.A.

(57) ABSTRACT

A patient transfer system is provided which enables a single operator to transfer a patient from a first horizontal surface to a second horizontal surface. The transfer is accomplished with minimal risk of injury to the operator and patient. The patient transfer system includes a transfer caddy, transfer bridge and transfer rod. The transfer caddy is mobile and contains means for storing the transfer bridge and transfer rod. The transfer bridge and transfer rod are foldable for storage and transport.

59 Claims, 53 Drawing Sheets

U.S. PATENT DOCUMENTS 2,392,083 A * 1/1946 Dumbleton
2,439,066 A 4/1948 Vanderlyn et al.
2,487,648 A 11/1949 Green
2,536,707 A 1/1951 Allyn
2,630,583 A 3/1953 Gilleland
2,632,619 A 3/1953 Wilson
2,710,975 A * 6/1955 Stoen et al.
2,733,452 A 2/1956 Tanney
2,745,163 A 5/1956 Van Buren
2,761,153 A * 9/1956 Mew
2,826,766 A * 3/1958 Stoner
2,827,642 A * 3/1958 Huff
2,939,195 A 6/1960 Carlson
2,959,792 A * 11/1960 Haugard
3,140,069 A 7/1964 McBurney et al.
3,165,760 A 1/1965 Abajian
3,289,685 A * 12/1966 Parker
3,294,247 A 12/1966 Norrington
3,302,219 A 2/1967 Harris
3,413,663 A 12/1968 Swann
3,417,765 A * 12/1968 Slater et al.
3,593,351 A 7/1971 Dove
3,597,774 A * 8/1971 Warren
3,669,133 A * 6/1972 Hyman
3,730,544 A * 5/1973 Hyman
3,769,642 A 11/1973 Warman
3,775,784 A 12/1973 Fry
3,779,474 A * 12/1973 Harelson
3,794,313 A 2/1974 Berger et al.
3,810,263 A 5/1974 Taylor et al.
3,849,813 A 11/1974 Neilson
3,866,619 A 2/1975 Frisk
3,924,281 A 12/1975 Gibbs
3,963,037 A 6/1976 Clark
4,038,572 A 7/1977 Hanagan
4,051,565 A 10/1977 Berge
4,068,770 A 1/1978 Boehringer
4,194,253 A 3/1980 Ullven
4,270,234 A 6/1981 James
4,281,564 A 8/1981 Hill
4,327,453 A 5/1982 Sefton
4,403,641 A 9/1983 Reeder
4,416,511 A 11/1983 Weinberg
4,502,169 A 3/1985 Persson
4,520,518 A 6/1985 Reaser
4,635,308 A 1/1987 Maggion et al.
4,644,595 A 2/1987 Daniel
4,660,240 A 4/1987 Hutton et al.
4,679,259 A 7/1987 Di Matteo et al.
4,680,818 A 7/1987 Ooka et al.
4,681,279 A 7/1987 Nakamura
4,686,748 A 8/1987 Kaivanto
4,688,304 A 8/1987 Marcott
4,696,025 A 9/1987 Taylor
4,726,082 A 2/1988 DiMatteo et al.
4,747,170 A 5/1988 Knouse
4,761,841 A 8/1988 Larsen
4,776,047 A 10/1988 DiMatteo
4,782,543 A 11/1988 Hutton et al.
4,787,104 A 11/1988 Grantham
4,794,660 A 1/1989 Hawkrigg
4,796,313 A 1/1989 DiMatteo et al.
4,809,377 A 3/1989 Lynn
4,809,725 A 3/1989 Champigny
4,819,283 A 4/1989 DiMatteo et al.
4,821,352 A 4/1989 DiMatteo et al.
4,837,872 A 6/1989 Di Matteo et al.
4,837,873 A 6/1989 DiMatteo et al.
4,850,562 A 7/1989 Mazzanti
4,868,938 A 9/1989 Knouse
4,868,940 A 9/1989 Masadi
4,926,512 A 5/1990 Coyle
4,937,901 A 7/1990 Brennan
4,970,738 A 11/1990 Cole
5,005,232 A 4/1991 Wright et al.
5,014,968 A 5/1991 Lammers et al.
5,016,306 A 5/1991 Grivna et al.
5,022,810 A 6/1991 Sherrow et al.
5,033,132 A 7/1991 Greenblatt
5,033,170 A 7/1991 Ewert
5,036,557 A 8/1991 Fales
5,038,424 A 8/1991 Carter et al.
5,065,464 A 11/1991 Blanchard et al.
5,072,840 A 12/1991 Asakawa et al.
5,127,113 A 7/1992 DiMatteo et al.
5,161,276 A 11/1992 Hutton et al.
5,163,189 A 11/1992 De Gray
5,168,587 A 12/1992 Shutes
5,182,827 A 2/1993 Carrier et al.
5,197,156 A 3/1993 Stryker et al.
5,271,110 A 12/1993 Newman
5,279,010 A 1/1994 Ferrand et al.
5,319,813 A 6/1994 DiMatteo et al.
5,329,655 A 7/1994 Garner
5,331,988 A 7/1994 Harmon
5,340,266 A 8/1994 Hodgetts
5,377,391 A 1/1995 Foster
5,379,468 A 1/1995 Cassidy et al.
5,394,576 A 3/1995 Soltani et al.
5,404,602 A 4/1995 Kondo
5,428,851 A * 7/1995 Shore et al. ..... 5/87.1
5,482,070 A 1/1996 Kelly
5,511,255 A 4/1996 Schuerch
5,522,100 A 6/1996 Schilling et al.
5,539,941 A 7/1996 Fuller
5,544,371 A 8/1996 Fuller
5,642,537 A 7/1997 Johnson
5,659,905 A 8/1997 Palmer, Jr. et al.
5,669,089 A 9/1997 Dees
5,697,109 A 12/1997 Hodgetts
5,737,781 A * 4/1998 Votel ..... 5/81.1 HS
5,819,339 A 10/1998 Hodgetts
5,890,238 A * 4/1999 Votel ..... 5/81.1 HS
6,282,734 B1 * 9/2001 Holberg ..... 5/81.1 HS
6,289,533 B1 * 9/2001 Hodgetts ..... 5/81.1 R

* cited by examiner

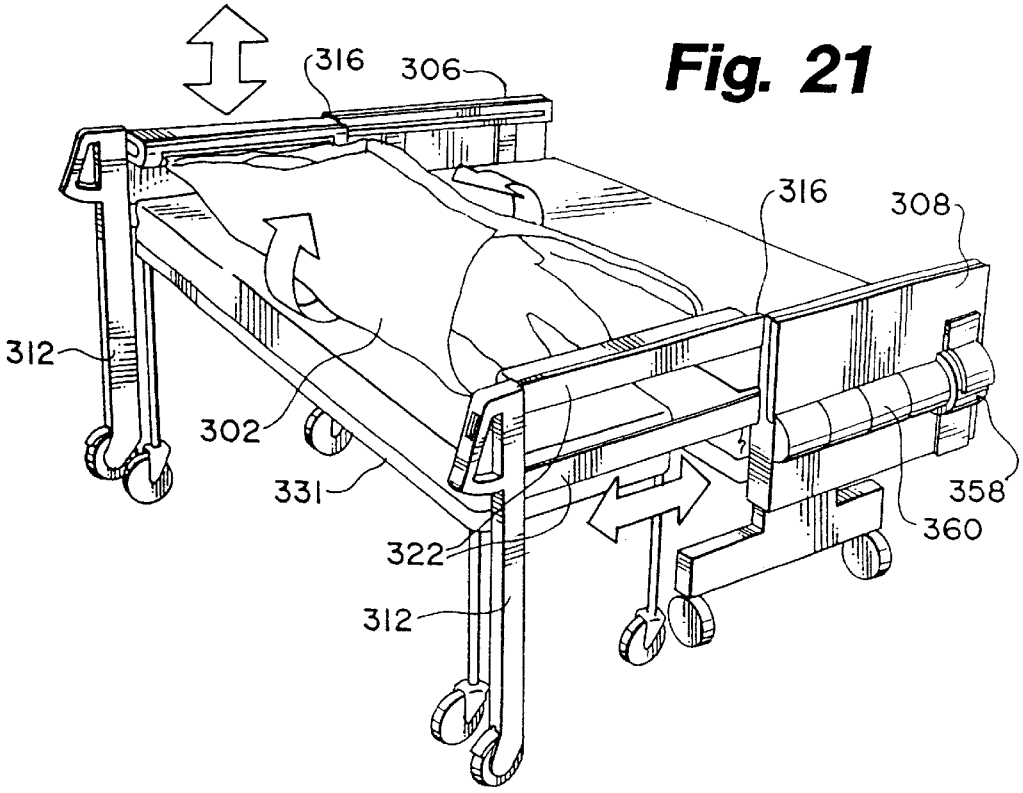
Fig. 21
Fig. 25
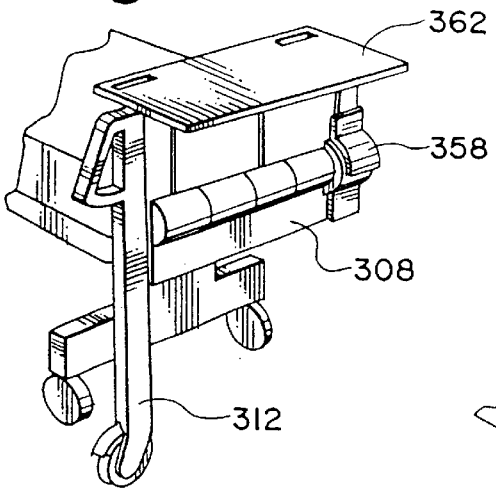
Fig. 24
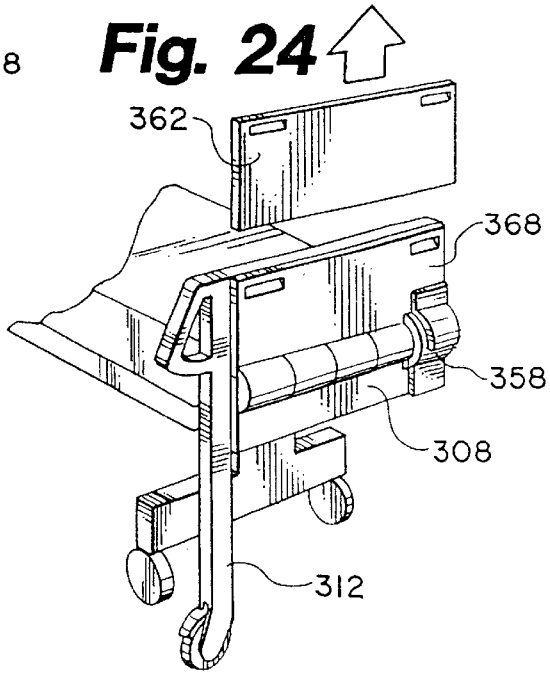

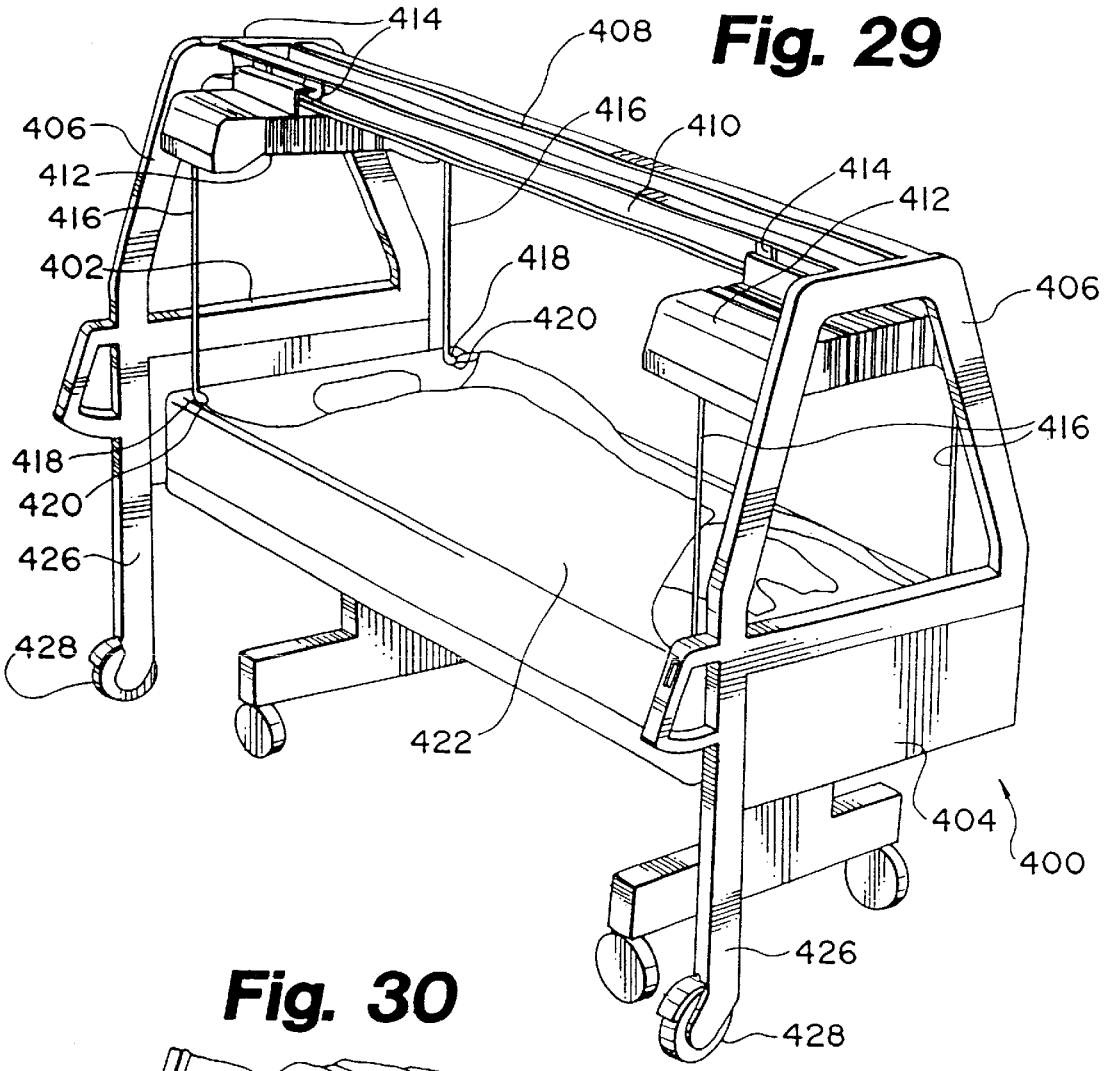
Fig. 29
Fig. 30
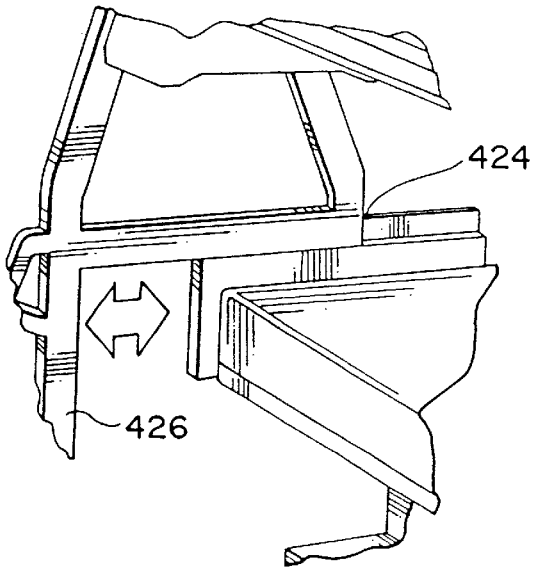

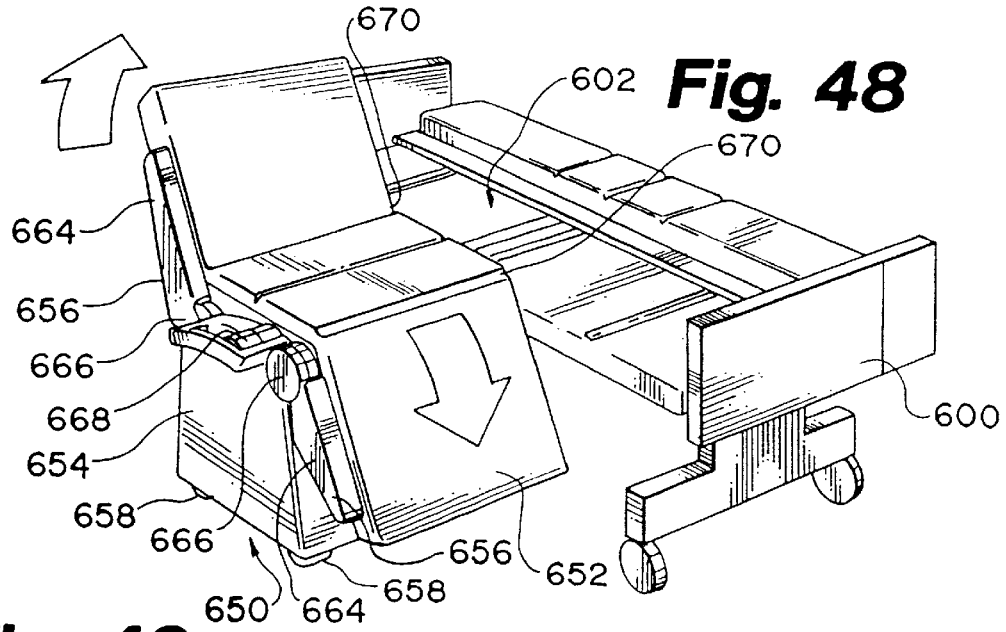
Fig. 48
Fig. 49
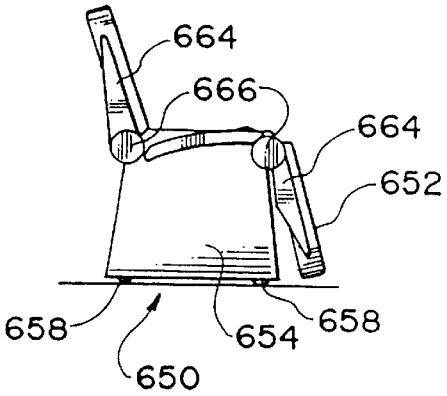
Fig. 50
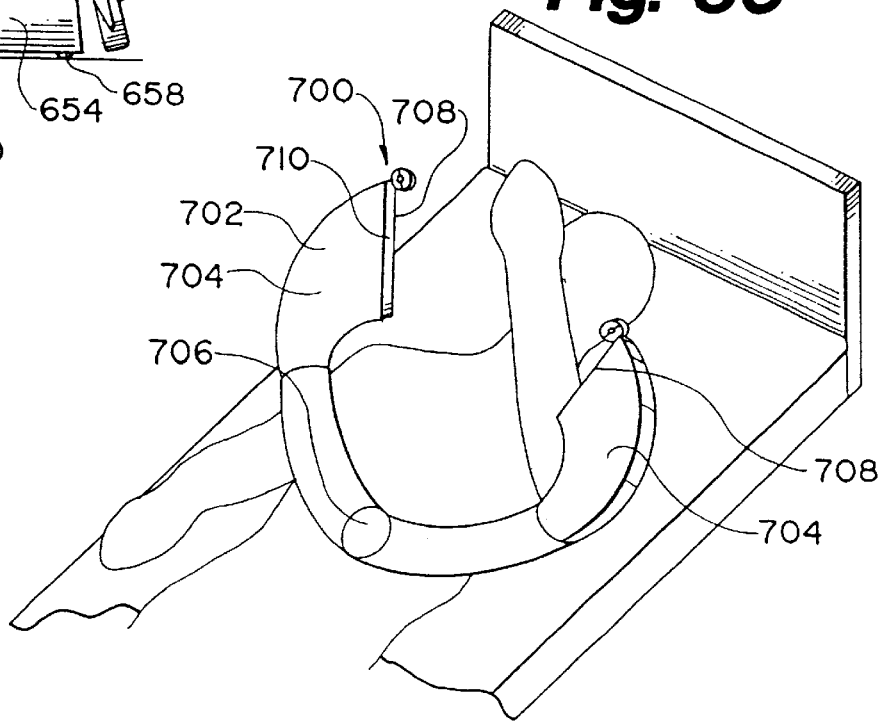

Fig. 51
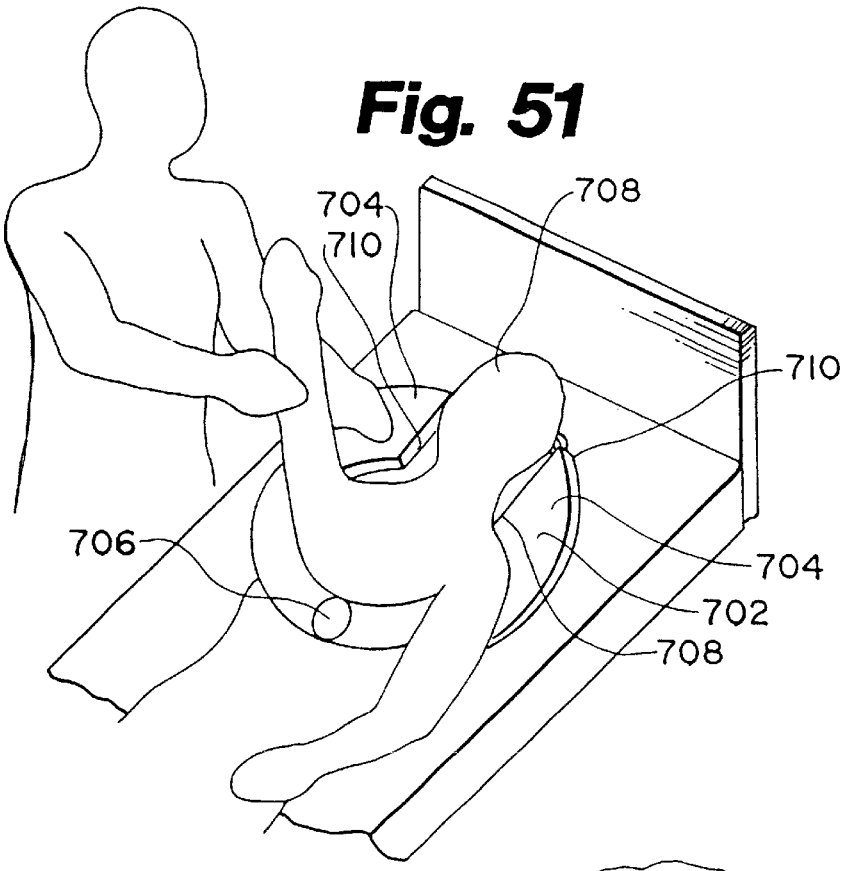
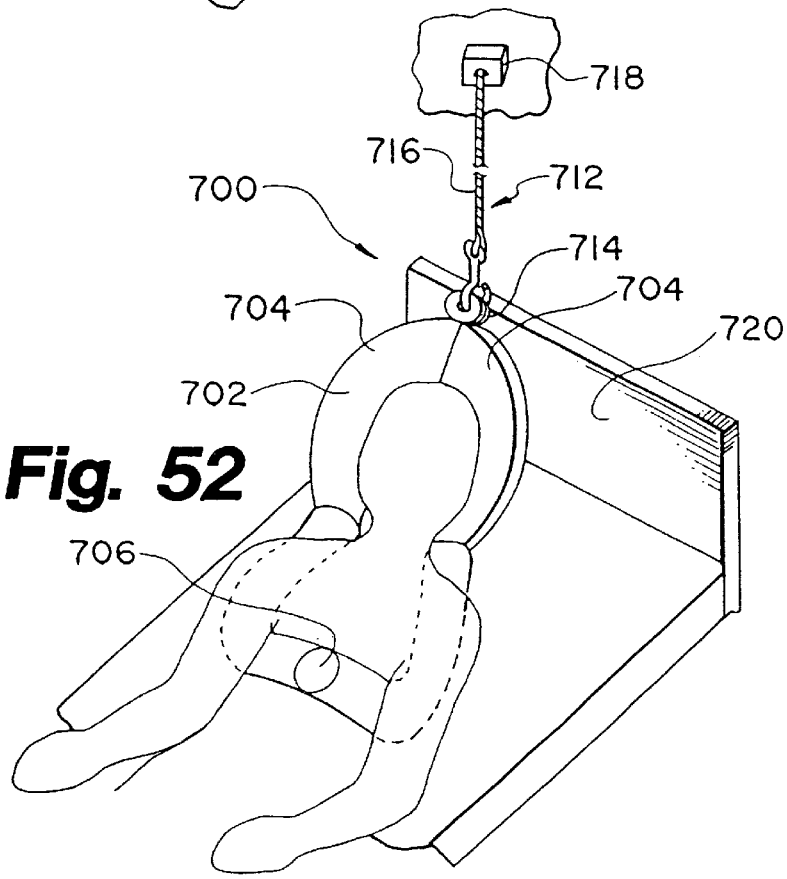
Fig. 52

FIG. 96
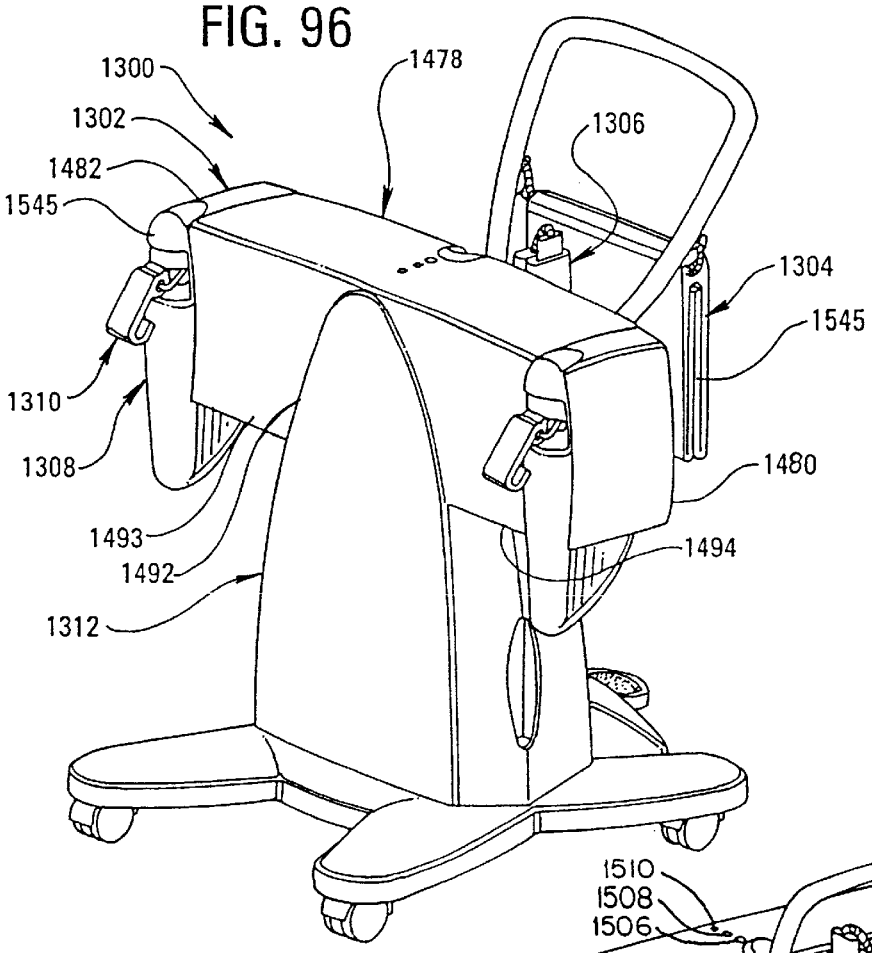
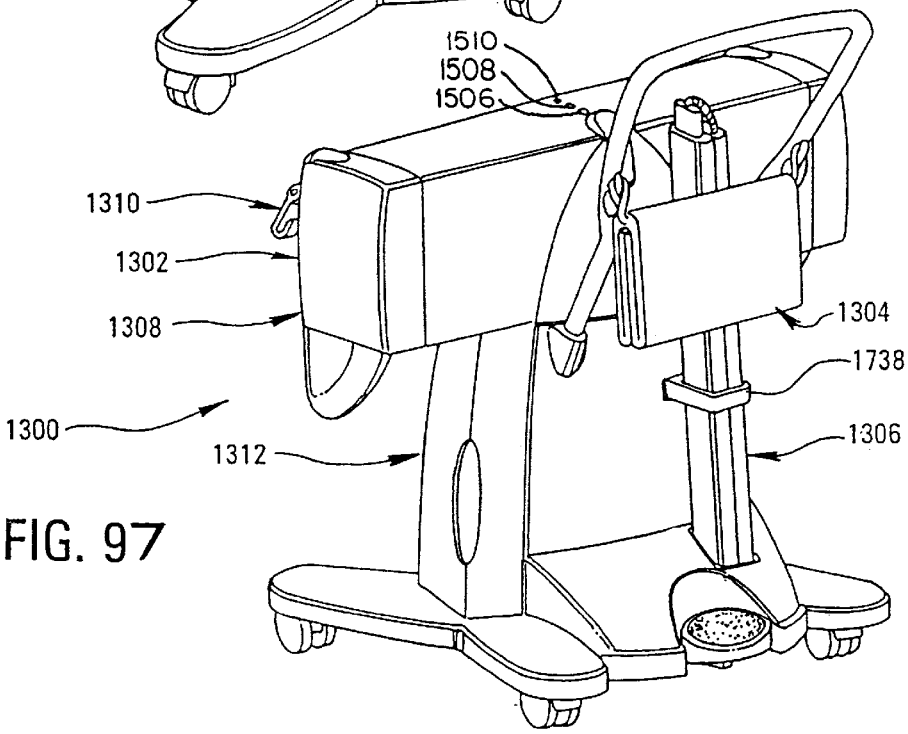
FIG. 97

2142
2146
2188
2140
2146
2188

2148
2178
2168
2180
2170
2166
2174
2162
2150
2168
2166
2172
2160
2172
2166
2170
2168
2156
2146
2144
2184
2166
2174
2150
2168
2158
2172
2166
2174
2168
2170
1306
2172
2166
2180
2178

2178
2144
2162

FIG. 108
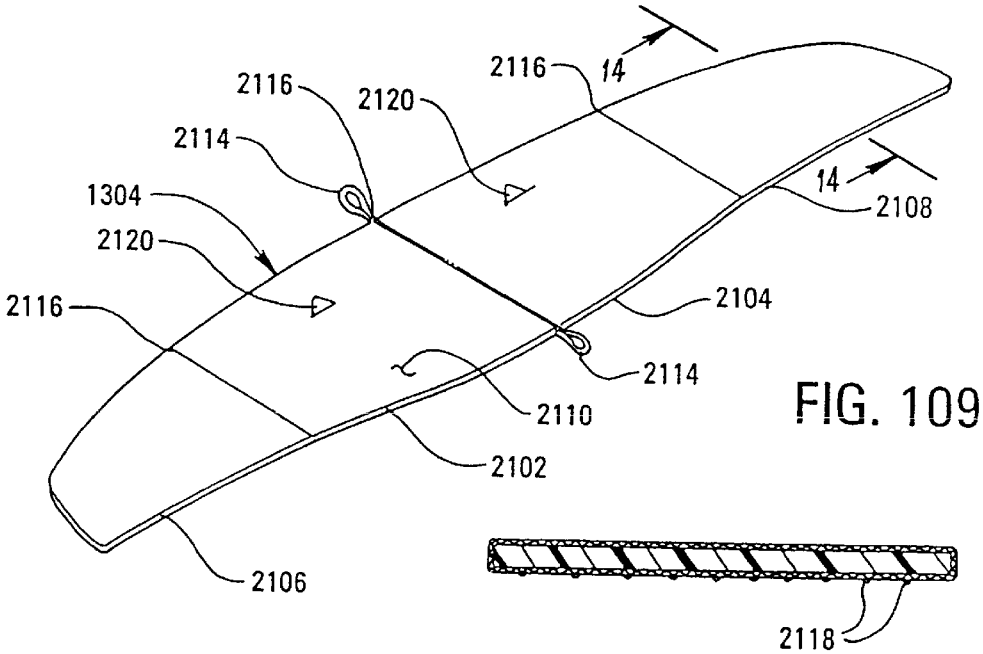
FIG. 109
FIG. 110
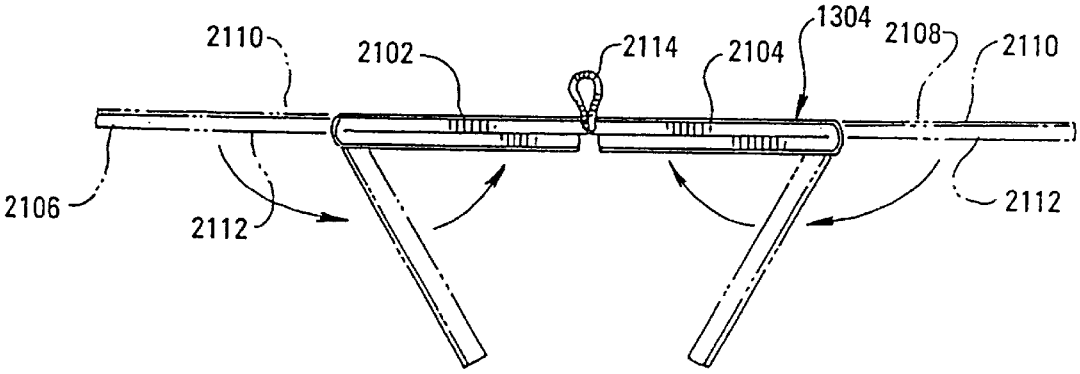

PATIENT TRANSFER SYSTEM

CROSS-REFERENCE TO RELATED APPLICATIONS

This is a continuation-in-part of U.S. patent application Ser. No. 08/713,412, filed Sep. 13, 1996, now U.S. Pat. No. 5,890,238, which is a continuation-in-part of U.S. patent application Ser. No. 08/527,519, filed Sep. 13, 1995 and now U.S. Pat. No. 5,737,781. This application claims the benefit of U.S. Provisional Patent Application No. 60/043,208, filed Apr. 8, 1997.

FIELD OF THE INVENTION

The invention relates to systems which assist in moving patients who are partly or completely incapacitated. The invention more particularly relates to systems which give a single health care worker the capability to move a patient from one bed to another bed, between a bed and a cart or gurney, between a sitting and a standing position or between a slumped position in a chair or bed and a more elevated position.

BACKGROUND OF THE INVENTION

Health care workers at hospitals, nursing homes, and home care programs face the challenge of moving partly or completely incapacitated patients. A typical patient weighs between 45 and 90 kilograms, although many others weigh more. Consequently, at least two to four health care workers are usually needed to move the patient. These activities often create unacceptable risks of injury, almost without regard to the number of health care workers used in the patient transfer. The risks are particularly high when a sufficient number of workers is not available to assist in a patient transfer. For example, injuries to workers' backs account for approximately 50% of worker's compensation costs for work place injuries in the health care industry in the United States. Thus, back injuries to health care workers are a particularly vexing problem.

Patient transfers can be placed in several broad categories. A first category includes the horizontal transfer of a patient from one flat surface to another. A second category involves upright transfers where a patient is moved from a horizontal position to an upright or sitting position in a wheelchair, chair or commode, and the return of the patient to the horizontal position from an upright or sitting position. A third category of transfer relates to the positioning or movement of patients in order to change their position in a bed or chair, for example pulling the patient up in the bed or rolling the patient from side to side. Although many attempts have been made to devise improved systems for patient transfer, almost all of these transfers continue to be manually performed.

Current healthcare guidelines typically recommend that four health care workers participate in a patient transfer. Two workers are at the bed side and two workers are at the cart side. Each worker grabs an edge of a draw sheet, which is positioned under the patient. The patient is then transferred between the bed and the cart through a combination of lifting, pulling, and pushing. An elongated plastic sheet is often placed beneath the patient to reduce friction or drag. Since a health care worker has to bend over at the waist to accomplish these patient transfers, the stresses encountered are magnified well beyond what would otherwise be expected for a maximum recommended lift of approximately fifty pounds. Normally this recommended maximum lift is measured with the lift at or near the worker's center of mass. Extremes in a health care worker's height, either taller or shorter than average, or any weakness in either the arms or legs further exaggerate these risks.

Many hospitals have swing-type mechanical lift devices to assist in certain patient transfers. However, these devices are not widely used because they are often cumbersome and time-consuming to set up and operate. Depending on the lift required, the devices may also be inappropriate.

The upright transfer and positioning categories provide similar difficulties, especially if the patient is unable to cooperate. For example, weak and elderly patients reclining in a semi-erect position tend to slide down. These patients must be returned to a position more toward the head of the bed. To do so, two health care workers usually grasp the patient by the upper arms to hoist the patient toward the head of the bed after the bed has been lowered to a more horizontal position. This manual transfer often causes strain on the workers' upper and lower backs and possible contact bruises on the patient. Similar difficulties occur with upright transfers.

Given these formidable difficulties, there have been other attempts to mechanize the patient transfer process. For example, U.S. Pat. No. 2,665,432 (Butler), describes a cart with a manual crank connected to an extensive pull unit. The pull unit has a large number of straps which connect at an edge by hooks to a transfer sheet. Rotation of the crank winds the pull unit onto a roller. The size of the pull unit presents many difficulties including its attachment at many locations to the sheet and the awkwardness of winding it on the roller. The pull unit must be placed under the patient just prior to transfer, since it would not normally be kept there. Also, no means are provided for transferring the patient off the cart.

U.S. Pat. No. 2,827,642 (Huff) describes a similar system mounted to the head of a bed and designed to move a patient from the foot toward the head of the bed. The '642 Patent does not describe the process of moving a patient laterally from one horizontal surface to another.

U.S. Pat. No. 4,970,738 (Cole) discloses another patient transfer system which employs a manual crank and self-locking gear system. This system has an advantage over the system described in the '432 patent in that the transfer is reversible. Rotating the crank drives a belt system, which is attached to a semi-rigid transfer apron. The apron is thereby transferred horizontally while supporting a patient. This system has the disadvantage that the apron must be first positioned under the patient before the patient can be transported from a bed onto a cart. Another disadvantage is that the transfer support alone does not provide sufficient support for the patient or the transfer system. Because of the complexity of its design, considerable operator interaction would be required for the transfer support to be mounted to a cart and then operated to transfer a patient.

U.S. Pat. No. 2,733,452 (Tanney) describes a transfer system that uses a motorized pulley to transfer a patient on a metal-reinforced transfer sheet. The transfer sheet has metal grommets in its corners for attachment to cables. A motor is used to wind the cables onto reels thereby resulting in the transfer of the sheet and the patient thereon. However, the patient must first be moved onto the transfer sheet before being moved from a bed to the cart. Moreover, this invention fails to provide support beneath a patient being transferred.

U.S. Pat. Nos. 4,747,170 and 4,868,938 (both to Knouse) reveal a motorized winch-type transfer system. This transfer system has apparent advantages over the transfer system of the '452 patent, which include a more secure transfer sheet gripping mechanism and the use of a transfer sheet which does not need grommets or other similar devices. Though more secure, the gripping system is difficult and awkward to use.

U.S. Pat. No. 5,038,424 (Carter et al.) teaches a system for reciprocally transferring a patient between a bed and a cart. This system employs a pliable transfer web wound about two detachable, cylindrical rollers and a drive motor mounted on the bed and the cart. In use, the bed and cart are positioned side-by-side and the web is placed beneath the patient. The roller adjacent the cart or bed onto which the patient is to be transferred is detached. While unwinding a sufficient length of transfer web wound thereon, the roller is extended to the opposite side of the bed or cart onto which the patient is to be transferred, and there connected to the drive motor. The drive motor is then activated, thereby rewinding the transfer web onto the roller and transporting the patient disposed thereon. Thus, while enabling reciprocal transfer, the system of the '424 patent is time consuming and awkward to set up. Moreover, as in the previous inventions discussed hereinabove, the patient is not supported adequately while being transferred.

While considerable effort has gone into developing horizontal patient transfer systems, all of the systems previously developed have significant drawbacks. These drawbacks primarily relate to the significant difficulties encountered in set-up and operation.

The patents described hereinabove primarily relate to systems for transferring patients from one horizontal surface to another horizontal surface. By partial contrast, U.S. Pat. Nos. 4,700,415 and 4,837,873 (both to DiMatteo et al.) teach a system for transferring patients between a reclined wheelchair and a bed. The bed is equipped with a sheet wound about a right side roller and a left side roller. The sheet is positioned beneath a patient reclining thereupon. The right and left side rollers are positioned laterally on each side of the bed, usually slightly below the plane of the patient. Two corner rollers are situated above the right side and left side rollers. The two corner rollers are approximately level with the top surface of the bed. The reclined wheelchair is equipped with two articulated rollers. Extending between these articulated rollers is a sheet, the sheet including three bands. The lateral edges of the sheet may be joined or separate. If the lateral edges are to be joined, the sheet spans above and below the wheelchair upper surface. If the lateral edges are free, the sheet spans the wheelchair upper surface with its ends wound about the two rollers. The separate transfer systems for the bed and wheelchair must be powered such that both sheets rotate with equal velocities. In use, the patient reclining upon the bed is conveyed laterally by the bed transfer system. Upon encountering the wheelchair transfer system, the patient is thereupon further conveyed onto the wheelchair. The wheelchair may then be further adjusted, allowing the patient to assume a sitting position.

The system of DiMatteo allows for transfer to or from a reclining wheelchair and for adjusting the wheelchair between sitting and reclining positions. However, its shortfalls include the complexity of its design, the need to retrofit beds with the rollers and sheet provided, and the possibility of pinching the patient or catching clothing in the gaps between the bands.

U.S. Pat. No. 3,597,774 (Warren) describes a harness and winch mechanism for raising a patient reclining upon a bed. The winch is mounted to a post attached to the head of the bed and is operated by a hand crank. The harness loops under the patient's armpits such that excessive stress may be applied thereto during operation of the device.

SUMMARY OF THE INVENTION

The invention includes devices for transferring patients which greatly simplify, and provide enhanced versatility over, any known device. The adoption of these transfer devices will likely reduce the wide incidence of back injuries in health care workers. A first system for the horizontal transfer of patients is adapted to use existing transfer sheets and an appropriately modified cart. The sheet is readily attached to a clamping device close to the patient. The clamping device has a releasable catch which holds the sheet. One or more straps are attached to the clamping device, and the other ends of the straps are attached to reels that are part of a winch. Activation of the winch winds the straps onto the reels. In a highly portable embodiment of this transfer device, the entire apparatus may weight only about 8–15 kilograms, and may be readily attachable and removable to bed and cart rails.

A long narrow rectangular cushion can be placed between the bed and cart when using the portable transfer device. The cushion is, optionally, the length of the bed, and may be partially coated with a low friction surface. The cushion may have fasteners for attachment to a bed or cart, or it may also be configured to hang from the side of the bed or cart by the fasteners when not in use. The cushion is particularly convenient when used with a portable transfer device of the invention because no other modifications to the bed or cart may be needed.

Other embodiments of horizontal transfer devices facilitate the transfer of the patient by providing some lift to the patient as well as horizontal motion. The vertical and horizontal transfer mechanisms may both be operably attached to a single bed or cart frame. One embodiment of a horizontal transfer mechanism within the invention has a transfer element that moves within tracks. Another embodiment of a horizontal transfer system of the invention moves the patient on a modularized cushion. In other embodiments, lift is added by use of a harness which provides significant advantage in distributing the weight of the patient without the need to lift the patient to place a portion of the harness under the patient. The harness has a support that goes across the patient's upper body. Another portion of the harness goes under the patient's arms. The harness has a fastener that attaches a lift mechanism near the back of the patient's head.

An improved patient transfer system is capable of transferring a patient using only a single attendant. The transfer system includes patient transfer means for transferring the patient, a transfer sheet, a retaining member assembly operably coupled to the patient transfer means and a contact element assembly.

The improved transfer system may also include a highly portable transfer unit. The portable transfer unit may be totally self-contained or may be installable on a bed or cart and connectable to a separate clamp. The portable transfer unit may utilize a plurality of detachable spools, as well as means for sensing the proximity of a patient being transferred and means for discontinuing the transfer in response to the sensing.

The improved transfer system may still further include a transfer bridge support means for supporting a patient being transported when the patient spans the bed or cart. The transfer bridge support means may be foldable and may include a stabilizer, a cross sectional camber and a leading edge camber to further prevent the transfer bridge support means from being displaced during patient transfer, and improved slip-resistant features.

A system for enabling a person to singly and ergonomically transfer a patient disposed on a sheet as provided. The system may include a caddy. The caddy may include means for enabling the person to transport the caddy from a first location to a second location, a power train, a hook and web assembly attachable to the power train, a power and switching system in electrical communication with the power train, and means for adjusting a vertical position of the hook and web assembly. The transport means may be operably disposed proximate the caddy. The system may further include means for gradually accelerating and decelerating a transfer force exerted by the power train. The power train may include a motor and a plurality of spools in mechanical communication with the motor. The plurality of spools may further be in mechanical and magnetic communication with the motor. The power train may still further include a plurality of magnetic clutch assemblies and a plurality of slip plates. Each magnetic clutch assembly may be in mechanical communication with the motor and each slip plate may be in magnetic communication with one of the magnetic clutch assemblies. Each spool may be in mechanical communication with one of the slip plates.

The hook and web assembly may include a plurality of webs and a plurality of transfer hooks, each web being connectable to one of the spools and each transfer hook being connectable to one of the webs. The power and switching system may further include means for automatically discontinuing a transfer. The system may provide a transfer rod, the transfer rod accommodating the transfer hook when at least a portion of the transfer sheet is wrapped around the transfer hook. The transfer rod may include a plurality of joinable sections, the sections may be elastically connected.

The system may further include a transfer bridge. The transfer bridge may further include a low-friction surface and a plurality of sections, foldable into a generally facing relationship.

There is also provided a movable caddy for enabling a single person to ergonomically turn a patient disposed on a sheet in cooperation with sheet-gripping means or to transfer the patient from a first horizontal surface to a second horizontal surface in cooperation with the sheet-gripping means. The caddy may include a base assembly, the base assembly including means enabling a single person to transport the caddy from a first site to a second site, a vertical adjustable head assembly, the vertical adjustable head assembly including a power train, the power train including a motor, a plurality of magnetic clutches, a plurality of slip plates, and a plurality of spools. Each magnetic clutch may be in mechanical communication with the motor. Each slip plate may be in magnetic communication with one of the magnetic clutches. Each spool may be in mechanical communication with one of the slip plates. The magnetic clutches and the slip plates may cooperate to exert a gradually accelerable transfer force. The system may further include a hook and web assembly with a plurality of webs and means for gripping the sheet. A first end of each web may be windably attachable to one of the spools. The sheet-gripping means may be attachable to a second end of each of the belts. The sheet-gripping means may grip a portion of the sheet, thereby transmitting the transfer force to the gripped sheet. The sheet-gripping means may include a plurality of transfer hooks and a transfer rod. Each transfer hook may be attachable to a second end of each belt and each transfer hook may cooperate with a transfer rod to grip the sheet.

There is also provided a transfer rod for cooperatively gripping and exerting a transfer force on a sheet. A portion of the sheet may be partially enwrapped around the transfer rod, the transfer rod exerting the transfer force in cooperation with the plurality of transfer hooks. The transfer rod may include means for mating with the transfer hooks.

There is also provided a transfer bridge. The transfer bridge may include a first inboard member, a plurality of outboard members, means for interfolding the inboard and outboard members, and means for reducing friction arising from contact between a sheet and the transfer bridge. An outboard member may extend from a lateral edge of the first inboard member. The transfer bridge may include a second inboard member and an outboard member may extend from each inboard member.

BRIEF DESCRIPTION OF THE INVENTION

FIG. 21 is a perspective view of the further embodiment of the horizontal transfer system with an alternative design for the horizontal drive;

FIG. 24 is a partial perspective view of one end of the embodiment of FIG. 21 with an arrow showing the disengagement of a removable panel;

FIG. 25 is a partial perspective view of one end of the embodiment of FIG. 21 with a removable panel attached as a shelf;

FIG. 29 is perspective view of an alternative embodiment of the horizontal transfer system;

FIG. 30 is a perspective view of a portion of the alternative embodiment of FIG. 29 showing extendable horizontal supports;

FIG. 48 is a perspective view of the mattress transfer system and position changing cart depicting the cart in a folded position;

FIG. 49 is a side view of the position changing cart in the chair orientation;

FIG. 50 is a perspective view of a lobster claw type of bed jacket being placed on one side of a person;

FIG. 51 is a perspective view of the bed jacket in place around a person;

FIG. 52 is a perspective view of the bed jacket secured around a person and hooked to a hoisting mechanism;

FIG. 96 is an elevated left perspective view of the patient transfer system of the present invention;

FIG. 97 is an elevated left perspective view thereof;

FIG. 108 is an elevated perspective view of the transfer bridge of the present invention;

FIG. 109 is a cross section taken along lines 109—109 of FIG. 108;

FIG. 110 is a side plan view depicting the transfer bridge of FIG. 108 being folded for storage or transport;

Figure 133:
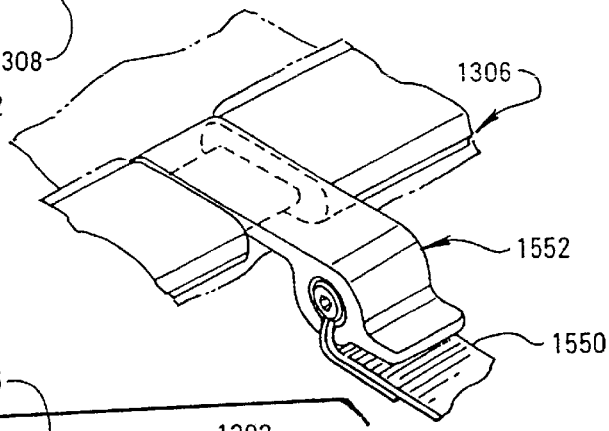
Figure 132:
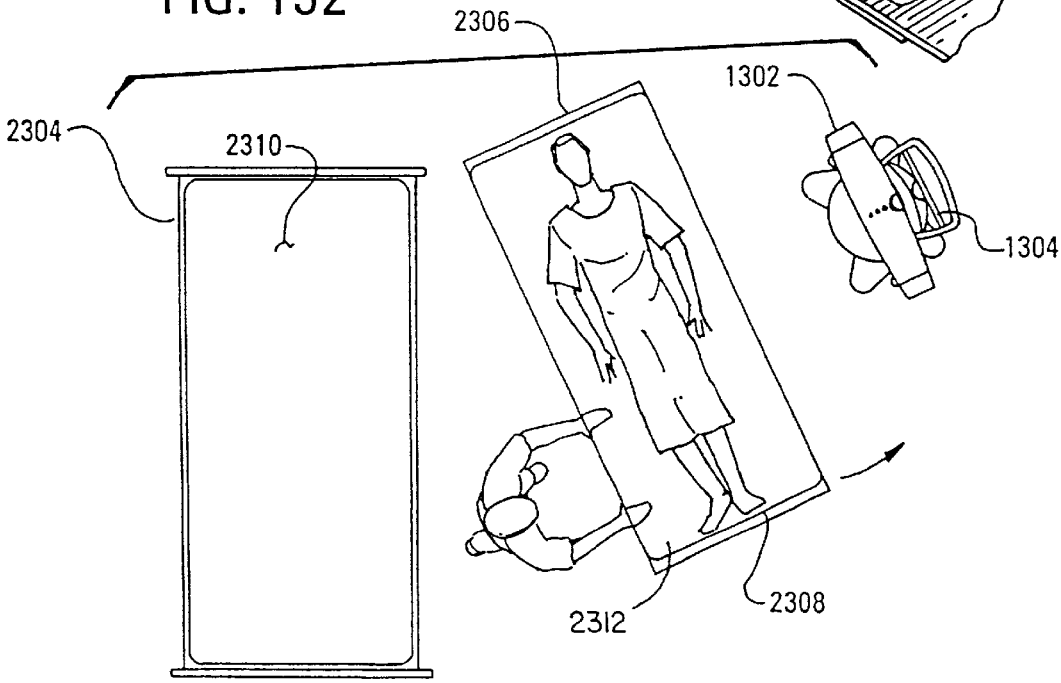
Figure 134:
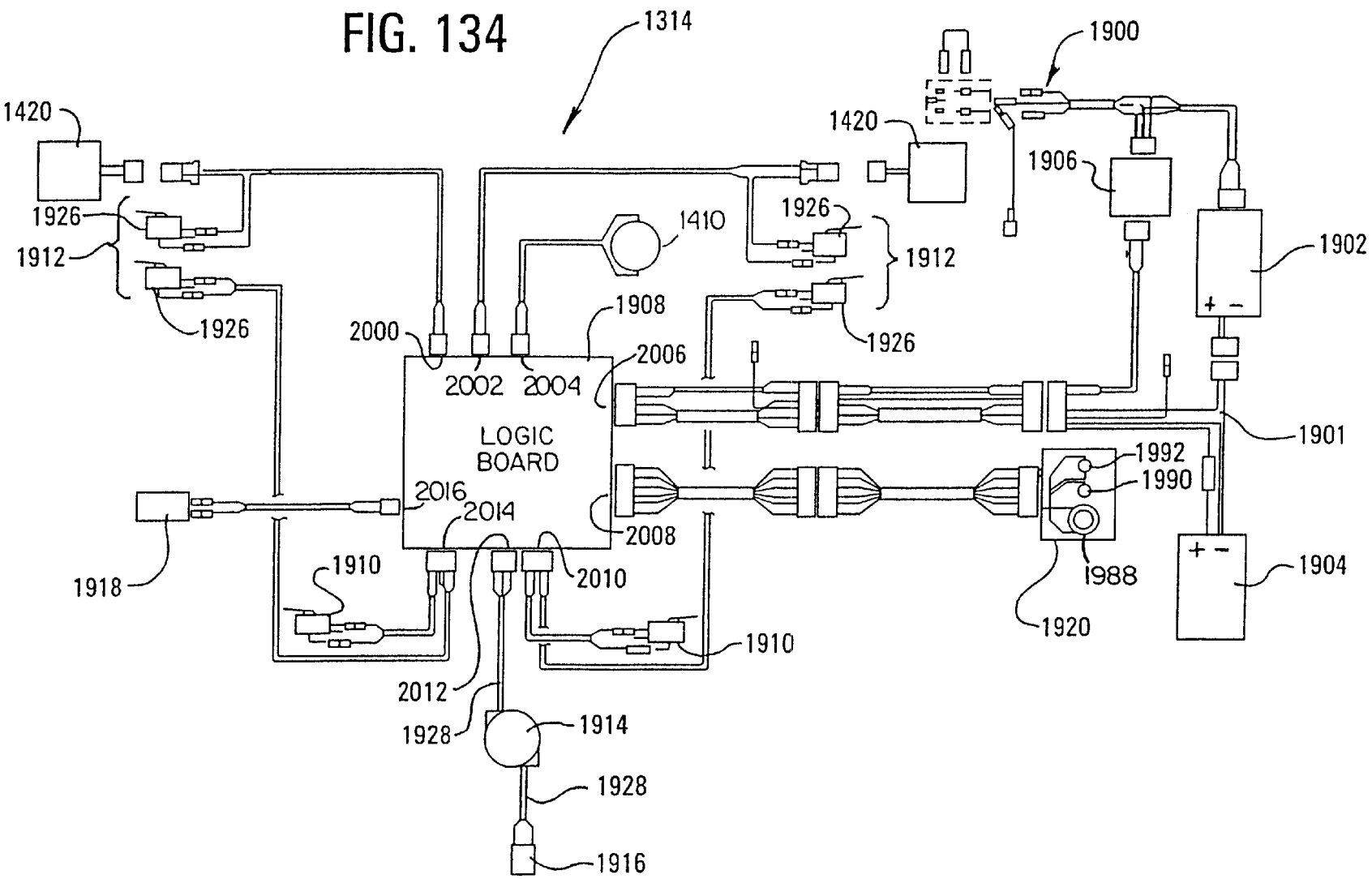
Figure 135:
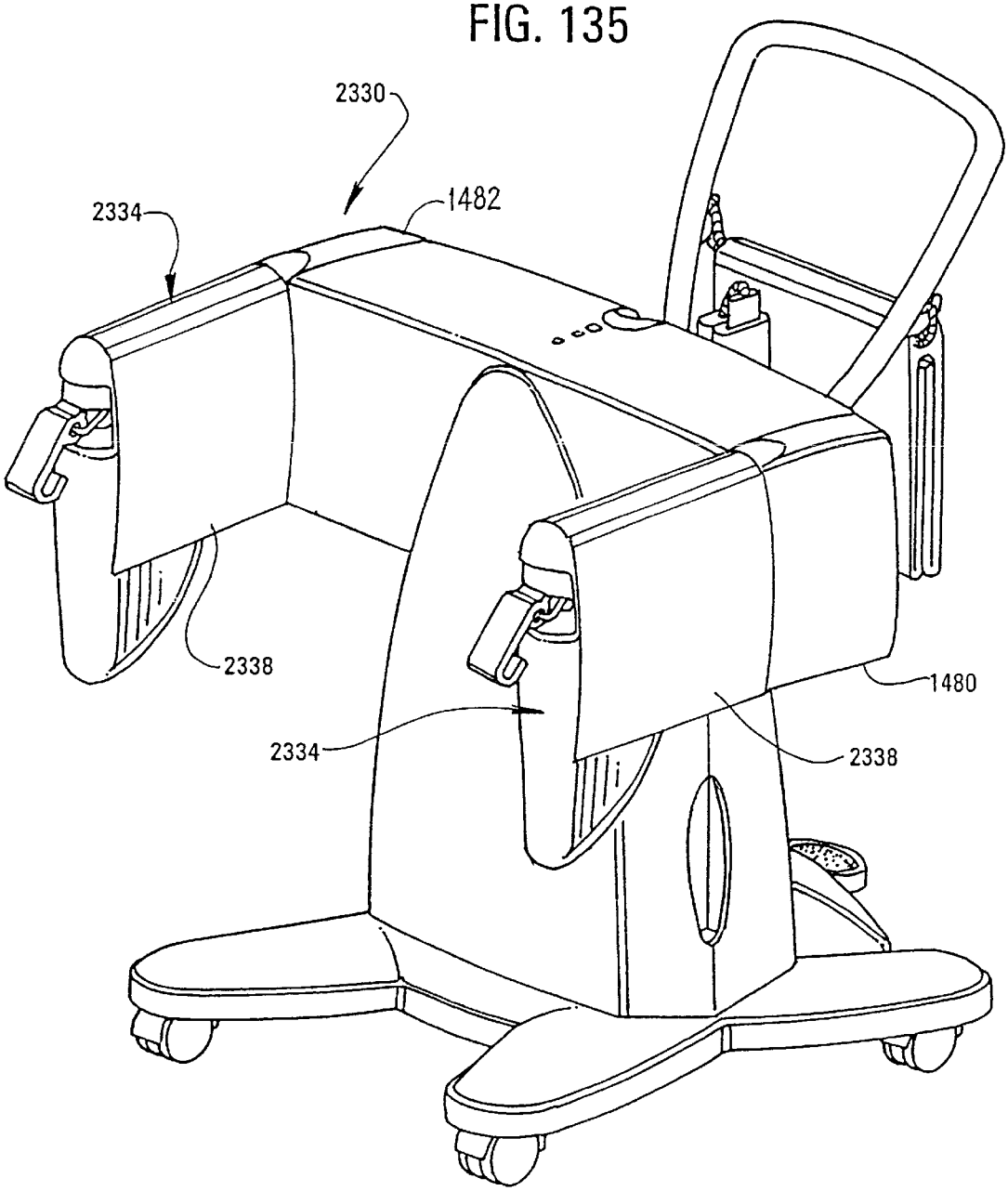
Figure 136:
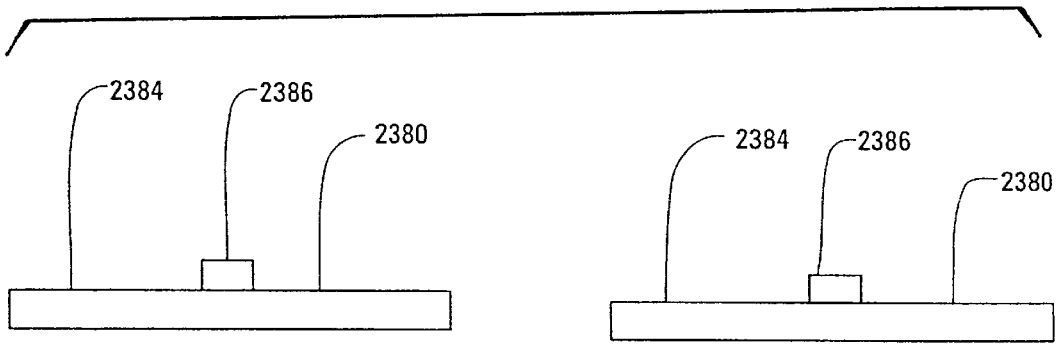

FIGS. 122–132 sequentially depict a patient transfer event by an attendant using the patient transfer system of the present invention;

FIG. 133 is a fragmentary elevated left perspective view of a transfer hook emplaced over an enwrapped transfer bar of the present invention;

FIG. 134 is a diagram of the electrical and switching system of the present invention;

FIG. 135 is an elevated perspective view of another embodiment of the patient transfer system of FIG. 96, with extended bumpers; and FIG. 136 is a top plan view of a pair of sheet grippers alternately used with the patient transfer system of FIGS. 96 and 135.

DETAILED DESCRIPTION OF THE PREFERRED EMBODIMENTS

The invention includes improved devices and methods for moving patients and other individuals who lack full mobility. Patients must be moved in a variety of ways in health care facilities such as hospitals, nursing homes and other residences. For example, patients may need to be transferred horizontally between a bed and a cart, they may need to be repositioned in a bed or chair, or they may need to assume a prone, sitting or standing position. The unifying feature of the various embodiments of this invention is enabling empowering a single health care worker to move a patient in a substantially low risk manner to either the patient or the healthcare worker. The embodiments of this invention further allow a patient transfer event to require between about 20 seconds and 28 seconds and preferably about 24 seconds.

A feature of the horizontal transfer systems of the present invention includes a support beneath the patient and a mechanical or electromechanical system for applying a horizontal force to the support to effect the transfer. The designs of the various embodiments incorporate varying features to achieve this utility. In order to reduce cost, the simplest systems are designed to be adapted for use with beds, carts and transfer sheets now commonly in use in health care facilities. Other embodiments optimize the particular characteristics of the design with less regard to adaptation to existing equipment. In all cases, each design focuses toward the goal of a safe and efficient ergonomic patient transfer event by a single health care worker. Each design also focuses toward greatly reducing the number of healthcare workers required for each transfer event.

This is a continuation-in-part of U.S. patent application Ser. No. 08/713,412, filed Sep. 13, 1996, which is a continuation-in-part of U.S. patent application Ser. No. 08/527,519, now U.S. Pat. No. 5,737,781. The embodiments of the present invention described hereinbelow are also disclosed in U.S. Provisional Application Ser. No. 60/023,572, filed Aug. 19, 1996, in U.S. Provisional Application Ser. No. 60/025,084, filed Aug. 30, 1996, and U.S. Provisional Application No. 60/043,208, filed Apr. 8, 1997, the entire contents of each being hereby incorporated by reference.

Figure 1:
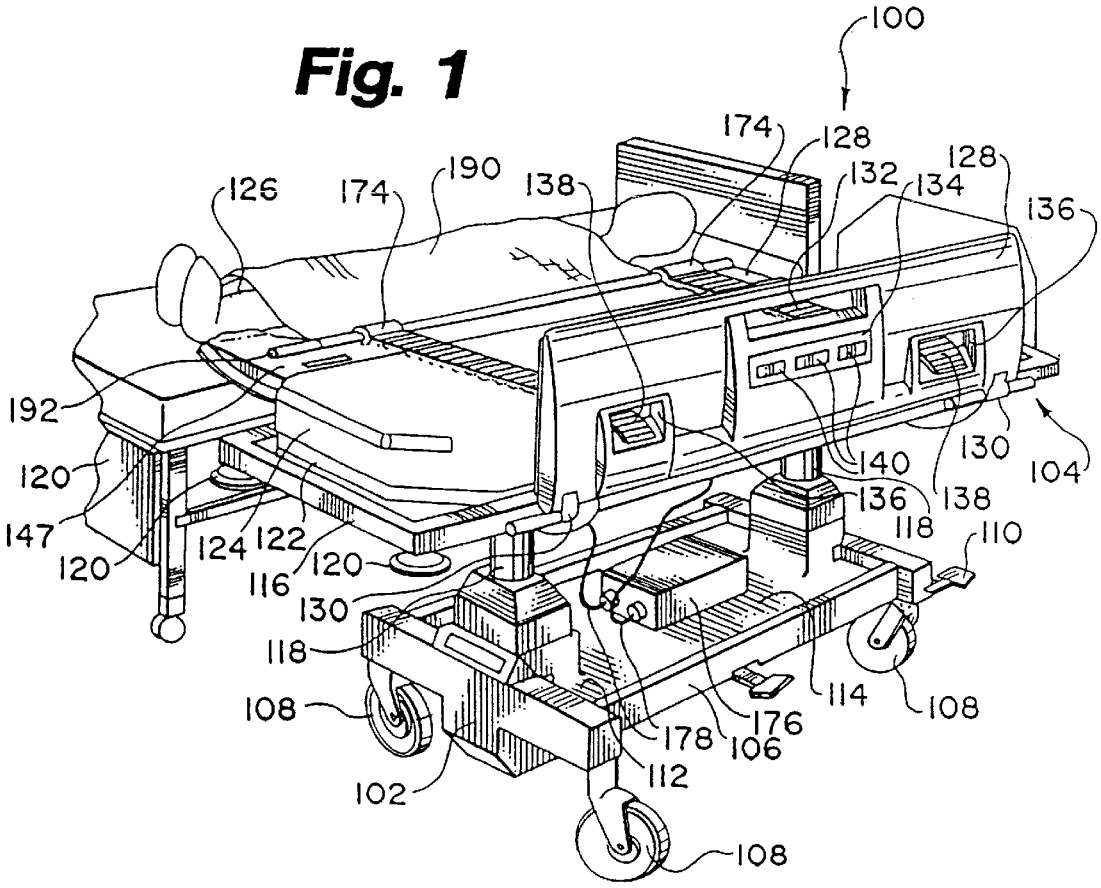
FIG. 1 is a perspective view of a bed with an adjacent cart adapted with a first embodiment of a horizontal patient transfer system.

Referring to FIG. 1, the first exemplary embodiment of horizontal transfer system 100 includes standard patient cart 102 retrofitted with horizontal transfer mechanism 104. Cart 102 will generally have base 106 with four wheels 108. Wheels 108 preferably have lock levers 110 for applying brakes to prevent rotation of wheels 108. Base 106 may have a top surface 112 that usually, but not necessarily, will have a flat portion 114.

Cart 102 includes support portion 116. Support portion 116 is attached to base 106 by one or more upright supports 118. The exemplary embodiment represented in FIG. 1 has two upright supports 118. Some designs may have wheels 108 attached directly to upright supports 118, thereby eliminating the need for base 106. Support portion 116 will preferably include cushioned bumpers 120. Cart 102 may have the capability of raising and lowering support portion 116 relative to base 106, as well as other features. Support portion 116 provides support structure 122 for supporting cushion (or mattress) 124 for holding patient 126.

Figure 2:
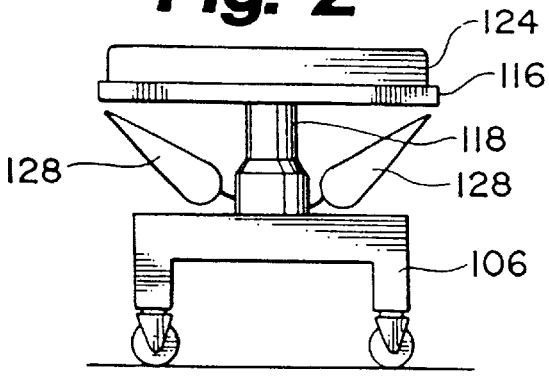
FIG. 2 is a front, schematic view of a cart adapted with the first embodiment of a horizontal patient transfer system with side rails in a lowered storage position.
Figure 3:
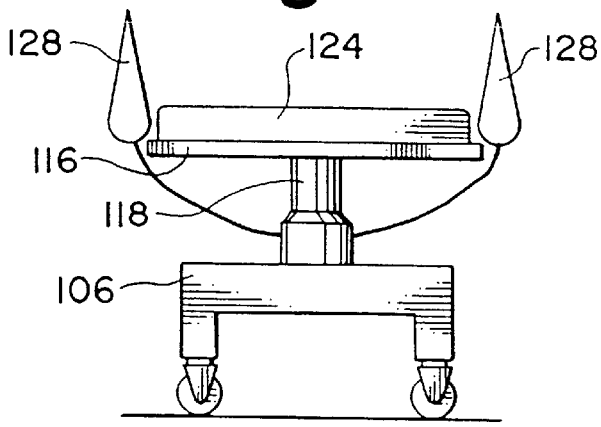
FIG. 3 is a front, schematic view of a cart adapted with the first embodiment of a horizontal patient transfer system with side rails in a raised patient transport position.
Figure 4:
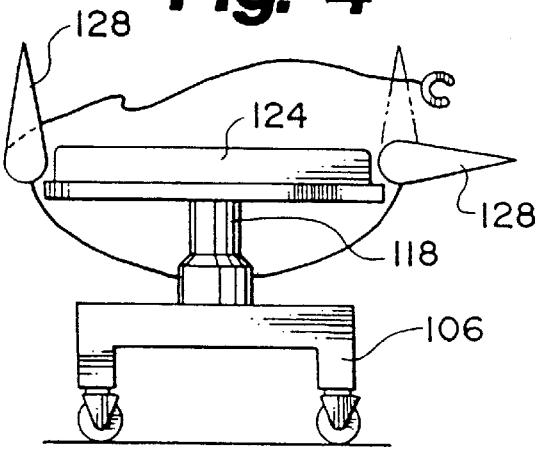
FIG. 4 is a front, schematic view of a cart adapted with the first embodiment of a horizontal patient transfer system with one side rail in a raised position and a second side rail in a bridge position used during patient transfer.
Figure 5:
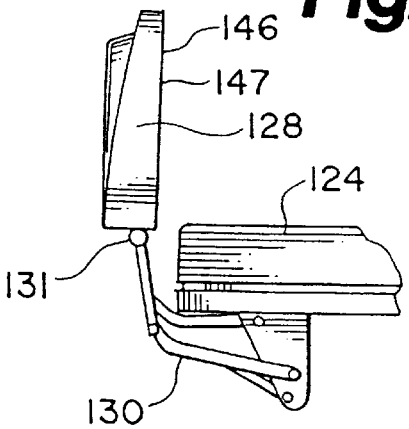
FIG. 5 is a front fragmentary view of one embodiment of hinges supporting a side rail.

Exemplary horizontal transfer mechanism 104 includes two side rails 128. Referring to FIG. 5, side rails 128 are mounted to cart 102 by hinges 130, 131. Side rails 128 and hinges 130, 131 are preferably adapted from existing side rails and hinges on cart 102. Hinges 130, 131 can adjust to place side rails 128 in either an elevated pull position or a lowered storage position as depicted in FIG. 2. Preferably, hinges 130, 131 are used to place side rails 128 in a horizontal bridge position to provide support and a smooth surface for transferring the patient (FIG. 4). The different positions are schematically depicted in FIGS. 2–4. Alternative designs for the side rail may allow for the side rail to slide straight down to a lowered position, although other variations are within the spirit and scope of this invention.

Figure 6:
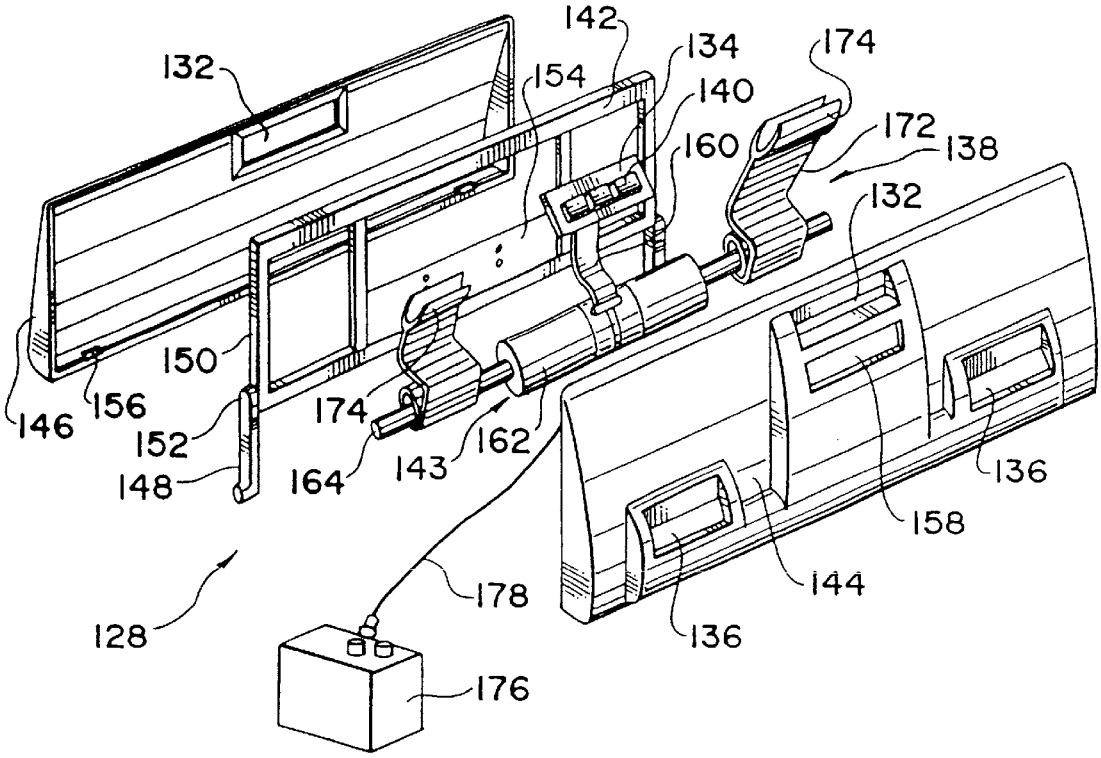
FIG. 6 is an exploded view of a side rail of the first embodiment of a horizontal transfer system.

Referring to FIG. 6, each exemplary side rail 128 includes handle 132, control panel 134 and a plurality of openings 136 for a power assembly, such as winch 138. Other openings may be used for access to the winch unit. Control panel 134 has a plurality of switches 140 to control the operation of winch 138. The particular design of side rail 128 and control panel 134 may be varied without effecting their function.

Referring to FIG. 6, a convenient structure for side rail 128 includes frame 142, winch 138, front cover 144 and back cover 146. Frame 142 further includes extensions 148 attached to frame substructure 150 at frame hinge 152. Frame substructure 150 may include winch mounting portion 154. Frame substructure 150 may be made from metal, a rigid polymer or a composite material, although other materials exhibiting the proper strength, weight, and cost characteristics may be suitable. Back cover 146 may define open portions 156 and handle 132. In this example, extensions 148 are disposed through open portion 156. Moreover, the sizes and configurations of open portions 156 admit frame hinges 152. Open portions 152 are further dimensioned to admit coincident movement when side rail 128 is raised or lowered by pivoting side rail 128 on hinges 152. Outer surface 147 of back cover 146 (FIG. 5) is a transfer surface which may include a low friction material to assist with the transfer process and reduce the risk of injury. Front cover 144 includes a mated part of handle 132. Front cover 144 further defines openings 136 and control panel opening 158.

Figure 7:
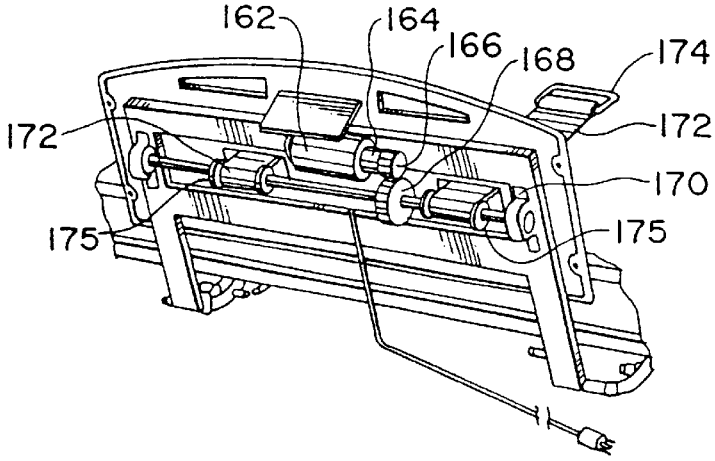
FIG. 7 is a cut away view of a second drive system within the side rail.

Winch 138 is coupled to control panel 134 by wires 160. A conventional manual winch may also be used without excess difficulty, but less conveniently. Drive system 143 may include at least one motor 162. Both drive system 143 and motor 162 may be configured in a variety of conventional designs. Motor 162 may directly rotate drive shaft 164 as depicted in FIG. 6. In the embodiment of FIG. 7, motor 162 rotates first drive shaft 165, thereby rotating first gear 166. First gear 166 engages second gear 168. Second gear 168 is connected to second drive shaft 170. Second gear 168 may have a larger diameter than first gear 166, thereby causing a reduced rate of rotation of second drive shaft 170 relative to first draft shaft 165.

Two belts 172 each with a clip 174 are attached to second drive shaft 170 at positions coincident openings 136. Belts 172 preferably wind on spools 175. Spools 175 help ensure that belts 172 wind and unwind straight. Belts 172 are preferably made from very strong synthetic fabric such as the material used in seat belts for automobiles. Winch 138 may be powered by a battery pack 176. Winch 138 and battery pack 176 are electrically connected by power cord 178. Alternatively, winch 138 may be powered by alternating current using another power cord (not shown). Cart 102, or any other embodiment of the present invention, may also include aligning and docking mechanisms. Aligning mechanisms may further include powering and steering means, whereby at least two wheels 108 of cart 102 are powered and steered by operation of control switches 140. Docking mechanisms may include clamps and electromagnets. These clamps and electromagnets may also be operated by control switches 140. These clamps and electromagnets may secure cart 102 to the horizontal surface onto which the patient is to be transferred.

In addition to control switches 140, hand-held remote control units communicating with the control mechanism of cart 102 by electric or electromagnetic means are within the scope of the present invention. Voice actuated controls are also within the scope of the present invention, thereby enabling the patient, as well as an attendant, to begin and discontinue a transfer event.

Cart 102, or any other embodiment of the present invention, may further include means for sensing an asynchronous operation of the transfer mechanisms. Such means include sensing the individual belt torque or drag experienced when belts 172 are being retracted and a comparison of these sensings. A difference between sensings exceeding a predetermined value or a sensing ratio greater than or less than a predetermined ratio range would result in an alarm being actuated or an automatic discontinuance of transfer.

Cart 102 of FIG. 1 is designed for use with standard patient draw sheet 190. Standard patient draw sheet 190 is sufficiently wide that it can be folded over patient 126 if desired. Typically draw sheet 190 is not long enough that it extends under the head or feet of the patient. Rather than using several persons to move the patient disposed on draw sheet 190, horizontal transfer mechanism 104 performs a comparable function. Clips 174 are designed to attach directly to draw sheet 190. However, a worker may also use another clamping device to provide a more even pull over more of the length of sheet 190 and thus provide a smoother transfer motion to the patient. For particularly tall patients, draw sheet 190 may be wrapped around patient 126 for added support. Both ends of draw sheet 190 are then attached to the clamping device.

Figure 8:
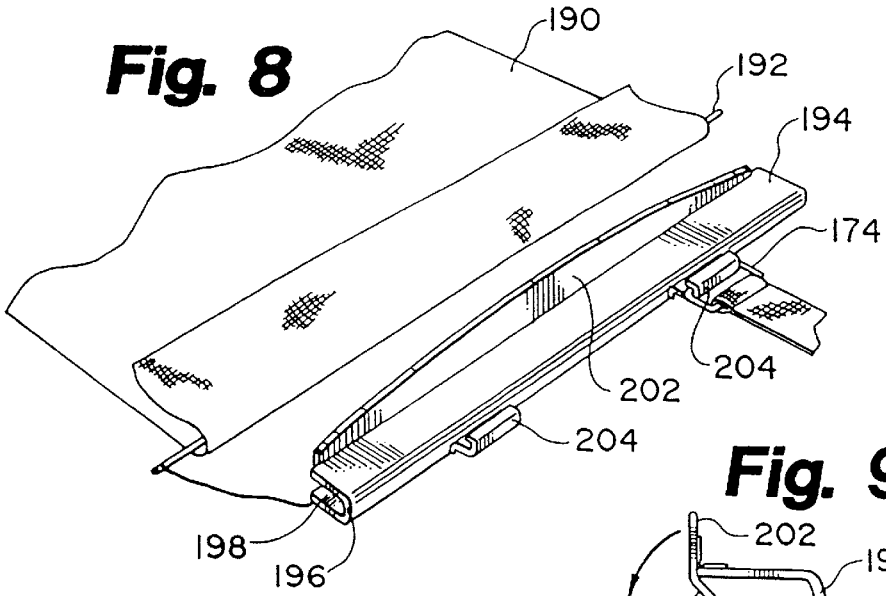
FIG. 8 is a perspective view of a first embodiment of a clamping device useful with a first embodiment of the horizontal transfer system in an orientation to be clamped to a transfer sheet folded over a rod.
Figure 9:
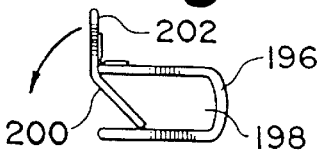
FIG. 9 is an end view of a first embodiment of the clamping device.
Figure 10:
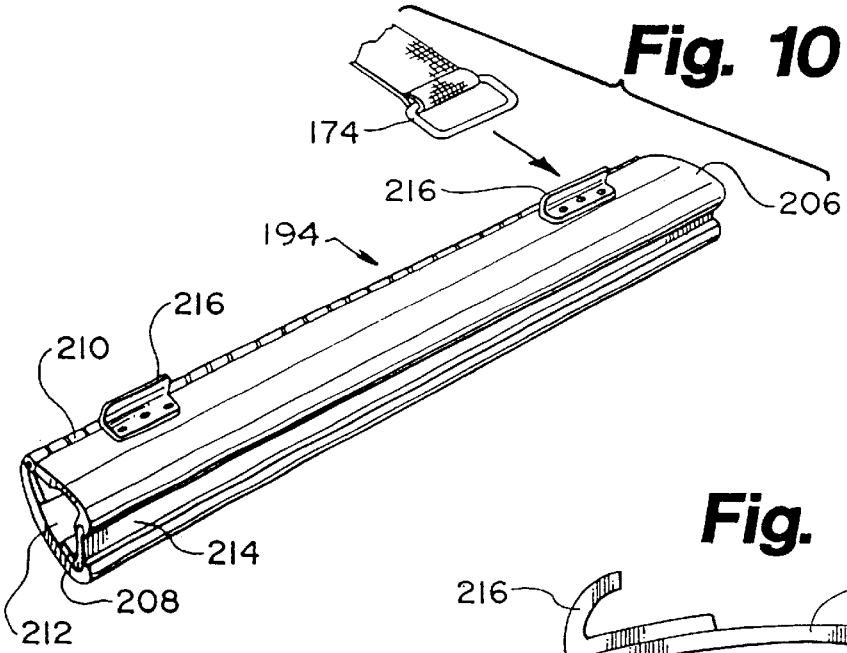
FIG. 10 is a perspective view of a second embodiment of the clamping device.
Figure 11:
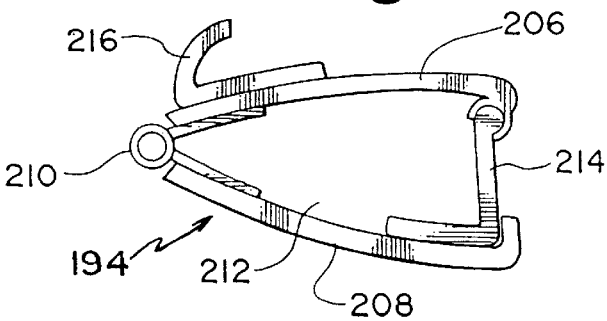
FIG. 11 is an end view of the second embodiment of the clamping device.
Figure 12:
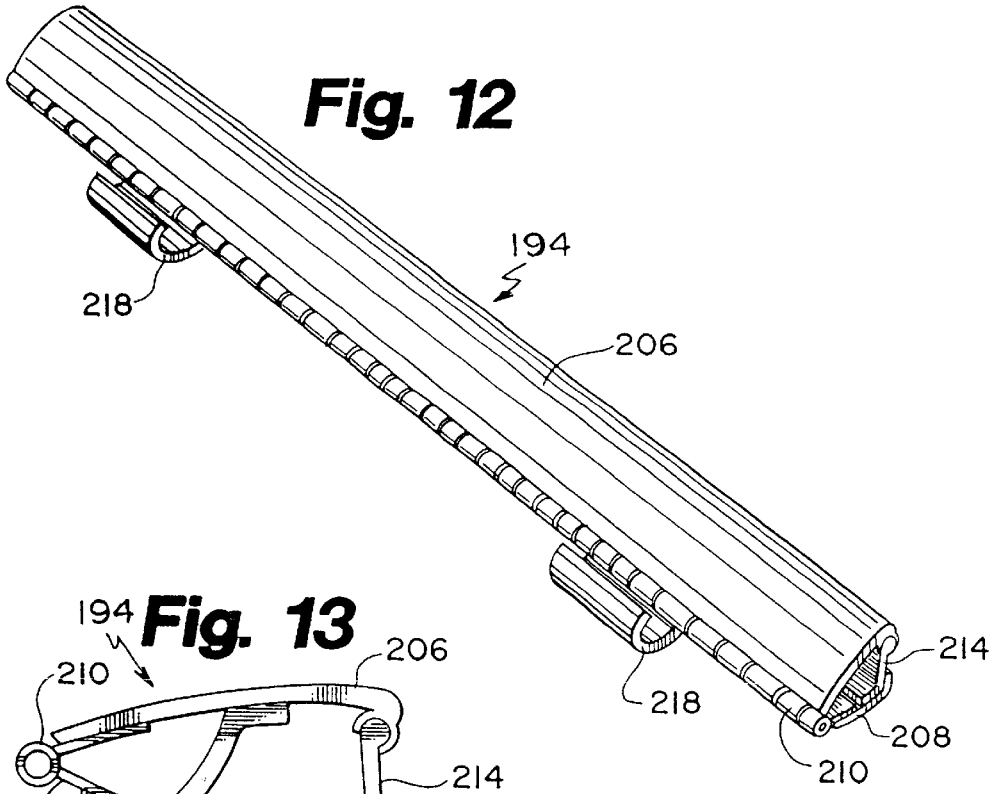
FIG. 12 is a perspective view of a third embodiment of the clamping device.
Figure 13:
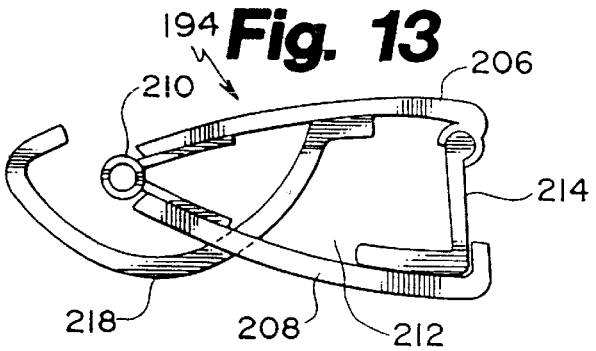
FIG. 13 is an end view of the third embodiment of the clamping device.

Three embodiments of exemplary clamping device 194 are presented in FIGS. 8–13. The first embodiment of clamping device 194 is shown in FIGS. 8 and 9. Clamping device 194 may be used to attach draw sheet 190 to winch 138. Clamping device 194 may employ rod 192 in doing so. A cross section of clamp 196 includes U-shaped portion 196, which forms cavity 198. Cavity 198, in turn, is covered by spring loaded gate 200. Rod 192 can enter cavity 198 when pushed against gate 200. Force from rod 192 against gate 200 from inside cavity 198 tends to force gate 200 closed, thereby further preventing withdrawal of rod 192. Gate 200 includes upward extension 202. Forward force on upward extension 202 opens gate 200 for the withdrawal of rod 192 from cavity 198. Clips 174 are conveniently attached to clamping device 194 at J-shaped flanges 204. Rod 192 can be optionally tethered to the clamping device 194 at one or more positions. Rod 192 may also be clipped to clamping device 194 for storage.

In the second and third embodiments, clamping device 194 includes upper portion 206 and lower portion 208 attached at hinge 210, thereby defining cavity 212. The front of cavity 212 is closed by L-shaped, hinged closure 214. The two embodiments to device 194 differ in their design for J-shaped flanges 216, 218 for attaching clips 174. In these embodiments, sheet 190 is directly placed into cavity 212 without the need to wrap sheet 190 around rod 192. However, rod 192 could still be used if desired. Sheet 190 is held in place by L-shaped hinge closure 214. A thin rigid tucking device (not shown) of any convenient length may be used if desired to assist with tucking sheet 190 into clamp 194.

Clearly, a variety of other designs for clamping device 194 are possible within the general concepts presented. In each of these embodiments, any portion of sheet 190 may be attached, not just the edge of sheet 190. This is an important feature because clamping device 194 should preferably be placed as near as possible to the patient so that transfer mechanism 104 can fully transfer the patient from the first horizontal surface to the second.

In operation, cart 102 is wheeled to a patient's bed 220, as depicted in FIG. 1, or onto another cart. Side rail 128 facing bed 220 is placed in the bridge position with low friction surface 147 directed upward. Draw sheet 190 is attached to a clamping device. Belts 172 are unwound from drive shafts 164 or 170 until they reach rod 192 at the edge of bed 220. Belts 172 are unwound either by activating motor 162 to unwind them or by using a clutch (not shown) to allow belts 172 to be freely withdrawn from the drive shaft. Clips 174 on the ends of belts 172 are attached to exemplary clamping device 194. Clamping device 194 is then engaged by rod 192 and sheet 190. Other embodiments of clamping device 194 may be used with or without rod 192.

After the appropriate switch mechanism 140 is actuated, winch 138 begins winding belts 172 onto drive shafts 164 (FIG. 6) or spool 175 (FIG. 7). Motor 162 may be designed to apply a slow, steady and constant force to move patient 126 without jerking. Motor 162 may further advantageously provide variable speeds of movement consistent with gradual starts and stops and safe transfer throughout the length of travel. Draw sheet 190 helps to distribute transfer forces over significant areas of the patient's body. When patient 126 is on cart cushion 124, motor 162 is turned off or otherwise disengaged. At this point, belts 172 are disconnected from clamping device 194. Sheet 190 is then removed from clamping device 194.

To transfer a patient from a cart to a bed, the bed should be equipped with a winch such as winch 138 present on cart 102. This bed-based transfer device may include the side rails of a conventional bed. These side rails typically slide vertically rather than folding under the bed. Winch 138 could easily be adapted on one or both sides of the bed, and may be retrofitted to a bed in a comparable fashion as with cart 102, based on the above description.

Figure 14:
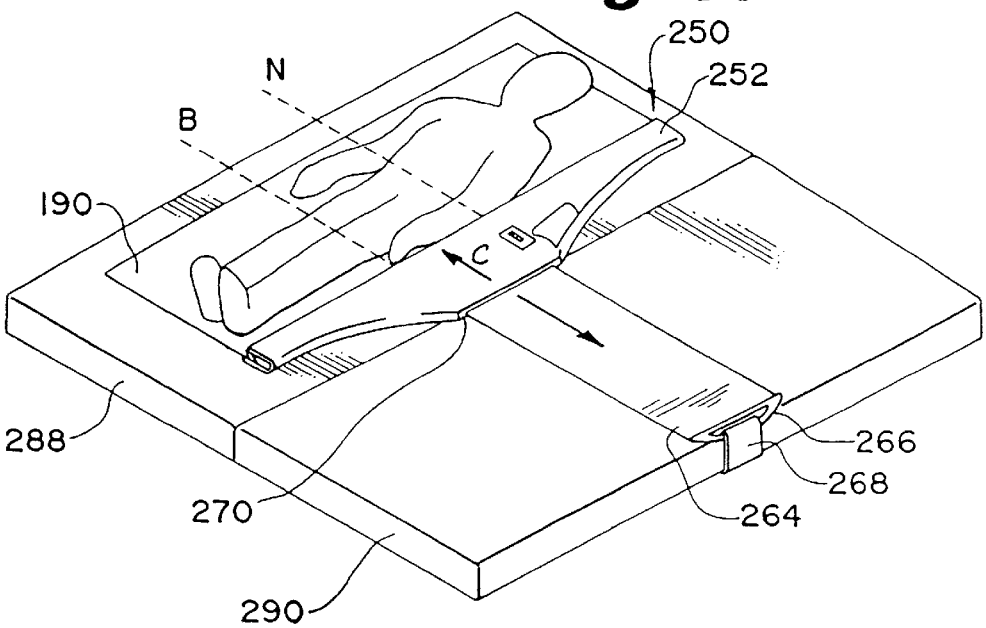
FIG. 14 is a perspective view of the attachment of a portable horizontal transfer device for the transfer of a patient from one horizontal surface to another.
Figure 15:
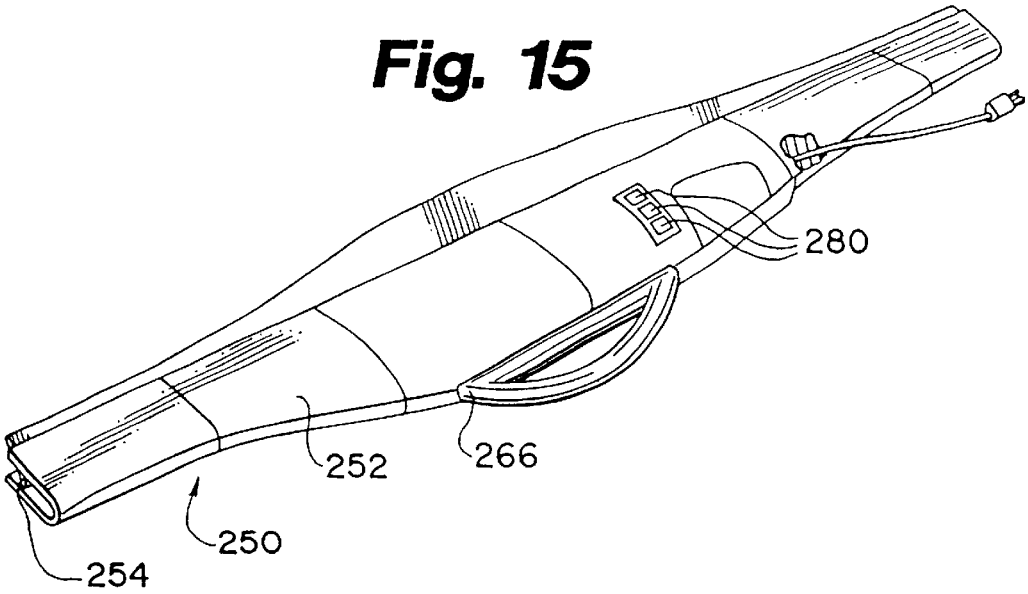
FIG. 15 is a perspective view of the portable horizontal transfer device.
Figure 16:
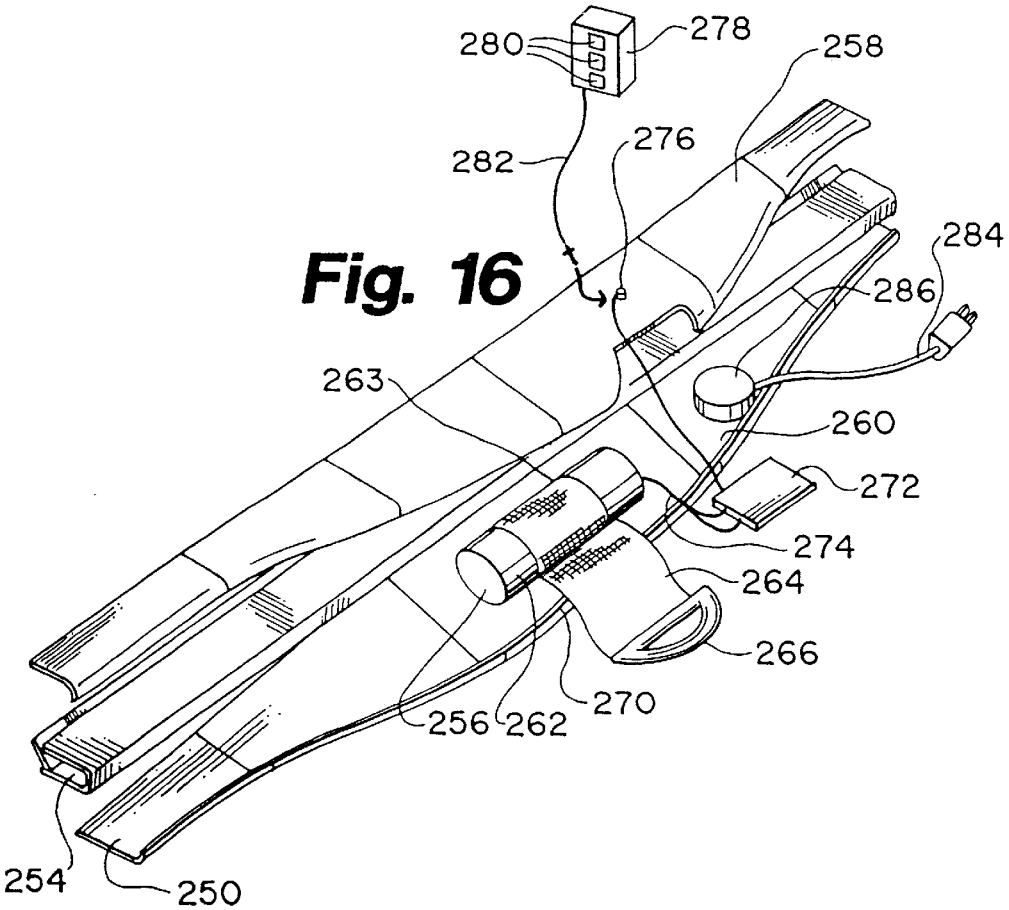
FIG. 16 is an exploded view of the portable horizontal transfer device.

Alternatively, a portable winch unit readily carried by a single health care provider may be used to replace winch 138 on bed 220, or cart 102. Exemplary portable winch unit 250 is shown in FIGS. 14–16. Portable winch unit 250 includes housing 252, clamping device 254 and winch 256. Clamping device 254 may hold and grip transfer sheet 190 in a similar manner as clamping device 194. Clamping device 254 also serves as a frame or a portion of a frame for the portable winch unit 250. Housing 252 preferably includes top portion 258 and bottom portion 260. Top portion 258 and bottom portion 260 may be heavy plastic shells surrounding clamping device 254 and winch 256.

Winch 256 includes motor 262. In operation motor 262 rotates a drive shaft (not shown) on which reel 263 is mounted. Belt 264 winds around reel 263. Belt 264 is comparable to belts 172 in embodiment 100. Handle 266 attaches to a free end of belt 264. Handle 266, in turn, attaches to clamp 268. Clamp 268 attaches to the edge of a bed or cart. Clamp 268 may be designed to fold out of the way when not in use. Belt 264 passes out of housing 252 through opening 270. The operation of winch 256 may be controlled through circuit board 272. Circuit board 272 may electrically connect to motor 262 by means of wire 274. Circuit board 272 may be electrically connected to port 276.

Control unit 278 with switches 280 may be electrically connected to port 276 by way of tether 282. The operator may operate winch 256 using control unit 278. Alternatively, control switches 280 may be present within housing 252, as shown in FIG. 15. However, this may be less desirable because the operator would need to lean over the bed or cart while the patient was being transferred. Control unit 278 may also have a wireless connection with circuit board 272 using a transmitter/receiver (not shown). Winch 256 may be powered by a standard wall outlet using cord 284. Retractable cord assembly 286 may be used to retract cord 284 when cord 284 is not in use. Retractable cord assembly 286 may also be used to prevent excess cord from being in the way during a patient transfer. Alternatively, a battery, preferably rechargeable, may be used to power winch 256.

Figure 17:
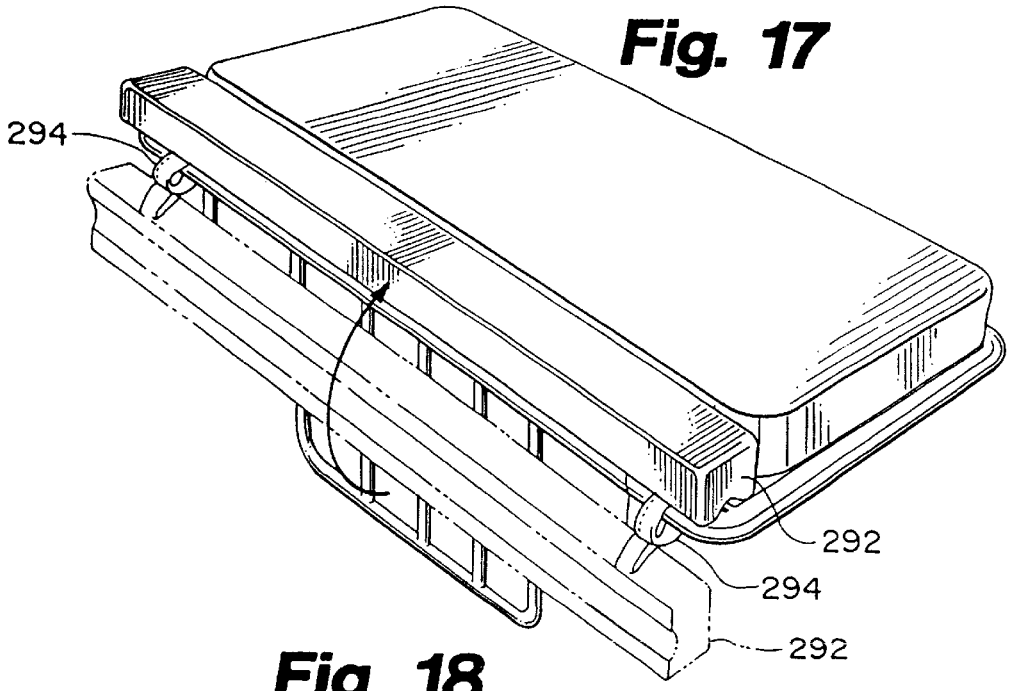
FIG. 17 is a perspective view of a portable cushion attached to a horizontal surface to provide a smooth continuous surface for the transfer of a patient with the portable horizontal transfer system, with the cushion in a lowered, stored position shown in phantom lines.

As shown in FIG. 14, a patient may be transferred from a first bed/cart 288 to a second bed/cart 290. Draw sheet 190 may be disposed under the patient in a similar manner as described above with respect to embodiment 100. FIG. 17 depicts portable cushion 292. Cushion 292 may be placed between the first bed/cart 288 and the second bed/cart 290 to provide a relatively smooth continuous surface for transferring the patient. Mating portions of a hook and loop fastener are present on a surface of portable cushion 292 and the bed or cart. Thus, portable cushion 292 may be attached to the bed or cart when not in use. Portable cushion 292 may also be used with other transfer devices or as an aid during a manual transfer. A top surface of cushion 292 may include a very low friction material. The very low friction material may be plastic.

Portable winch unit 250 may be attached to draw sheet 190 by means of clamping device 254, (FIGS. 15, 16). The design of clamping device 254 may be similar to the clamping devices in FIGS. 8–13 or a comparable design based on similar concepts. Draw sheet 190 may be wrapped about rod 192 (FIG. 8) for attachment to clamping device 254. Referring to FIG. 14, belt 264 is withdrawn from housing 252 so that handle 266 can be attached to clamp 268. Clamp 268 is rigidly attached to second bed/cart 290 on its side opposite the side near first bed/cart 288. Clamp 268 can be optionally reversibly detachable or lowerable to a storage position. The operator uses control unit 278 to activate motor 262. As motor 262 retracts belt 264, portable winch unit 250 and the patient are drawn toward clamp 268 which result in the patient being moved onto second bed/cart 290.

Referring to FIG. 14, the transfer devices of the present invention, especially the clamps, are designed to be centered at the patient's center of gravity when the patient is in a supine position. A patient's center of gravity is usually about midway between the patient's navel and buttocks, represented as lines N and B, respectively. Thus, to move the patient smoothly and evenly, the clamp center of gravity (represented by arrow C) should be aligned about midway between lines N and B on the patient.

Figure 18:
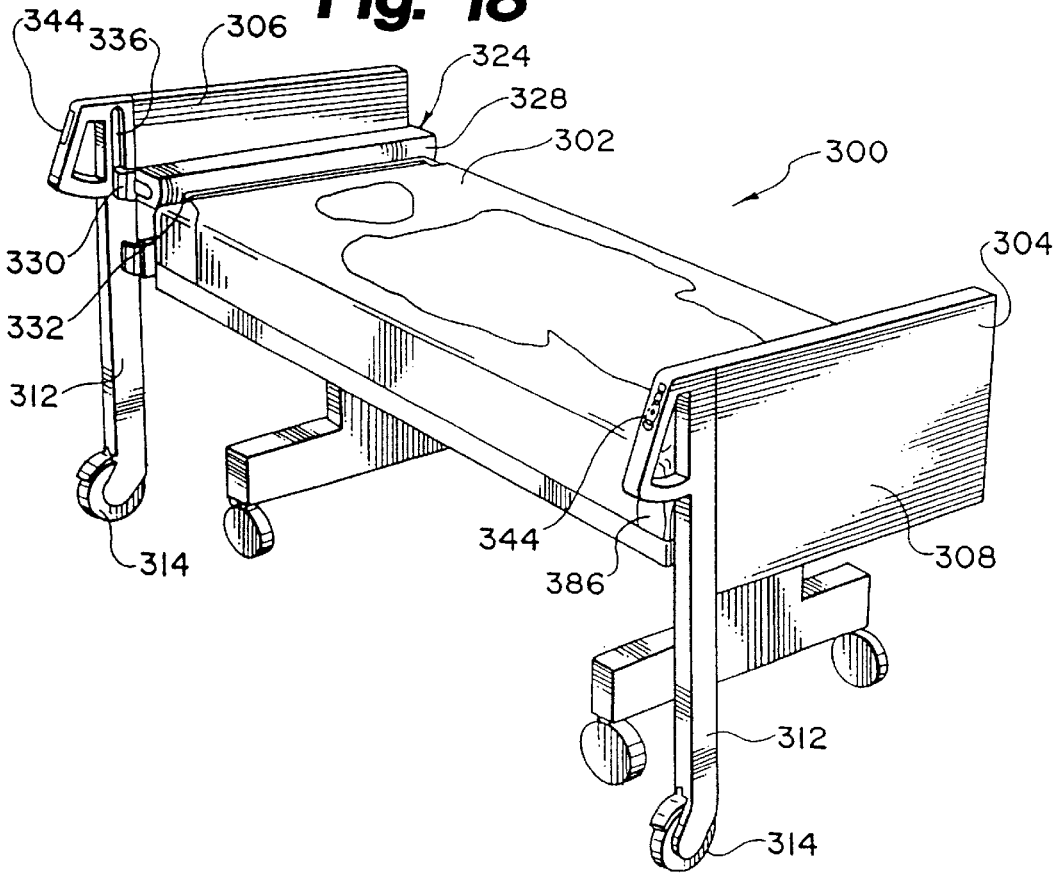
FIG. 18 is a perspective view of a further embodiment of a horizontal transfer system.

Exemplary horizontal transfer system 300 includes an especially designed transfer sheet 302 and transfer unit 304, as shown in FIG. 18. Transfer unit 304 can move a patient in either of two directions. Thus, horizontal transfer system 300 has the advantage that only the cart or bed, but not both, must be equipped with transfer unit 304. Therefore, the cart or bed not adapted by transfer unit 304 may be conventional in design.

Figure 19:
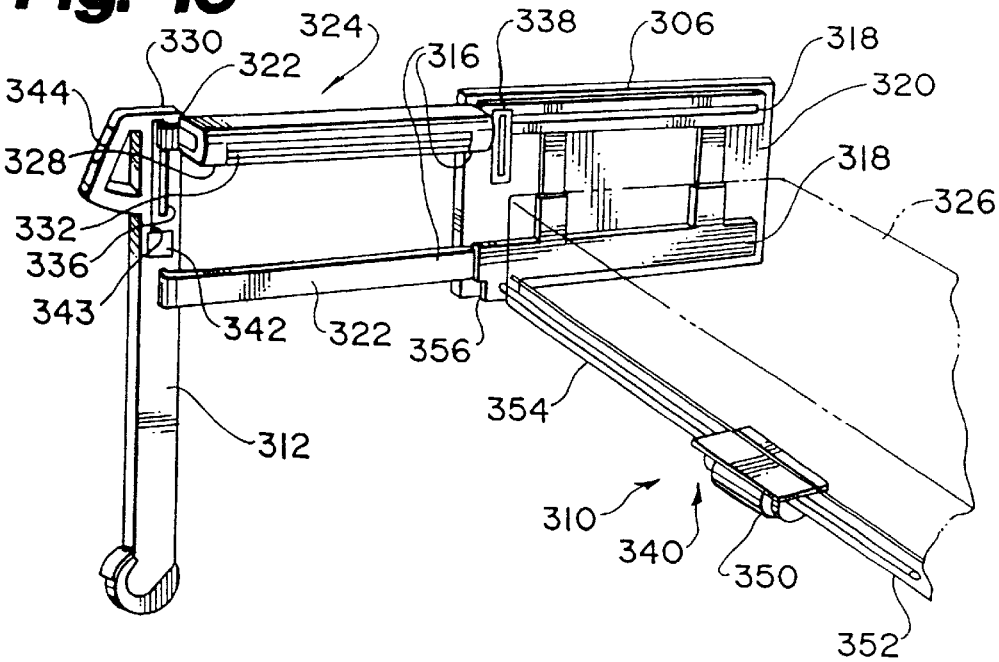
FIG. 19 is a partial, cut away perspective view of the further embodiment of the horizontal transfer system showing the drive system for horizontal extensions.

Transfer unit 304 includes head frame 306 and foot frame 308. Head frame 306 and foot frame 308 are in mechanical communication with drive system 310 (FIG. 19). Head frame 306 replaces or attaches to the head board of the bed or cart. Foot frame 308 replaces or is attached to the foot board of the bed or cart. Head frame 306 and foot frame 308 include at least one vertical support 312. A bottom portion of vertical support 312 may include wheel 314. Wheels 314 are oriented to roll in a direction defined by the width of the bed/cart. Wheels 314 may be attached to vertical support 312 in such a manner that wheels 314 are shifted up and out of contact with the floor. Thus, the bed or cart may then be moved more easily because wheels 314 are retracted away from the floor. Vertical supports 312 may have a removable brace (not shown) extending therebetween. When in use, the removable braces serve to enable vertical supports 312 to become more rigid by compensating for forces created by the weight of the patient during transport.

Figure 20:
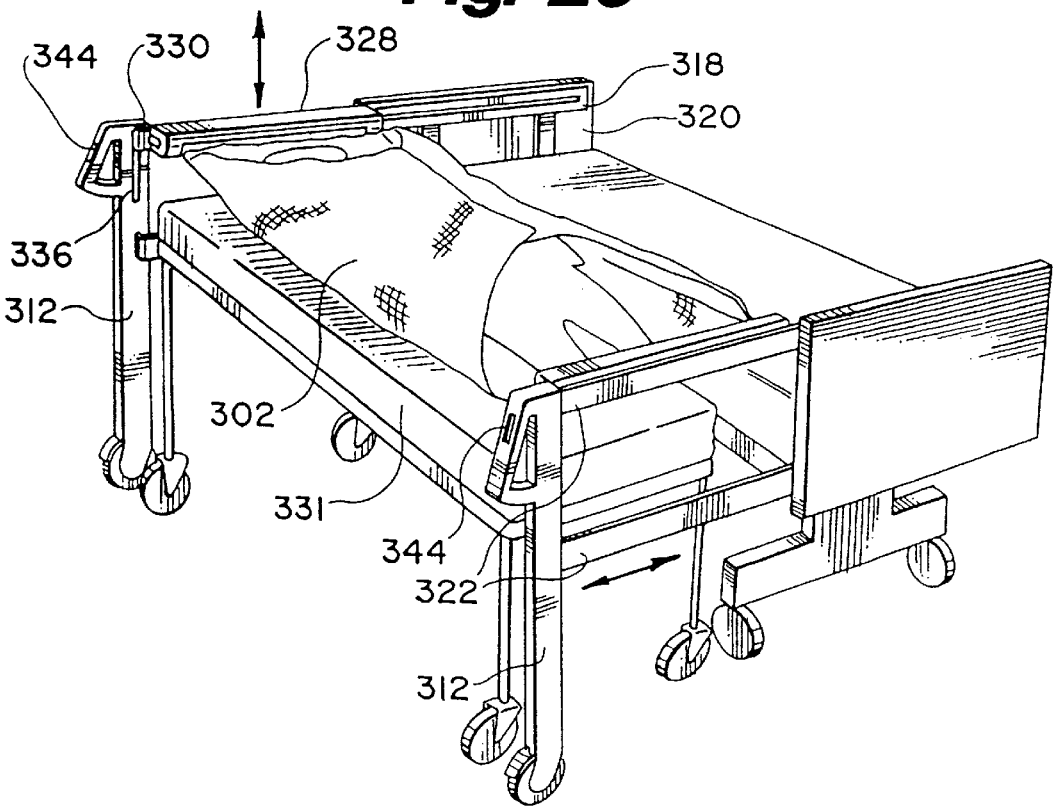
FIG. 20 is a perspective view of the further embodiment of the horizontal transfer system with a patient elevated over a cart to indicate the ranges of motion obtainable by the transfer system.

Referring to FIGS. 19–21, head frame 306 and foot frame 308 each include at least one expandable horizontal support 316 and lifting support 324. Each horizontal support 316 extends from vertical supports 312. Horizontal supports 316 include fixed portions 318 and telescoping portions 322. Fixed portions 318 are attached to the head board, foot board, head board portion 320, or foot board portion 320. Fixed portions 318 may extend at least across the width of the bed or cart. Telescoping portions 322 are attached to each vertical support 312 and slidably engage a corresponding fixed portion 318. In certain embodiments, telescoping portion 322 will slide into a corresponding fixed portion 318, although other types of slidable engagement are possible.

Figure 23:
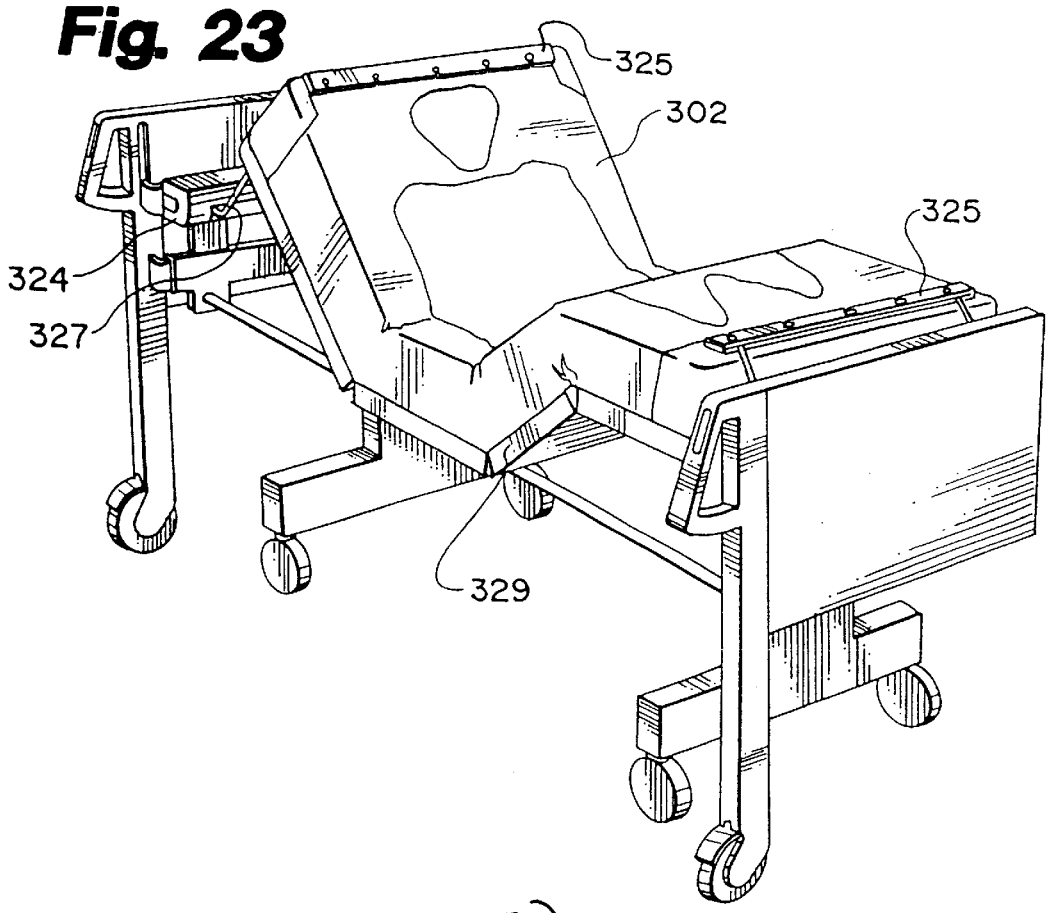
FIG. 23 is a perspective view of a bed equipped with the further embodiment of the horizontal transfer device with the bed in a raised position.
Figure 22:
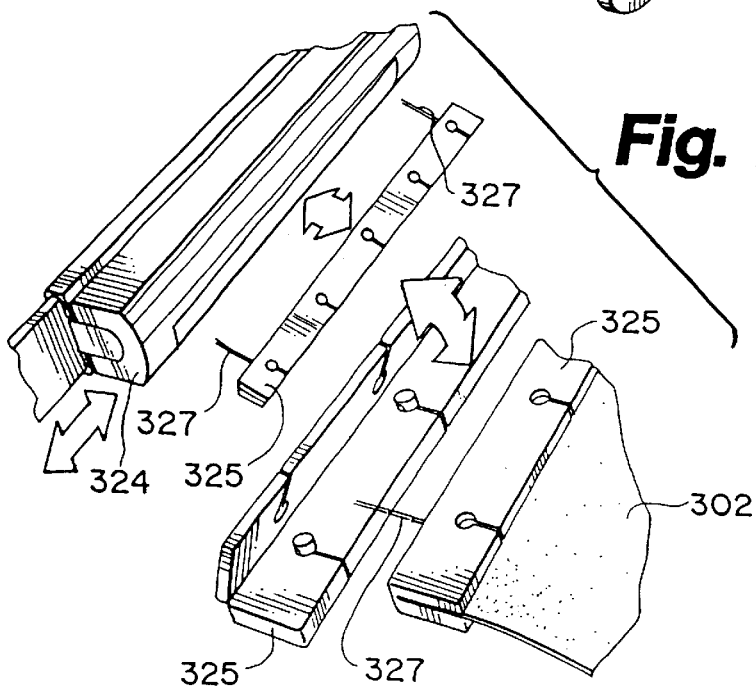
FIG. 22 is a fragmentary perspective view of a sheet clamp indicating its motion relative to a lifting support and its attachment to a transfer sheet.
Figure 26:
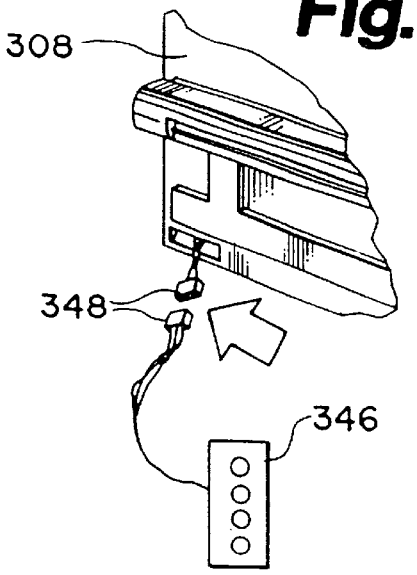
FIG. 26 is a perspective view of a portion of the foot board bed or cart adapted with the further embodiment of the horizontal transfer system indicating a location for the attachment of a control unit.

Lifting support 324 slidably attaches to fixed portion 318 such that lifting support 324 moves with vertical support 312 and telescoping portions 322. Each lifting support 324 includes gripping portion 328 and two lifting portions 330. Gripping portion 328 may define opening 332. Sheet clamp 325 will be discussed in more detail hereinbelow. However, first ends of cables 327 may extend from sheet clamp 325 through opening 332. Second ends of cables 327 may be secured to gripping portion 328. Thus, raising lifting support 324 will also raise clamp 325. Referring to FIG. 23, cables 327 permit sheet clamps 325 to remain attached to transfer sheet 302 while mattress support 329 goes through a range of motion. In one configuration, first lifting portion 330 engages vertical support 312 at slot 336. Second lifting portion 330 engages moving support 338 which is attached to telescoping portion 322.

Exemplary lifting support 324 is capable of a range of vertical motion. The range of vertical motion enabled by lifting support 324 will typically be between 6" and 12". This range of vertical motion provides sufficient clearance for a horizontal transfer from a first bed/cart to a second bed/cart. Thus, retrofitted bed/cart 326 with attached transfer unit 304 can transfer patients from or to retrofitted bed/cart 326. Lifting support 324 also enables workers to change linen more conveniently. However, transfer sheet 302 needs to be changed separately.

Referring to FIG. 19, drive system 310 includes horizontal drive system 340 and vertical drive system 342. Drive system 310 is operated from control panel 344 (FIGS. 18–20). Control panel 344 may be located on vertical supports 312. Alternatively, portable controller 345 (FIG. 23) is patched into head frame 306 or foot frame 308 through connector 348. Other embodiments for controlling drive system 310 are possible. Drive 342 enables vertical motion of lifting support 324. Drive 342 may be adapted to operate by motorized worm drive 343 or by other motor or hydraulic systems.

Two embodiments are shown for horizontal drive system 340 in FIGS. 19 and 21, respectively. The first embodiment includes motor 350. Motor 350 is secured to the frame of bed/cart frame 352. Motor 350 turns drive shafts 352, 354. Drive shafts 352, 354 connect to transmission 356. Transmission 356, in turn, is in mechanical communication with telescoping portion 322. Thus, actuating motor 350 results in extending or retracting telescoping portion 322 within fixed portion 318.

The second embodiment of drive system 340 includes motor 358 mounted on either head frame 306 or foot frame 308. Motor 358 rotates worm drive 360. Worm drive 360 is mounted horizontally alongside motor 358. Worm drive 360 transfers motion from motor 358 to telescoping portion 322. Optional removable panel 362 can be removed, as shown in FIG. 24, and mounted on foot frame 308. When mounted on foot frame 308, panel 362 may be used as a shelf, as a cardiopulmonary resuscitation (CPR) board, or to support additional equipment as shown in FIG. 25.

Figure 27:
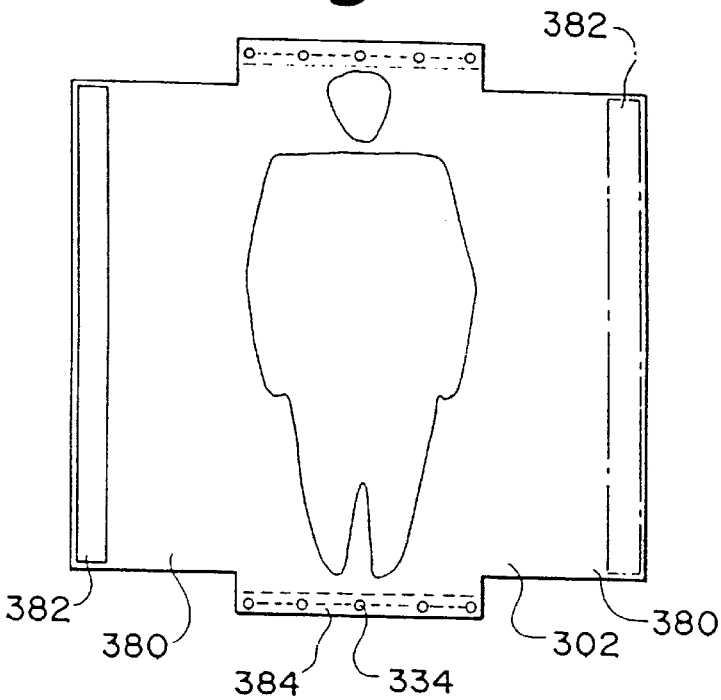
FIG. 27 is a top view of a transfer sheet designed for use with the further embodiment of the horizontal transfer system.
Figure 28:
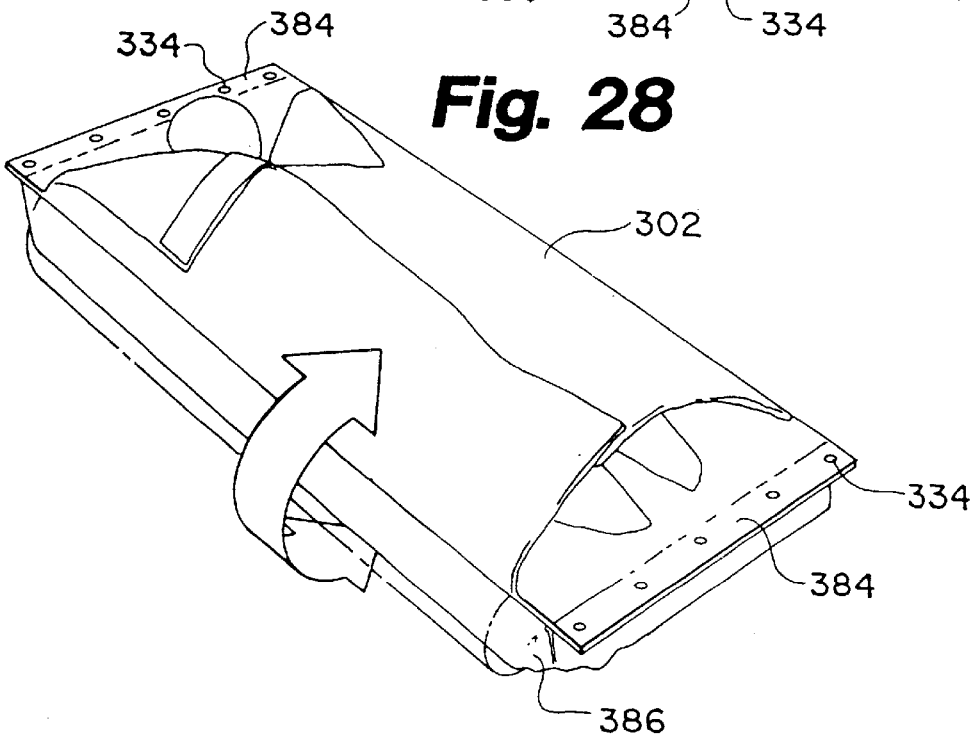
FIG. 28 is a perspective view of the transfer sheet of FIG. 27 shown in its folded position.

An appropriate transfer sheet 302 for use in this embodiment of horizontal transfer unit 300 is depicted in FIGS. 27 and 28. Transfer sheet 302 includes wings 380. Hook and loop or comparable fasteners 382 may be present on the edges of wings 380. Wings 380 may be folded over the patient and closed with fasteners 382. The shape of wings 380 may be selected as desired. The top and bottom of transfer sheet 302 may include reinforced attachment portions 384. Reinforced holes, grommets 334, or other improved attachment means are optionally present within reinforced portions 384. Sheet 302 may be attached to sheet clamps 325. Alternatively, sheet 302 may be attached to the clamps shown in FIGS. 8–13. The presence of grommets on sheet 302 may be a disadvantage when sheet 302 is being laundered. Attachment portions 384 will generally extend to or just beyond the end of the mattress 386. Other designs are possible for sheet 302, for example an embodiment which does not fold over the patient.

As depicted in FIGS. 19 and 20, vertical supports 312 and telescoping portion 322 are initially placed in a retracted position if the patient is being moved from retrofitted bed/cart 326. Vertical supports 312 and telescoping portion 322 are initially placed in their extended position if the patient is being moved from a separate bed/cart 331 to retrofitted bed/cart 326. Transfer sheet 302 is optionally folded over the patient, and fasteners 382 are secured together. Attachment portions 384 are placed into opening 332 and sheet clamps 325 engage reinforced holes 334. At this point, vertical drive system 342, originally in its lower point, is engaged to extend to its upper point, thereby raising the patient into a suspended position.

Horizontal transfer system 300 is engaged accordingly to move the patient from an original location to the transfer location. If the patient was originally disposed on retrofitted bed/cart 326, vertical supports 312 and telescoping portion 322 are moved to extended positions. If the patient was not originally located on the retrofitted bed/cart 326, vertical supports 312 and telescoping portion 322 are moved to retracted positions. Once the horizontal transfer is complete, vertical drive system 342 is lowered and transfer sheet 302 is disengaged therefrom.

Another embodiment of a patient transfer device 400 is shown in FIG. 29. Head portion 402 and foot portion 404 may be similar in construction to head frame 304 and foot frame 306, respectively. However, head portion 402 and foot portion 404 lack lifting supports 324 attached to telescoping portion 320. Head portion 402 and foot portion 404 instead include top supports 406. Top supports 406 support upper transverse support 408. Upper transverse support 408 provides support to counterforces resulting from the weight of the patient during a transfer.

Upper transverse support 408 may include transverse tracks 410 on both sides thereof. Transverse tracks 410 support lifting elements 412. Lifting elements 412 include track wheels 414. Track wheels 414 rotate within tracks 410, thereby enabling lifting elements 412 to transverse thereon. Lifting elements 412 may include winches (not shown) to retract cords 416. Cords 416 may have fasteners 418 at their ends for attaching to reinforced holes or grommets 420 at the corners of draw sheet 422. Retracting cords 416 raise draw sheet 422, on which the patient is secured therewithin.

As shown in FIG. 30, extendable horizontal supports 424 may include wheels 428. Horizontal supports 424 enable lateral motion of vertical supports 426, along with upper transverse support 408 and lifting elements 412. As with system 300, device 400 can transfer a patient from a retrofitted bed/cart to a second bed/cart or from a second bed/cart to the retrofitted bed/cart.

Figure 31:
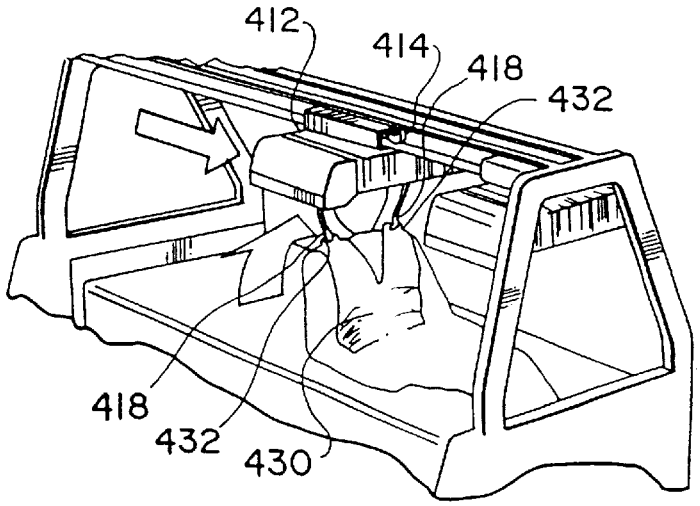
FIG. 31 is a perspective view of the alternative embodiment of FIG. 29 being used to assist a patient to sit up.
Figure 32:
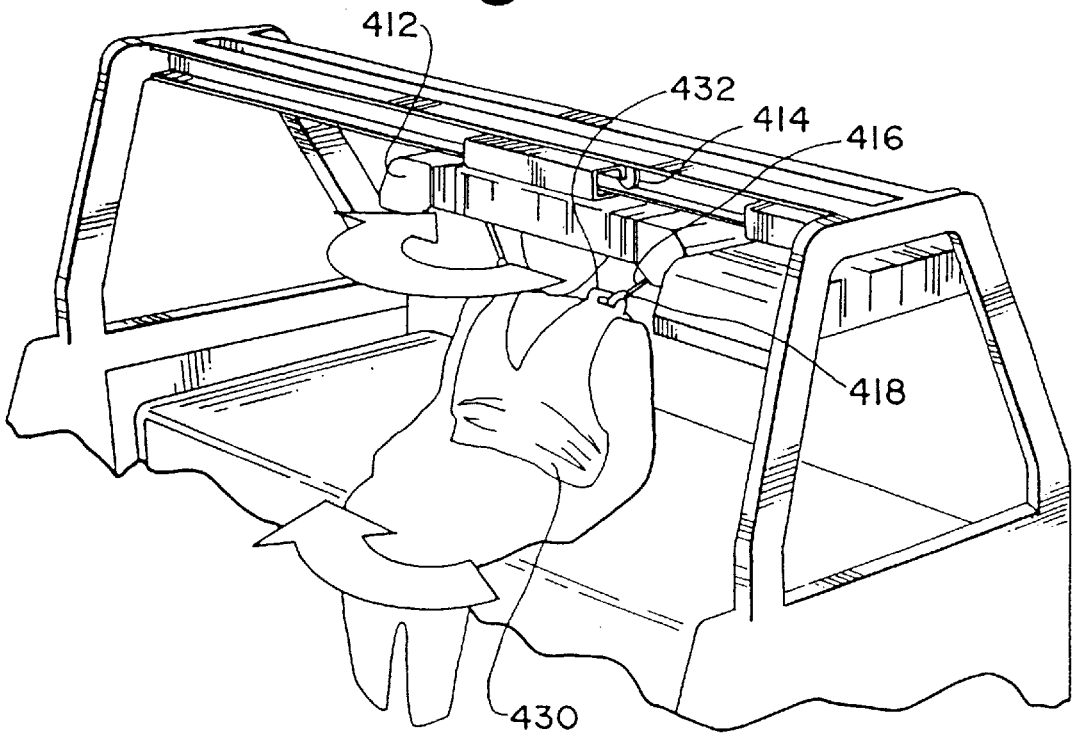
FIG. 32 is a perspective view as in FIG. 31 indicating the rotation of a lifting element.

An exemplary single lifting element 412 is depicted in FIGS. 31, 32. Element 412 may be used with lift jacket 430. Lift jacket 430 fits around the torso of a patient and includes loops 432. Fasteners 418 attach to loops 432. When thusly attached to lift jacket 430, cords 416 may be retracted, thereby lifting the patient's torso off the bed and into a bent position at the patient's waist. Lifting element 412 may then be translated and rotated as shown in FIGS. 31 and 32, thereby placing the patient in a seated position at the side of the bed. The patient's back is supported in this position. In this way horizontal transfer device 400 serves a second purpose in assisting a patient from a supine to a sitting position.

Figure 33:
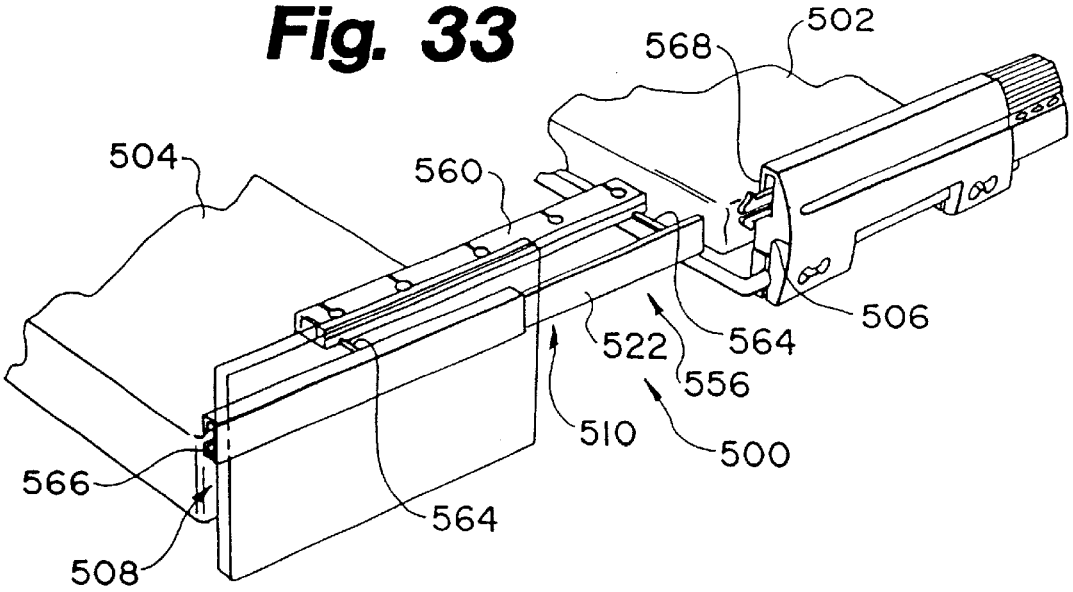
FIG. 33 is a perspective view of a transfer system with a horizontal transfer mechanism.
Figure 34:
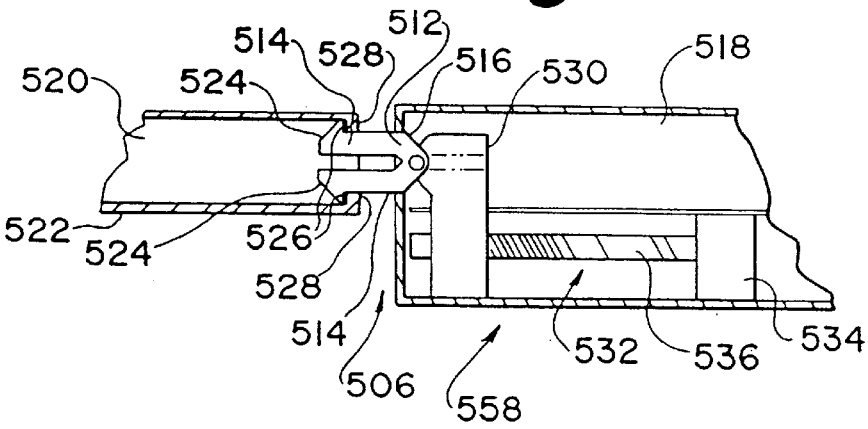
FIG. 34 is a cut away side view of one embodiment of a docking mechanism.
Figure 35:
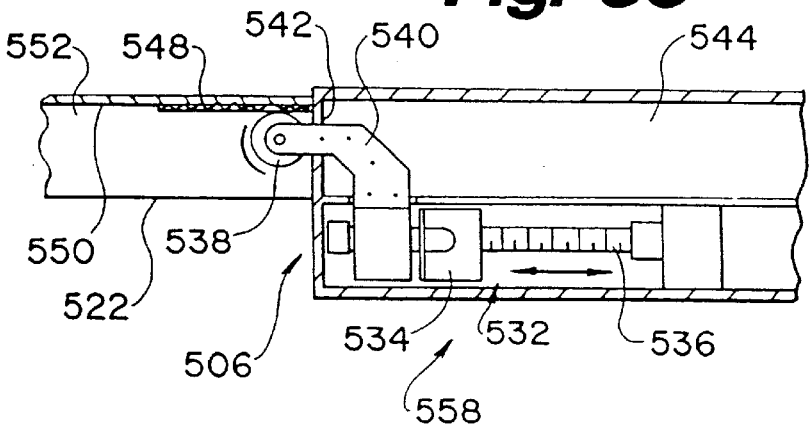
FIG. 35 is a cut away side view of a second embodiment of a docking mechanism.

Exemplary transfer system 500 is depicted in FIG. 33. Transfer system 500 is designed for retrofitting both bed 502 and cart 504. Transfer system 500 includes horizontal transfer mechanism 508 and transfer bridge 510 (FIGS. 37–41). Horizontal transfer mechanism 508 includes docking mechanism 506. FIGS. 34 and 35 depict two representative embodiments of docking mechanism 506. Bed 502 of the first embodiment includes foot board 518. An opening 516 is defined in the side of foot board 518. The first embodiment of transfer system 500 includes spring loaded clamp 512. Clamp 512 includes arms 514, each arm 514 with an angled front edge 524. Arms 514 protrude from opening 516 at side of foot board 518 of bed 502. Spring loaded clamp 512 engages cavity 520, which opens into transfer bar 522. When angled front edge 524 of arms 514 engage cavity 520, arms 514 resiliently deflect towards each other until tips 526 clear flanges 528. When tips 526 clear flanges 528, arms 514 return outwardly as tips 526 engage flanges 528. Arms 514 pivot on docking support 530 within bed foot board 518. Head boards (not shown) of bed 502 and cart 504 have a comparable docking mechanism. When clamp 512 is protruding from opening 516, arms 514 may be disengaged by being pressed together.

The second embodiment of the docking mechanism 506 is depicted in FIG. 35. In this second embodiment, gear 538 is supported by a docking support 540. Gear 538 protrudes from opening 542 in the side of bed foot board 544. Protruding gear 538 engages teeth 548, which are disposed on top surface 550 of cavity 552 within transfer bar 522. Gear 538 may flex slightly on its support 540 to engage teeth 548. Cavity 552 within transfer bar 522 may not have flanges at its opening. Gear 538 is disengaged by pressing downwardly on docking support 540 when docking support 540 is protruding from opening 542. The head boards (not shown) of bed 502 and cart 504 may have a comparable docking mechanism.

The two embodiments of docking mechanisms 506 are described in a particular configuration with respect to the cart and the bed. This configuration may be reversed with the bed containing protruding gear 532 or clamp 512. In either configuration, the protruding gear or clamp may be retracted by worm gear drive 532 during a docking.

Figure 36:
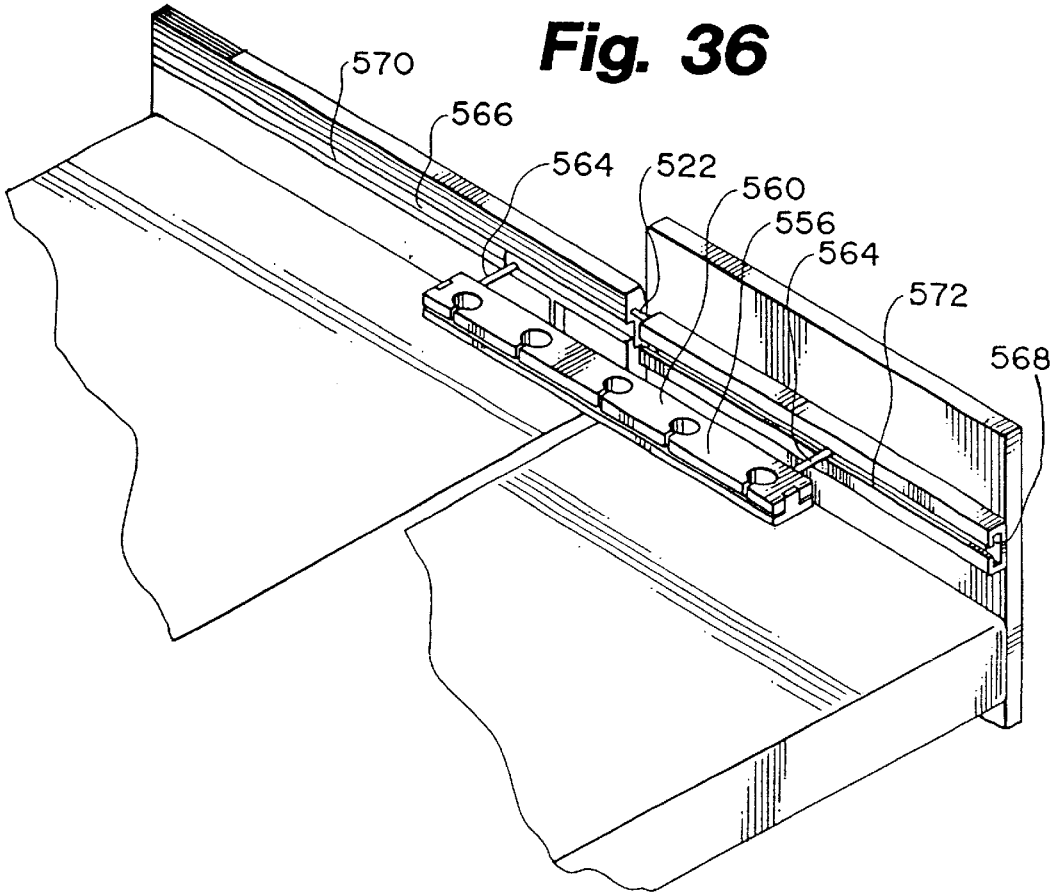
FIG. 36 is a perspective view of the transfer system of FIG. 33 with a transfer element bridging between a bed and a cart.

Horizontal transfer mechanism 508 is shown in FIG. 36. Transfer mechanism 508 includes transfer element 556 and drive system 558. Transfer element 556 includes gripping mechanism 560 and transfer bar 522. Gripping mechanism 560 grips transfer sheets such as transfer sheet 302. Gripping mechanism 560 is attached to transfer bar 522 by a plurality of support bars 564. Gripping mechanism 560 may be similar to sheet clamp 325. Transfer bar 522 slides within cart channel 566 and bed channel 568. Cart channel 566 and bed channel 568 respectively define slots 570, 572. Support bars 564 extend through slots 570, 572 within cart channel 566 and bed channel 568, respectively. Docking supports 530 or 540 may be moved laterally by drive system 558 which may comprise worm gear drive 532 (FIGS. 34, 35). Worm gear drive 532 includes motor 534 and worm 536. Rotating worm 536 laterally moves docking supports 530 or 540. The motion of the docking supports 530 or 540 moves transfer bar 522 within channels 566 and 568 (FIG. 28). Worm gear drive 532 can move the transfer bar 522 in either direction, thereby effecting a patient transfer in either direction.

Figure 37:
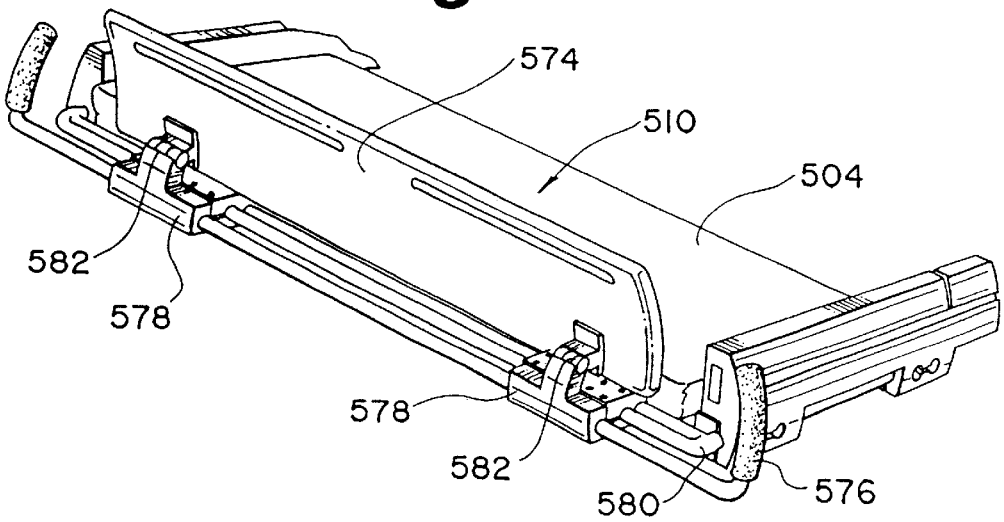
FIG. 37 is a perspective view of a transfer bridge used with the transfer system of FIG. 33.
Figure 41:
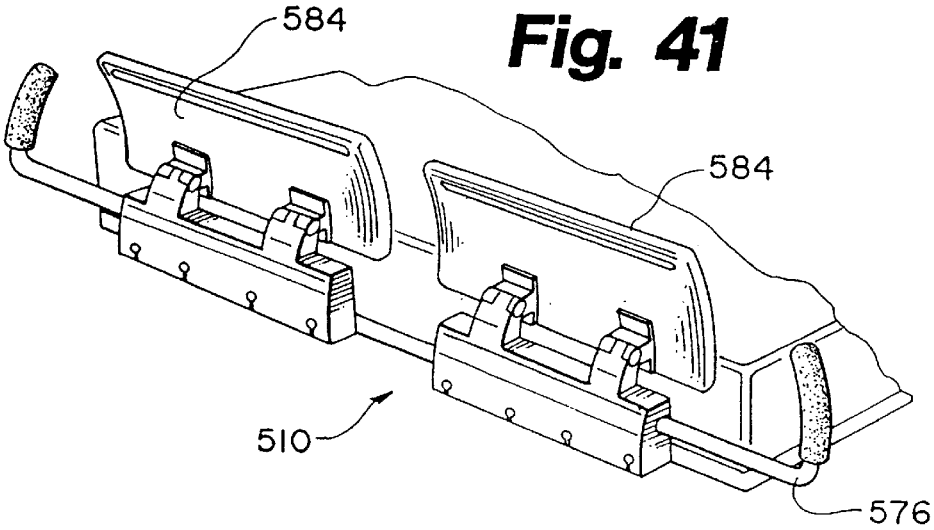
FIG. 41 is a perspective view of a split transfer bridge.

Transfer bridge 510 is mounted on the side of cart 504 (FIGS. 37, 41). Transfer bridge 510 includes bridge 574, lever 576 and mounting portions 578. Bridge 574 is preferably molded from a low friction material such as, for example, polypropylene, to facilitate passage of the transfer sheet. It is recognized that other low friction materials may also be suitable. Mounting portions 578 are attached to the side of cart 504 by rods 580. Mounting portions 578 include hinge 582 which supports bridge 574. Lever 576 passes through mounting portions 578. Rotating lever 576 changes the configuration of hinges 582, thereby moving bridge 510 between a stored position and a bridge position, as shown in FIGS. 37–40. In the bridge position, bridge 574 fills in the gaps between bed 502 and cart 504. In the storage position, bridge 574 may function as a side rail for cart 504. FIG. 41 depicts a different embodiment of transfer bridge 510, including split transfer bridge portions 584. These embodiments of the transfer bridge may be adapted for use with other transfer systems including the conventional manual transfer system.

Figure 38:
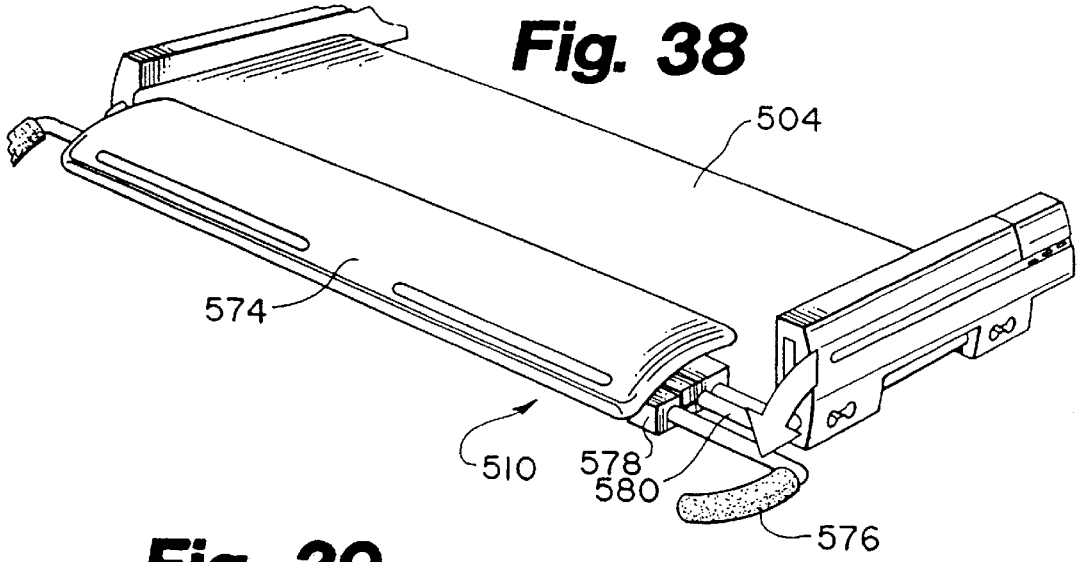
FIG. 38 is a perspective view of the transfer bridge of FIG. 37 with the bridge in the bridging position.
Figure 39:
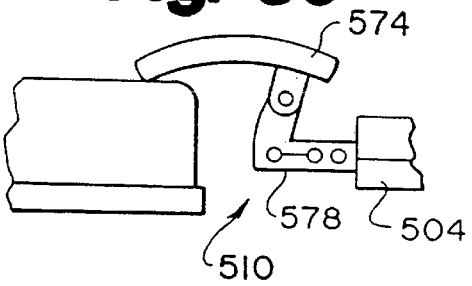
FIG. 39 is a side view of the transfer bridge in the bridging position with lever and rods removed.
Figure 40:
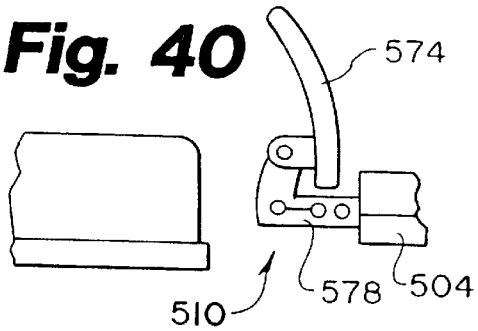
FIG. 40 is a side view of the transfer bridge in the raised position with lever and rods removed.

To transfer a patient between bed 502 and cart 504, transfer sheet 302 is attached to gripping mechanisms 560 proximate the patient's head and foot, in a similar manner to the attachment of transfer sheet 302 in the embodiment of FIG. 18. Referring to FIG. 36, cart 504 and bed 502 are positioned to align channels 566 and 568. Referring to FIG. 38, transfer bridge 510 is placed in its transfer position to fill the gap between bed 502 and cart 504. As shown in FIG. 36, drive system 558 is engaged to move transfer element 556 from bed 502 or cart 504 where the patient was located to the bed 502 or cart 504 to which the patient is being transferred. Once the patient is transferred, cart 504 and bed 502 are undocked, and transfer sheet 302 is disconnected from gripping mechanisms 560.

The above transfer systems rely on supporting the patient on some type of sheet during the transfer. However, present methods often rely on health care personnel to provide the necessary transfer forces, usually by pulling a transfer sheet. However, supporting the patient on a sheet may be inappropriate for patients with certain injuries. Hence, it may be safer to transfer the entire mattress or cushion, as described below.

Figure 42:
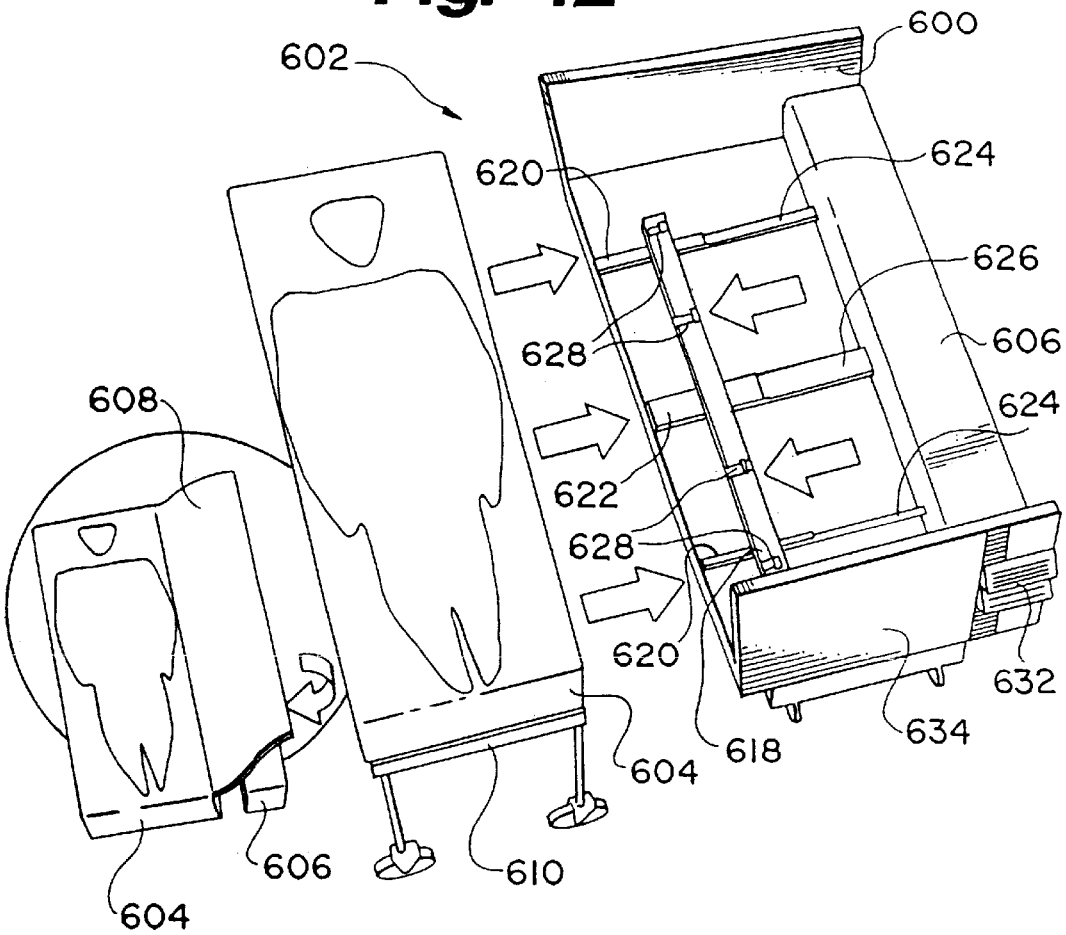
FIG. 42 is a perspective view of a mattress transfer system.
Figure 43:
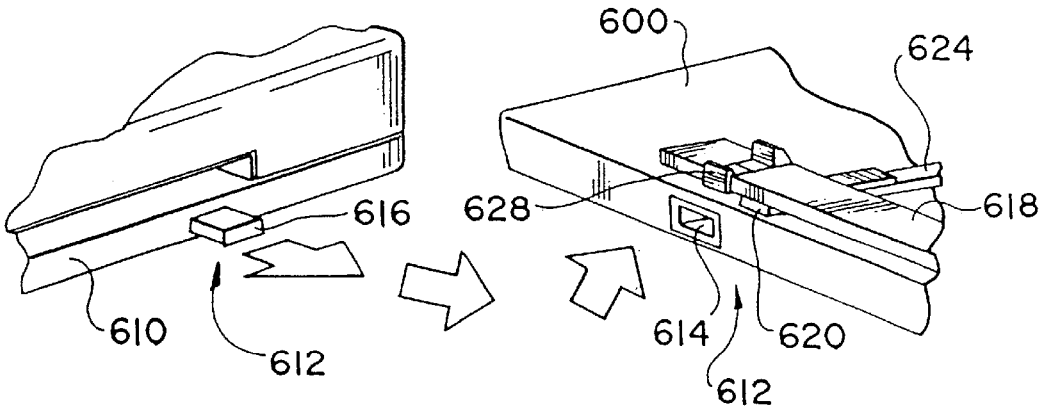
FIG. 43 is a perspective view of a docking mechanism used with the mattress transfer system of FIG. 42.

FIG. 42 depicts exemplary bed 600. Bed 600 includes exemplary mattress transfer system 602. Bed 600 supports modular mattress 604 and fixed cushion 606. Modular mattress 604 includes wing 608 made of padded fabric in this example. Wing 608 wraps around fixed cushion 606 to form a smooth surface without gaps, as shown in the insert to FIG. 42. Wing 608 tucks under modular mattress 604 when not in use. Referring to FIG. 43, bed 600 connects to cart 610 by way of docking mechanism 612 when mattress 604 is to be transferred. Docking mechanism 612 includes one or more apertures 614 for accepting projections 616. FIG. 43 displays apertures 614 on bed 600 and projections 616 on cart 610. However, the opposite arrangement would work similarly. It is possible to provide a locking mechanism (not shown) to lock projections 616 within apertures 614. The locking mechanism would prevent relative motion of bed 600 and cart 610 during transfer of modular mattress 604. However, the same effect may be accomplished by locking the wheels of cart 610.

Figure 44:
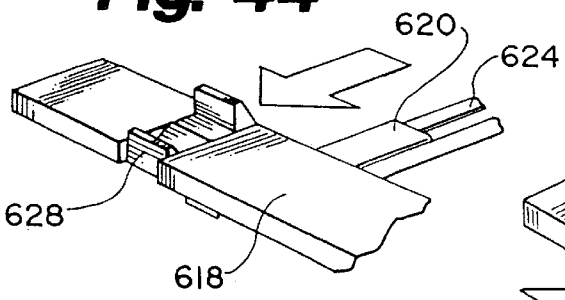
FIG. 44 is a perspective view of a gripping mechanism of the mattress transfer system in pushing position.
Figure 45:
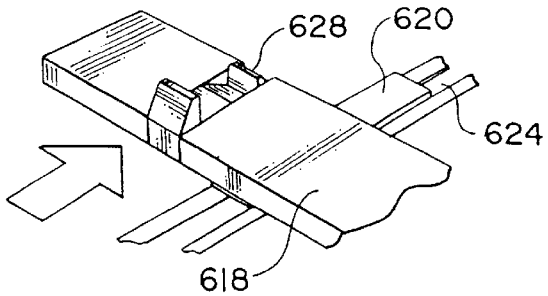
FIG. 45 is a perspective view of a gripping mechanism of the mattress transfer system in pulling position.

In one embodiment, mattress transfer system 602 includes transverse bar 618, a plurality of lateral bars 620 and at least one lateral drive bar 622. Transverse bar 618 is connected to the plurality of lateral bars 620 and to at least one lateral drive bar 622. Lateral bars 620 slide along lateral tracks 624. Lateral drive bar 620 engages lateral drive track 626. Lateral bars 620 and lateral drive bars 622 allow transverse bar 618 to extend just past the edge of bed 600. Transverse bar 618 has a plurality of gripping mechanisms 628. Each gripping mechanism 628 may assume a pushing position (FIG. 44) and a pulling position (FIG. 45) for respectively pulling and pushing modular mattress 604.

Figure 46:
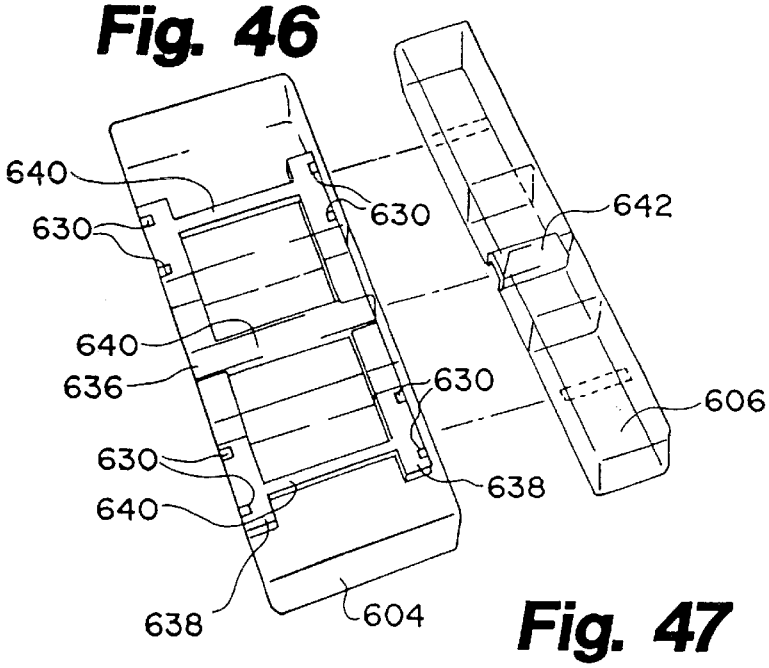
FIG. 46 is an exposed, top perspective view of a mattress and fixed cushion of the mattress transfer system indicating the location of structures within and below the mattress and cushion.

Referring to FIGS. 42 and 46, gripping mechanisms 628 grip handles 630 near the edge of modular mattress 604. Mattress transfer system 602 is controlled from control panel 632 mounted on foot board 634, as shown in FIG. 42. Actuating mattress transfer system 602 moves transverse bar 618 either toward or away from cart 610 by moving lateral drive bar 622 accordingly. Of course, a variety of designs are possible for the mattress transfer system 602 besides the embodiment described.

Referring again to FIG. 46, modular mattress 604 may include channel system 636 to accommodate transfer system 602. Channel system 636 includes transverse void 638 and longitudinal channels 640. Transverse void 638 accommodates transverse bar 618. Longitudinal channels 640 accommodate lateral tracks 624 and lateral drive track 626. Handles 630 are located along an upper surface of transverse void 638. To the extent necessary, channels 642 may be present within fixed cushion 606.

In order to transfer modular mattress 604, cart 610 is first docked with bed 600 using docking mechanism 612. If modular mattress 604 is being moved to cart 610, the patient is centered on modular mattress 604, and gripping mechanisms 628 are set from control panel 632 into a pushing position. Mattress transfer system 602 is then operated to move transverse bar 618 toward cart 610. When modular mattress 604 is located on cart 610, docking mechanism 612 is disengaged.

If modular mattress 604 is being moved from cart 610 to bed 600, cart 610 and bed 600 are docked appropriately. Then, transverse bar 618 is placed into an extended position within transverse void 638. Gripping mechanisms 628 are placed in their pulling position. Mattress transfer mechanism 602 is operated to move transverse bar 618 away from cart 610. When modular mattress 604 is in position on bed 600, mattress transfer system 602 is stopped and docking mechanism 612 is disengaged.

Figure 47:
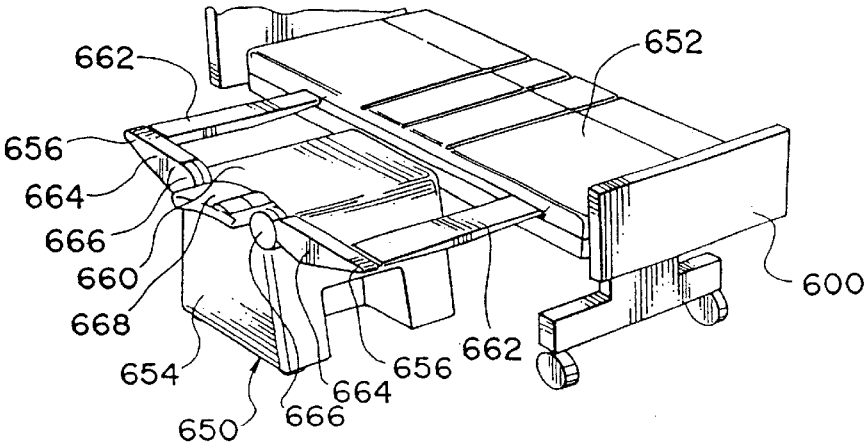
FIG. 47 is a perspective view of a mattress transfer system used with a position changing cart and a folding mattress.
Figure 56:
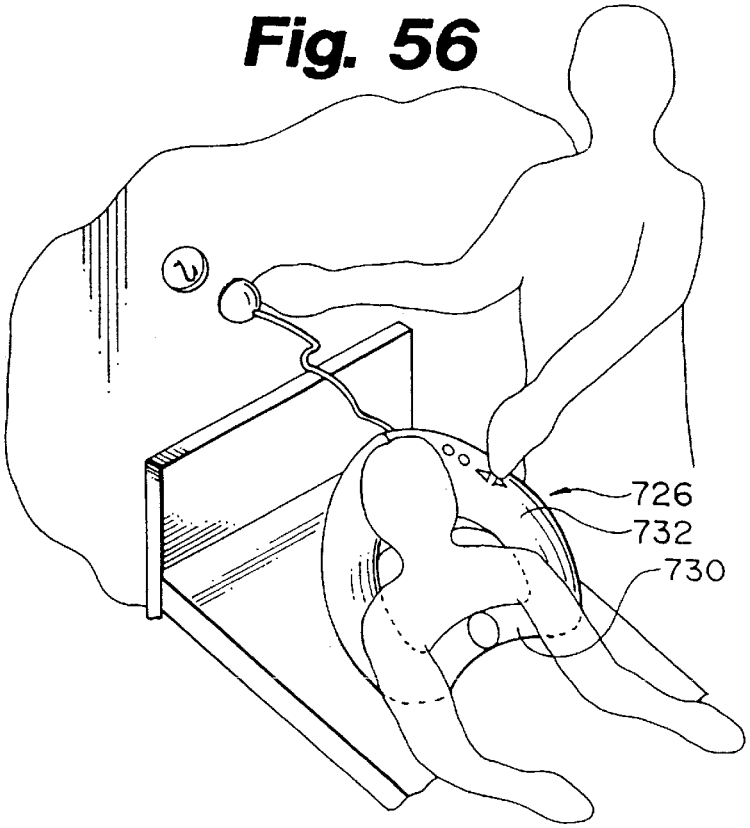
FIG. 56 is a perspective view of a motorized bed jacket being attached to a mount above a headboard.
Figure 58:
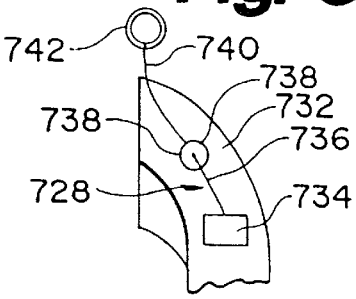
FIG. 58 is a partial cut away view of the drive system of the motorized bed jacket.
Figure 57:
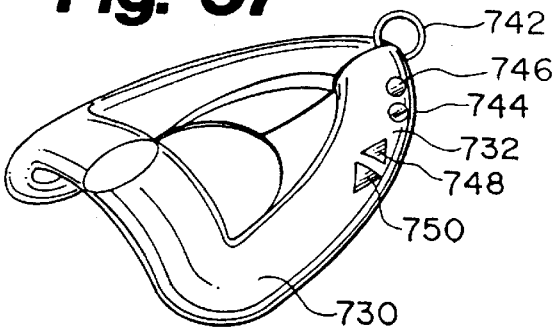
FIG. 57 is a top perspective view of the motorized bed jacket.

Bed 600 with mattress transfer system 602 may be adapted to cooperate with exemplary position changing cart 650 when used with folding mattress 652, as shown in FIGS. 47–49. Position changing cart 650 includes base 654 and a plurality of, preferably two, arms 656. Base 654 has a plurality of locking wheels 658 to provide a relatively broad base of support for cart 650. Base 654 should have sufficient weight and a relatively low center of mass such that cart 650 is stable. Top 660 of base 654 provides support for the center of folding mattress 652 when mattress 652 is positioned on cart 650.

Arms 656 may include support portion 662 and lever portion 664. Support portions 662 extend laterally toward bed 600 from the far edge of cart 650. Lever portions 664 are rigidly attached to support portions 662 at one end and are attached to hinge mechanism 666 at base 654. Support portions 662 support folding mattress 652 when mattress 652 is positioned on cart 650. A folding drive (not shown) within base 654 is operated from control panel 668 at the side of base 654. The folding drive operates to rotate hinge mechanisms 666 to change folding mattress 652 from a prone configuration to a seated configuration, or visa versa, as depicted in FIGS. 47,49.

When going from a supine to a seated configuration, lever portion 664 at the head of mattress 652 rotates upwardly and lever portion 664 at the foot of bed 400 rotates downwardly. Folding mattress 652 may include creases 670 to accommodate changes in configuration. Movement of folding mattress 652 on and off position changing cart 650 is analogous to moving modular mattress 604 on and off cart 610.

The next devices are designed to hoist, or pull up, a patient disposed on a bed or a chair. These devices are configured with at least one lifting device and at least one winch system. Exemplary embodiment 700 illustrates a hoist system. Hoist system 700 includes "lobster claw-shaped" bed jacket 702, as shown in FIGS. 50–52. Bed jacket 702 has two "claw" portions 704 joined at joint 706. Claw portions 704 are made of fabric enclosing a padding in one embodiment. Exemplary joint 706 includes folds in the fabric which enable a greater flexibility therein. No portion of bed jacket 702 fits under the mid-torso of a patient. Hence, it is relatively easy to place bed jacket 702 on the patient. Lifting forces generated when bed jacket 702 is used are distributed across the patient's chest and the patient's neck is supported by claw portions 704.

Claw portions 704 may display edges 708 at their ends opposite joint 706. Edges 708 may be joined by hook and loop fastener 710, with clips (not shown), as well as other suitable fasteners. However, edges 708 do not necessarily have to be joined before the patient is moved by bed jacket 702. In use, joint 706 is placed across the patient's chest and claw portions 704 are placed under the patient's arms. Edges 708 may be joined behind the patient's neck, if desired. If edges 708 are not joined, they will nonetheless be held together by loops 714. Loops 714, in turn, are attached to a hoist cable as described below.

Figure 53:
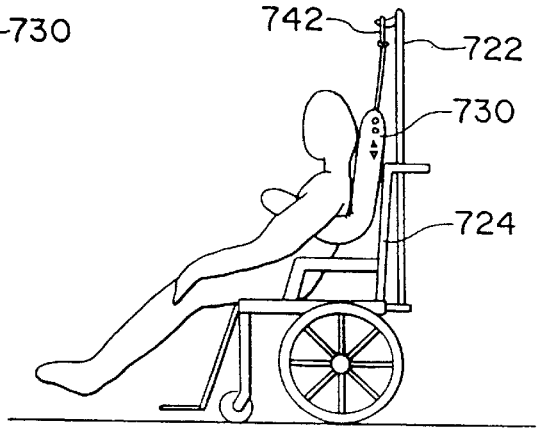
FIG. 53 is a perspective view of a motorized bed jacket attached to a stand above a wheel chair.

Bed jacket 702 may be used with at least two embodiments of the winch system described herein. A first embodiment, winch system 712, is depicted in FIG. 52. In this embodiment, bed jacket 702 includes loop 714 for attaching tether 716. Tether 716 winds on external winch 718. External winch 718 may be attached to head board 720, located on support 722. Support 722 may be in an elevated position above a bed or wheel chair 724 (FIG. 53) or mounted to a ceiling (FIG. 52). External winch 718 may be operated manually with a hand crank (not shown) or with a motor (not shown). If present, the motor may be controlled by a control panel.

Figure 54:
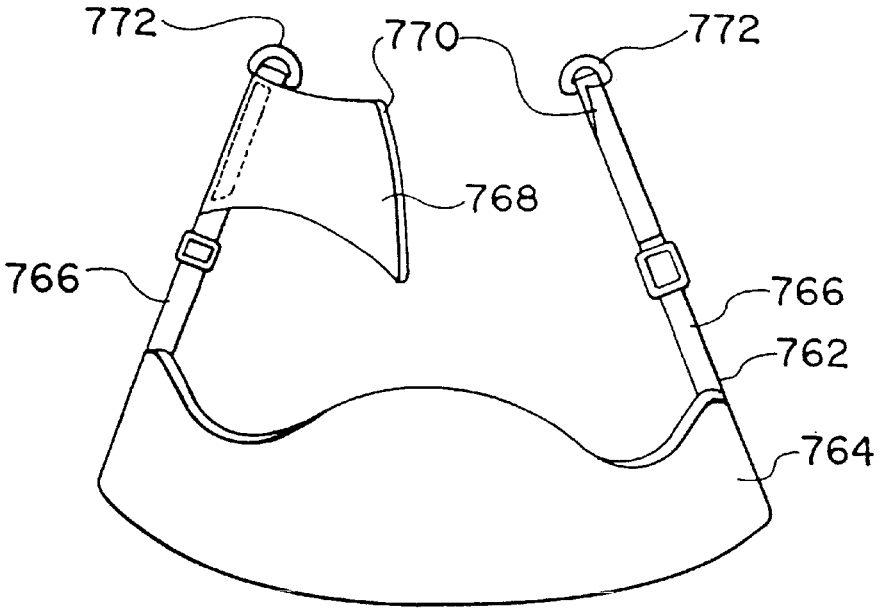
FIG. 54 is a front view of a padded vest.
Figure 55:
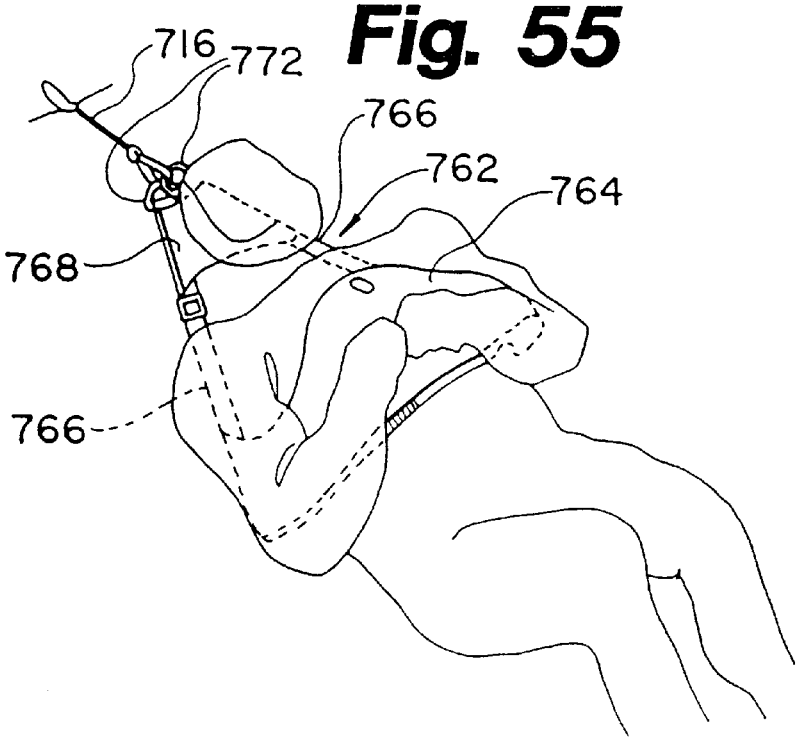
FIG. 55 is a perspective view of the padded vest around a person and attached to a tether where hidden portions of the vest are depicted with phantom line.

As shown in FIGS. 54, 55, external winch 712 may also be used with padded vest 762. Exemplary padded vest 762 offers many of the same advantages as lobster claw bed jacket 702. Padded vest 762 includes foam portion 764 and straps 766. Foam portion 764 fits across the patient's chest. Two adjustable straps 766 extend from foam portion 764. One strap 766 includes head support 768 attached thereto. The free end of head support 768 may be attached with hook and loop fastener 770 or a comparable fastener to the other strap 766. Rings 772 may be attached to the ends of straps 766. Rings 772 attach vest 762 to tether 716. Tether 716 is wound about winch 718.

FIGS. 53, 56–58 depict exemplary winch system 726. Winch system 726 includes bed jacket 730. Winch mechanism 728 is disposed within bed jacket 730. Winch mechanism 728 is preferably motorized. Winch mechanism 728 is embedded in one of claws 732 of bed jacket 730. However, winch mechanism 728 may be imbedded in other designs of bed jackets as well. Exemplary winch mechanism 728 includes motor 734. Motor 734 rotates drive shaft 736. Spool 738 is mounted on drive shaft 736. A first end of tether 740 is attached to spool 738. Ring 742 is attached to the second end of tether 740.

Claw 732 may also include controls such as release switch 744, recoil switch 746, pull switch 748 and lower switch 750. Release switch 744 releases spool 738, allowing tether 740 to be unwound therefrom. Recoil switch 746 winds tether 740 on spool 738 using a spring mechanism (not shown) if there is a sufficiently minimal resistance from tether 740. Pull switch 748 activates motor 734 to wind tether 740 on spool 738. Lower switch 750 actuates motor 734 in the opposite direction, thereby releasing tether 740 from spool 738. Optionally, controls 744–750 may be disposed externally to bed jacket 730. If so, controls 744–750 may be contained within a remote control unit or mounted to a bed. External control units may communicate with winch mechanism 728 either through a wired or wireless (transmitter/receiver) communication in a similar manner to control unit 278 on the clamp embodiments depicted in FIGS. 15 and 16.

Exemplary ring 742 may be attached to head board 720, to an elevated support on wheel chair 722 or to ceiling mount 52. Thus, motorized bed jacket 730 may be used in the same way as its non-motorized counterpart 702. Winch-bed jacket combination 730 is more versatile because it may be used without separate winches. Furthermore, controls 744–750 are conveniently located. Hence, a health care worker can operate controls 744–750 while being close enough to the patient to assist in the transfer thereof.

Figure 59:
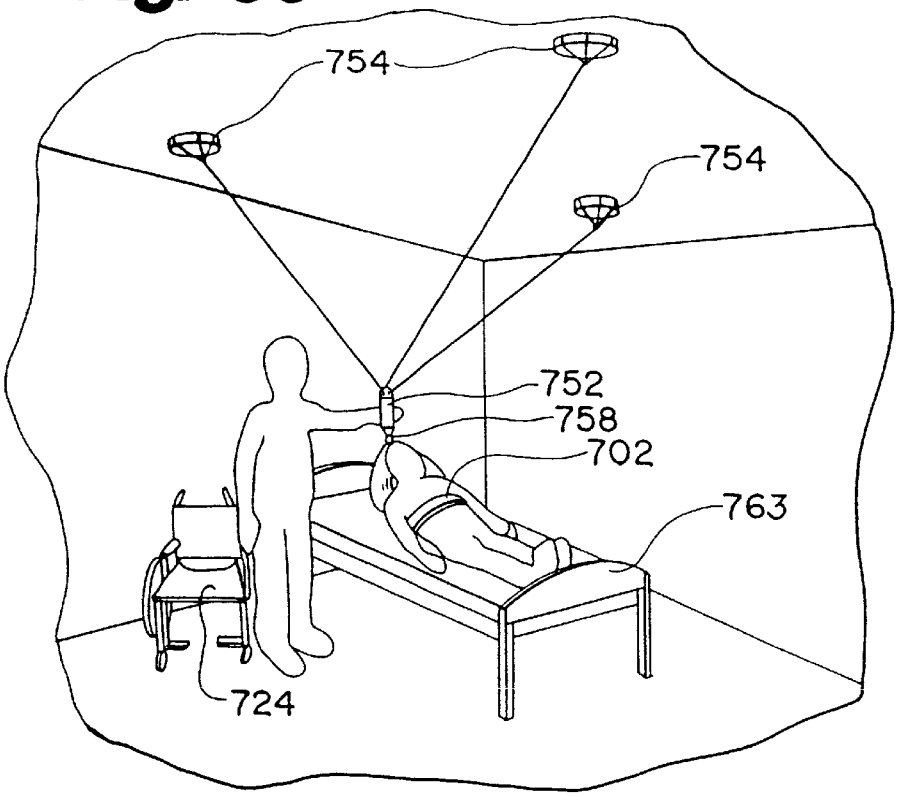
FIG. 59 is a perspective view of a bed jacket attached to three hoisting mechanism on a ceiling using a three way control cylinder.
Figure 60:
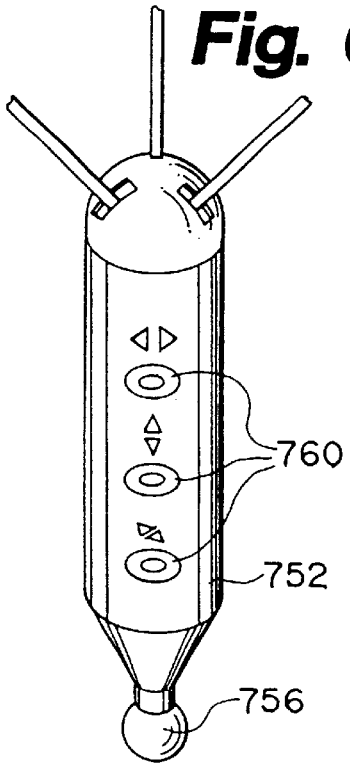
FIG. 60 is a side perspective view of the three way control cylinder.
Figure 61:
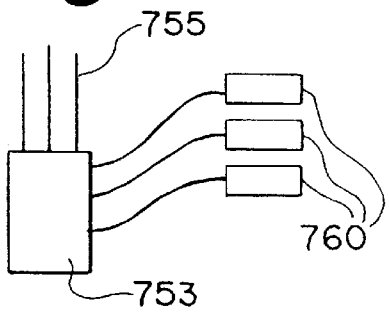
FIG. 61 is a schematic view of the internal components of the three way control unit.

Bed jacket 702 may also be connected by way of three axis control cylinder 752 to three ceiling mounted winches 754, as shown in FIGS. 59 and 60. Control cylinder 752 may connect to bed jacket 702 by way of ball 756. Ball 756 fits into ball joint 758. Control cylinder 760 may include three switches 760. Each switch 760 controls motion along one of three axes. Referring to FIG. 61, switches 760 are in electrical communication with microprocessor 753. Microprocessor 753 may be preprogrammed to include the locations of winches 754 in its memory. Thusby programmed, microprocessor 753 may calculate instructions for winches 754 to perform selected motions. Microprocessor 753 may be connected to winches 754 by way of wires 755. This versatile system can be used in a variety of ways including transferring a patient from bed 762 to a wheel chair 724 and pulling the patient up in either bed 762 or wheel chair 724. Padded vest 724 may also be used with three axis control cylinder 752.

Figure 62:
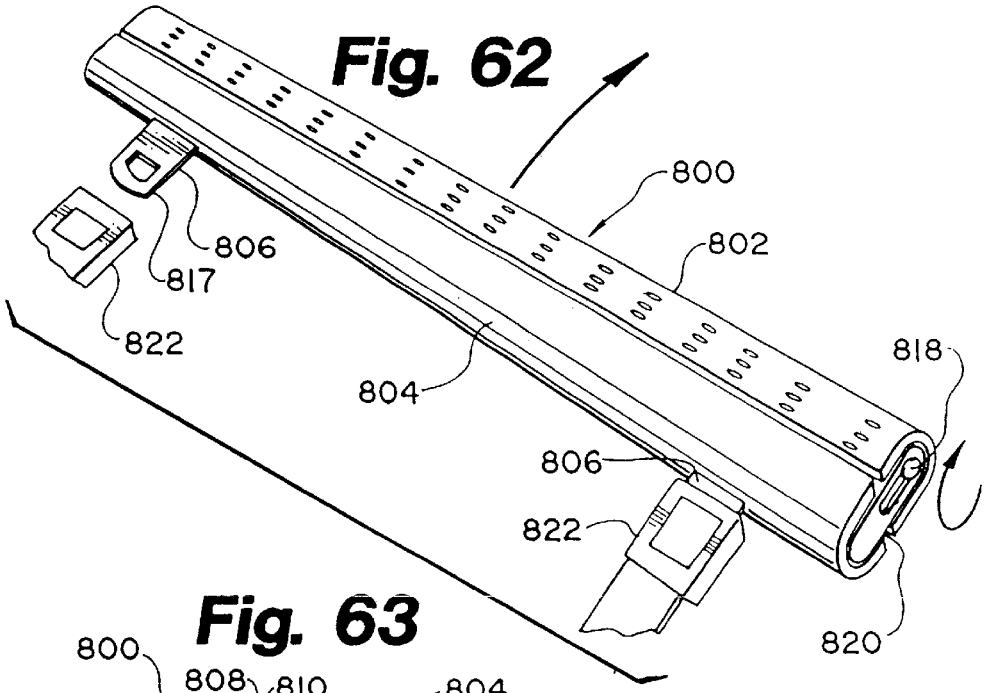
FIG. 62 is a top right perspective view of another clamp embodiment of the present invention.
Figure 63:
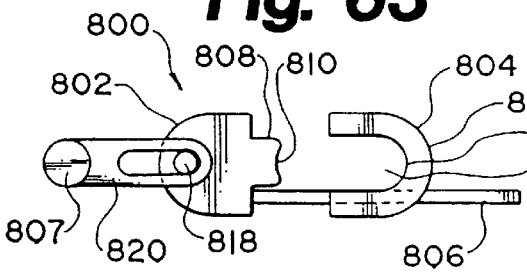
FIG. 63 is a side plan view of the clamp of FIG. 62, in an open position.
Figure 64:
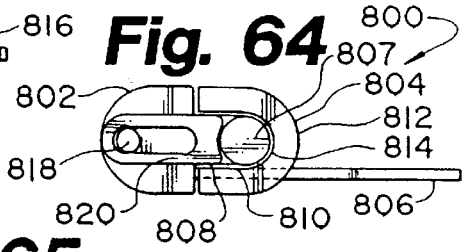
FIG. 64 is a side plan view of the clamp of FIG. 62 in a closed, locked position.

FIGS. 62–95 further relate to features of a portable patient transfer system of the present invention. Each component thereof, is consistent with the patient care and health care injury reduction goals stated above. Referring to FIGS. 62–64, exemplary engaging mechanism 800 is shown. Engaging mechanism 800 is designed for engaging or clamping a sheet bearing a patient. Engaging mechanism 800 includes forwardly opening element 802, arcuate engaging element 804, belt engaging element 806 and cylindrical member 807. In this embodiment, elements 802, 804 are elongated and may have a length of at least greater than about 60 cm and preferably at least about 100 cm. Element 802 includes interiorly disposed movable extension 808. A laterally disposed edge, such as convex edge 810, is present on extension 808. Arcuate engaging element 804 displays exterior surface 812 and interior surface 814. Interior surface 814 defines cavity 816. A plurality of belt engaging elements 806 are affixed to element 802. Elements 806 extend through engaging element 804. At least one engaging slot 817 is defined exterior to engaging element 804 on belt engaging element 806. Disposed on each end of element 802 is pivot means 818. Pivoting member 820 is slidingly and rotatingly affixed about pivot means 818. Pivoting member 820, in turn, is rigidly affixed to portions of cylindrical member 807. The exterior surface of cylindrical member 807 may be smooth or may present a roughened surface to enhance gripping. A rubberized or tacky substance may be present on the surface of cylindrical member 807. Other means to enhance gripping such as an increased surface area or greater gripping features of the existing surface area may also be present. A plurality of biasing springs or other biasing means (not shown) are optionally and operably disposed within engaging mechanism 800.

Functionally, elements 802, 804 of engaging mechanism 800 are biased away from each other by means one or more biasing springs (not shown). When a user desires to place a transfer sheet within engaging mechanism 800, the user first wraps a portion of the transfer sheet around cylindrical member 807. Subsequently, cylindrical member 807 is pivoted proximate convex interior surface 810. Elements 802 and 804 are then forced toward each other, thereby extending engaging slot 817 on belt engaging element 806 away from element 804. When elements 802, 804 are in a closed position, cylindrical member 807 and the portion of the transfer sheet wrapped around cylindrical member 807 are enclosed within clamp 800. Engaging slot 817 is displaced by forcing elements 802, 804 toward each other. Hence, when elements 802, 804 contact and grip cylindrical member 809 and the enwrapped transfer sheet, engaging slot 817 is sufficiently distant from element 804 for belt buckle 822 to firmly latch onto belt engaging element 806. Belt buckles 822, when firmly attached onto engaging element 806, thereby hold elements 802 and 804 in a closed position. Elements 802, 804 enclose cylindrical member 809 therein and exert a gripping force on the portion of the transfer sheet enclosed. When a patient is being transferred, a transfer force is exerted on belt engaging elements 806, further forcing elements 802 and 804 toward each other and thus exerting an additional, or further, gripping force on the transfer sheet disposed therein.

Figure 65:
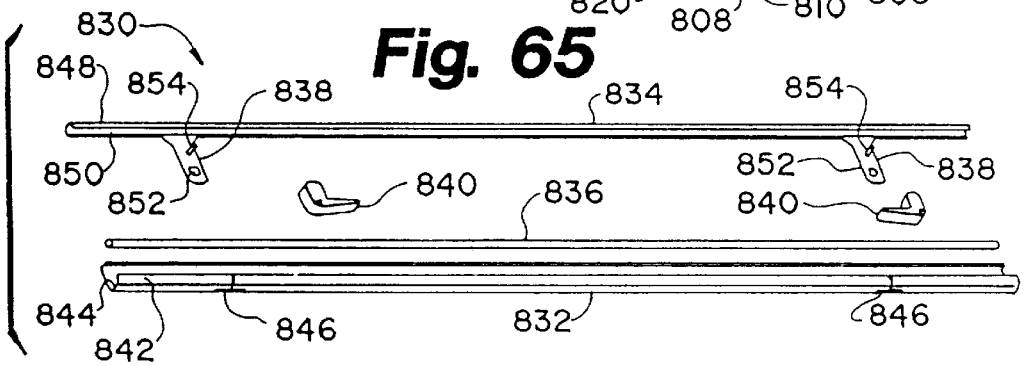
FIG. 65 is a top perspective view of another clamp embodiment of the present invention, the clamp disassembled and depicted in an exploded view.
Figure 66:
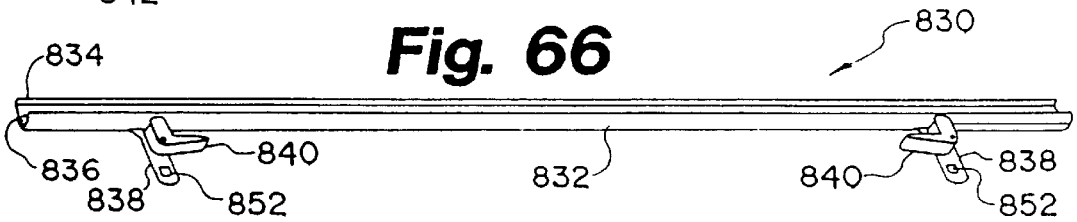
FIG. 66 is a top perspective view of the clamp of FIG. 65 assembled.

Exemplary clamp 830 is shown in FIGS. 65 and 66. Clamp 830 is another embodiment of the present invention. Clamp 830 includes large U-channel member 832, small U-channel member 834, cylindrical member 836, a plurality of belt engaging elements 838, and a plurality of cams 840. Large U-channel member 832 displays outer surface 842, inner surface 844 and defines a plurality of slots 846. Each slot 846 is optionally configured with a horizontal and a vertical dimension. Small U-channel member 834 displays outer surface 848 and inner surface 850. In this embodiment, U-channel members 832, 834 are at least about 60 cm, preferably greater than about 100 cm, in length. Cylindrical member 836 has a circumference sufficient to enable cylindrical member 836 to fit within the confines of inner surface 846 with a transfer sheet wrapped therearound. Cylindrical member 836 may have a length substantially the same as U-channel members 832, 834. The outer surface of cylindrical member 836 may be smooth, but may also be somewhat rough, thereby further facilitating gripping, as described above. Belt engaging elements 838 are rigidly affixed to, and extend from, small U-channel member 834. Disposed on each belt engaging element 838, as part of cam attachment element 838, is engaging means 852.

In use, a portion of a transfer sheet (not shown) is wrapped around cylindrical member 836. Cylindrical member 836 and the enwrapped sheet portion are disposed proximate inner surface 850 of small U-channel member 834 and adjacent belt engaging element 838. Belt engaging elements 838 are then passed through slots 846. Large U-channel member 832 and small U-channel member 834 are forced toward each other until cylindrical member 836 and the enwrapped sheet contact inner surface 844 of large U-channel member 832. At this point, the vertical notch component of slots 846 has served as a passageway for cam attachment elements 854. Cams 840 then lock members 832 and 834 together. Belt buckles or equivalent attaching means (not shown) are then affixed to belt engaging elements 838. As in previous embodiments, when a transfer force is exerted on clamp 830, members 832 and 834 are further forced together, thereby exerting an additional, or further, gripping force on the transfer sheet disposed therein.

Clamps 800 and 830 may be made from resilient, rather stiff materials. Suitable materials include various gauges of metal or synthetic resins. Buckle mechanisms, similar to those commonly used in automobiles, as well as the belts attached thereto, are possible for use as one embodiment of attaching means of the present invention.

Figure 67:
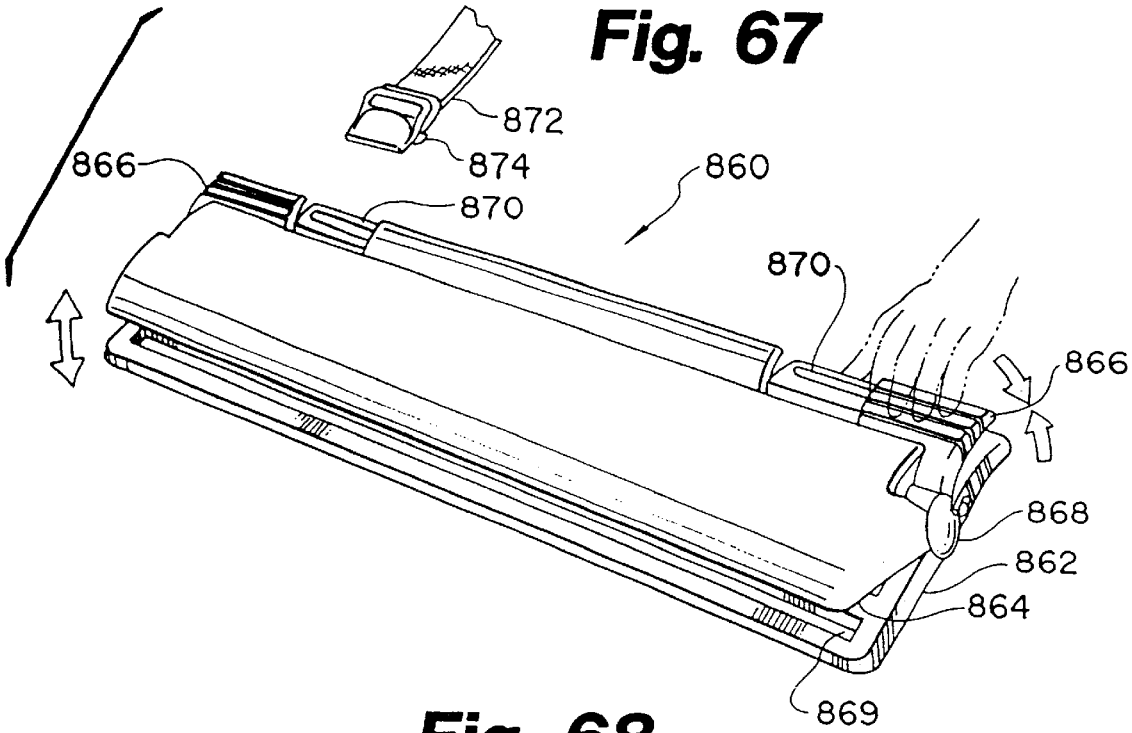
FIG. 67 is a top plan view of another clamp of the present invention.
Figure 68:
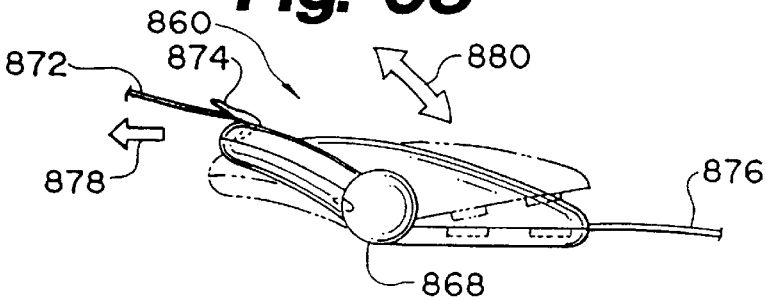
FIG. 68 is a side plan view of the clamp embodiment of FIG. 67.

Exemplary clamp 860, depicted in FIGS. 67 and 68, includes base member 862, pivoting upper member 864, two locking levers 866, locking mechanism 868 and a plurality of belt attachment sites 870. Pivoting upper member 864 pivots onto base member 862, with a pivot site at the base of member 864 and coincident with locking mechanism 868. A rubberized substance 869 or other material with increased tack may be present on the inner surfaces of base member 862 and upper member 864. A pair of locking levers 866 is present atop base member 862 and proximate the pivotal end of pivoting upper member 864. Locking mechanism 868 cooperates with locking levers 866 to secure pivoting upper member 864 in a locked position. Pivoting upper member 864 may be biased in an open position by such means as a leaf or helical spring. Two belt attachment sites 870 may be disposed adjacent to each locking lever 866.

In practice, a portion of a transfer sheet (not shown) is disposed between base member 862 and pivoting upper member 864. Alternatively, a portion of the transfer sheet may be wrapped around a cylindrical element or other suitable member (not shown), and then placed between base member 862 and pivoting upper member 864. Pivoting upper member 864 is then pressed toward base member 862 until locking mechanism 868 locks, thereby securing base member 862 and pivoting upper member in a closed, locked position with the transfer sheet gripped securely therewithin. Alternatively, pivoting upper member 864 and locking levers 866 may be mechanically connected by a linkage or lever combination in which locking lever 866 is pressed down by a user, thereby forcing pivoting upper member 864 down until locking mechanism 868 securely locks base member 862 and pivoting member 864 in closed contact. Finally, belt or strap 872 is affixed to clamp 860 by disposing hook 874 within the slots located at belt attachment sites 870.

As depicted in FIG. 68, when transfer sheet 876 is secured within clamp 860, base member 862 and pivoting upper member 864 are in a closed and locked position. When belt 872 is then retracted away from transfer sheet 876, a transfer force is exerted onto transfer sheet 876 in the direction of arrow 880. Due to the upper placement of belt attachment sites 870 and the angular configuration of the bottom portion of clamp 860, a pivot point is thereby formed proximate locking mechanism 868. This transfer motion simultaneously pivots upper member 864 upwardly and the portion of clamp 860 proximate hook attachment site 870 downwardly, thus rotating clamp 860 about the pivot point located proximate locking mechanism 868 and as indicated in arrow 880. The angular orientation of the portion of transfer sheet 876, secured within clamp 860, relative to the remainder of transfer sheet 876 exerts a further gripping force thereon.

Figure 69:
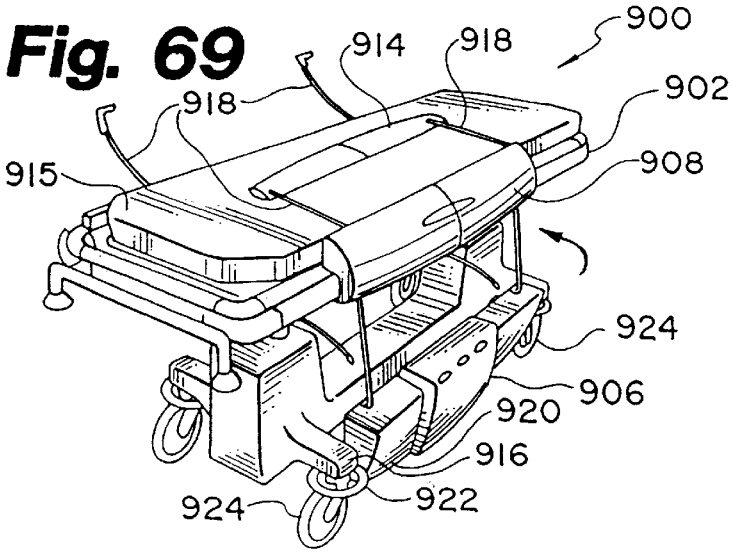
FIG. 69 is another embodiment of the transfer system of the present invention, whereby a patient may be bidirectionally transferred without the necessity of reinstalling this embodiment on another bed or cart.
Figure 70:
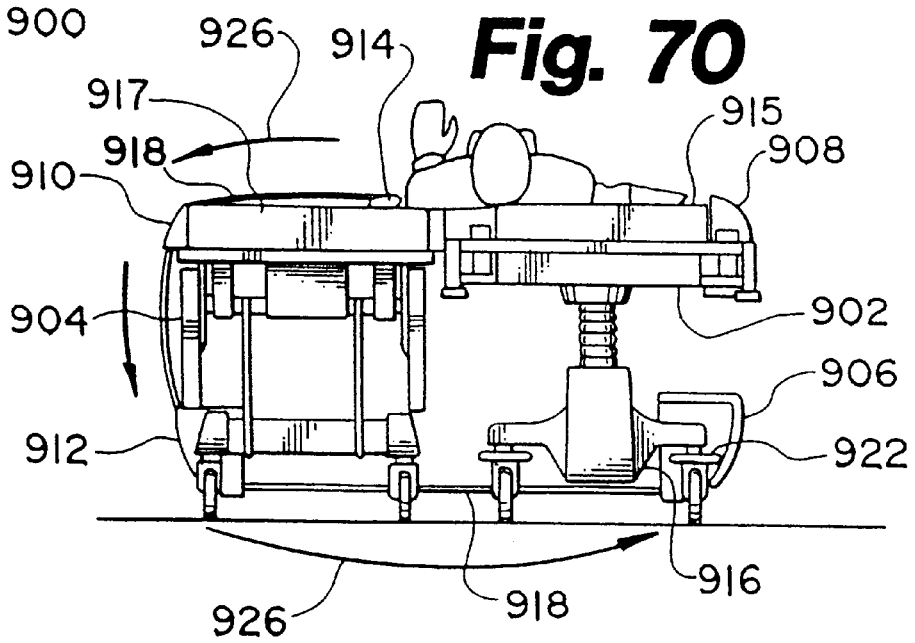
FIG. 70 is a side plan view of the embodiment of FIG. 69, wherein a patient is being transferred away from the bed on which the embodiment is installed.
Figure 71:
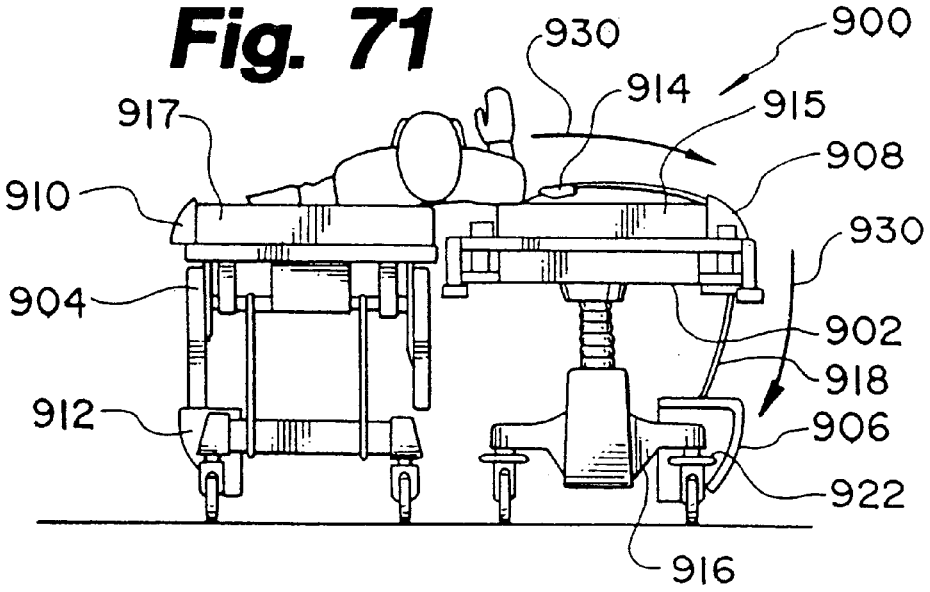
FIG. 71 is a side plan view of the embodiment of FIG. 69, wherein a patient is being transferred onto the bed or cart onto which the embodiment is installed.

Patient transfer system 900, as depicted in FIGS. 69–71, broadly includes bed 902, cart 904, motor-winch unit 906, perpendicular transfer units 908, 910, 912, clamp 914 and a plurality of belts discussed below. Although depicted as cart 904, a bed or other horizontal surface may be used and still be within the spirit and scope of the present invention. Motor-winch unit 906 may be attached to base 916 of bed 902. Perpendicular transfer unit 908 is attached to the upper frame of bed 902. Another perpendicular transfer unit 910 is attached to the upper frame on adjoining cart 904. Still another perpendicular transfer unit 912 is attached to the lower frame of cart 904. As shown in FIG. 69, a pair of belts 918 may extend generally upwardly from motor-winch unit 906 through perpendicular transfer unit 908, finally extending horizontally on mattress 915. Belts 918 are then attached to clamp 914 in any manner such as described herein. Alternately, belts 918 may proceed horizontally from motor-winch unit 906, beneath bed 902 and cart 904 and through perpendicular transfer unit 912. Extending generally upwardly and vertically from perpendicular transfer until 912, belts 918 pass through perpendicular transfer unit 910, then onto mattress 917. On mattress 917, belts 918 may be attached to a clamp such as a clamp of the present invention. Motor-winch unit 906 may be attached to bed 902 by means of rings 922 extending from housing 920. Rings 922 may enclose an upper portion of casters 924 on which bed 902 is mounted.

In use, bed 902 and cart 904 are aligned and may be secured together. If a patient is to be transferred from bed 902 onto cart 904, clamp 914 is attached to a transfer sheet upon which the patient is disposed. The belts attaching to clamp 914 have been routed under bed 902 and cart 904, then upwards, and then horizontally by means of perpendicular transfer units 910 and 912. Once motor-winch unit 906 is activated, belts 918 are retracted. The transfer force exerted thereby will transport the patient in the direction of arrow 926 from bed 902 onto cart 904. Once the patient has been transferred onto cart 904, motor-winch unit 906 is disengaged. Alternatively, a sensing device (not shown) may be attached to perpendicular transfer unit 910. This sensing device may be either mechanical, electronic, magnetic, optical or a combination thereof in its operation and may detect the presence of the patient, the buckle, the belt portion proximate the buckle, or the clamp within a predetermined distance from perpendicular transfer unit 910.

If the patient is to be transferred from cart 904 onto bed 902, belts 918 are routed through perpendicular transfer unit 908 and onto mattress 915 where they are attached to clamp 914. Clamp 914 is then securely attached to a transfer sheet upon which the patient is disposed. Motor-winch unit 906 is then activated, thereby retracting belt 918 in the direction of arrow 930, thereby generating a transfer force upon clamp 914. The transfer force acts upon the transfer sheet upon which the patient is disposed, thereby transferring the patient from cart 904 onto bed 902 and thereby further, or additionally, gripping the transfer sheet secured within clamp 914. Again, patient proximity sensing devices may be included in perpendicular transfer unit 908 as discussed hereinabove. Perpendicular transfer units 908, 910, and 912 may include either a pulley system or a roller system onto which belts 918 are emplaced prior to a patient transfer. Clamp 914 may be any of the clamps disclosed herein. Some exemplary embodiments of motor-winch unit 906 are discussed in more detail herein.

Figure 72:
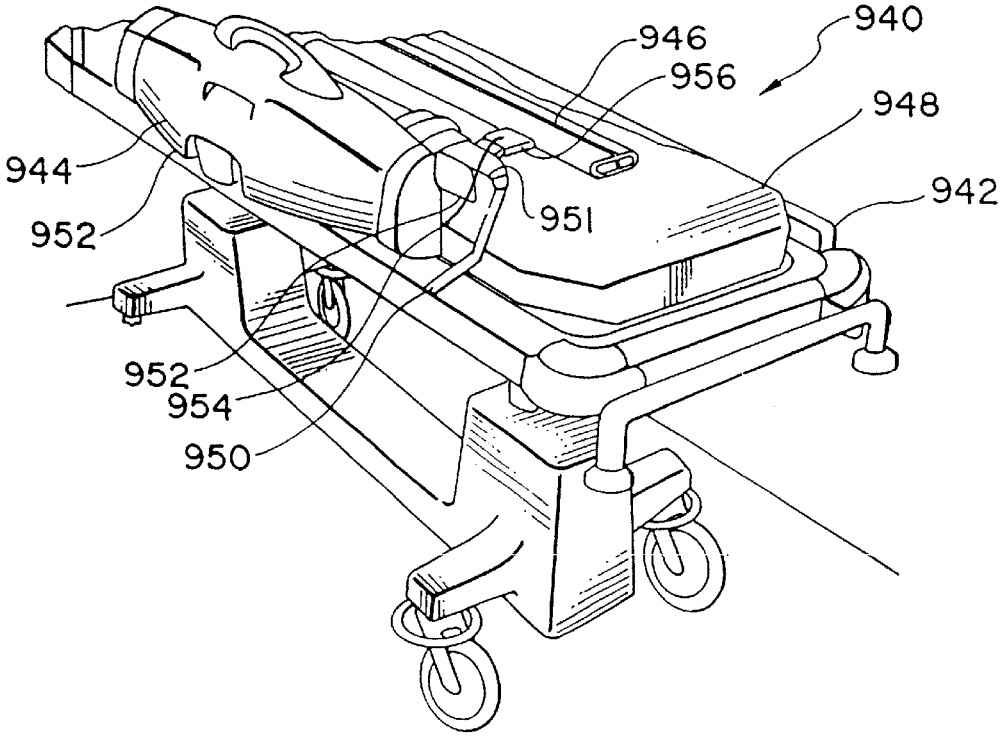
FIG. 72 is a top, side perspective view of a remote control usable for any of the embodiments described herein.
Figure 73:
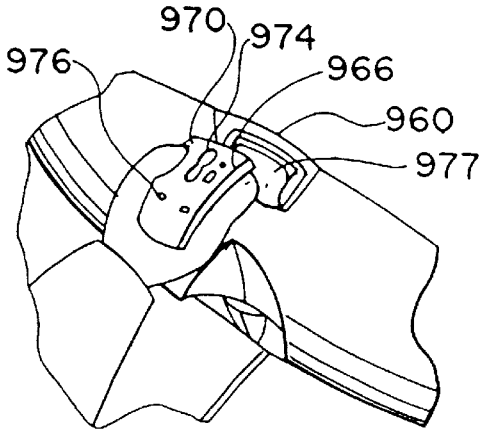
FIG. 73 is a top, side view of a remote control, which may be used for any of the embodiments described herein.
Figure 74:
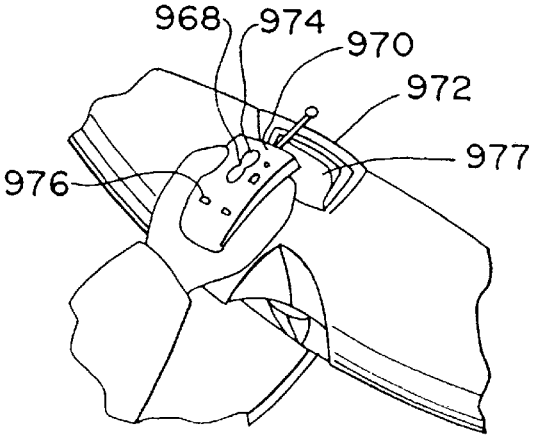
FIG. 74 is a top, side perspective view of a portable transfer device and clamp installed onto a hospital bed.

Referring to FIGS. 72–74, exemplary patient transfer system 940 is depicted. Patient transfer system 940 broadly includes bed 942, portable transfer unit 944 and clamp 946. Bed 942 includes mattress 948 and side rail 950. Side rail 950 may include a plurality of horizontal bars 951. Portable transfer unit 944 includes housing 952, one or more belts 954, an equal number of attaching means or buckles 956 and a motor-winch unit. Further included in portable transfer unit 944 is mounting bracket 958 which will be further described below. Handle 960 on portable transfer unit 944 enables an attendant to easily grasp and carry portable transfer unit 944 as desired. Housing 952 is preferably a light weight resilient plastic or other suitable light weight material. Portable transfer unit 944 has the advantage of being light in weight, hence readily transportable by an attendant of virtually any size and lifting ability with little likelihood of injury therefrom. Portable transfer unit 944 may weigh between about 20 and 35 pounds. Portable transfer unit 944 may also weigh between about 15 and 25 pounds.

FIGS. 73 and 74 depict two of many possible embodiments 966, 968 of control units 966, 968. Control units 966, 968 control the operation of exemplary portable transfer unit 944. Controls 970 of control units 966, 968 serve to operate portable transfer unit 944. Control unit 966 may communicate with portable transfer unit 944 by means of electromagnetic radiation, more particularly by radio frequency, or by other means. Controls 970 include on/off simultaneous transfer power control 974 and left and right transfer actuator controls 976, 977. Control unit 968 communicates with portable transfer unit 944 by means of a cord or other suitable connecting means. The cord is mechanically and electrically attached to control unit 968 and may be disposed on a spool or other retaining means within portable transfer unit 944. The spool may be biased so that cord 972 winds thereon when control unit 968 is released by the operator. Control units 966 and 968 may be housed in a recess contained within portable transfer unit 944 when not in use. An alternative to the control units of this patient transfer system is via voice actuation. Voice actuation would enable the patient to effect the patient's own transfer and to halt a transfer in progress if the need to do so arose.

Figure 75:
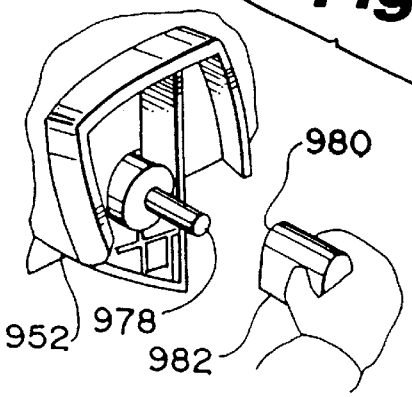
FIG. 75 is a top, side perspective view of an embodiment of the portable transfer device, wherein a spool or reel may be detachably installed onto a drive shaft.

FIG. 75 depicts another embodiment of a portable transfer unit according to the present invention. In this embodiment, shaft 978 extends laterally from housing 952. By being exposed, shaft 978 facilitates mounting spools 980 thereon. Spools 980 provide means upon which belts 982 are wound. Since shaft 978 is exposed, each spool 980 may be easily and quickly detached from shaft 978 to facilitate cleaning and disinfecting shaft 978, spools 980 and belts 982.

Figure 93:
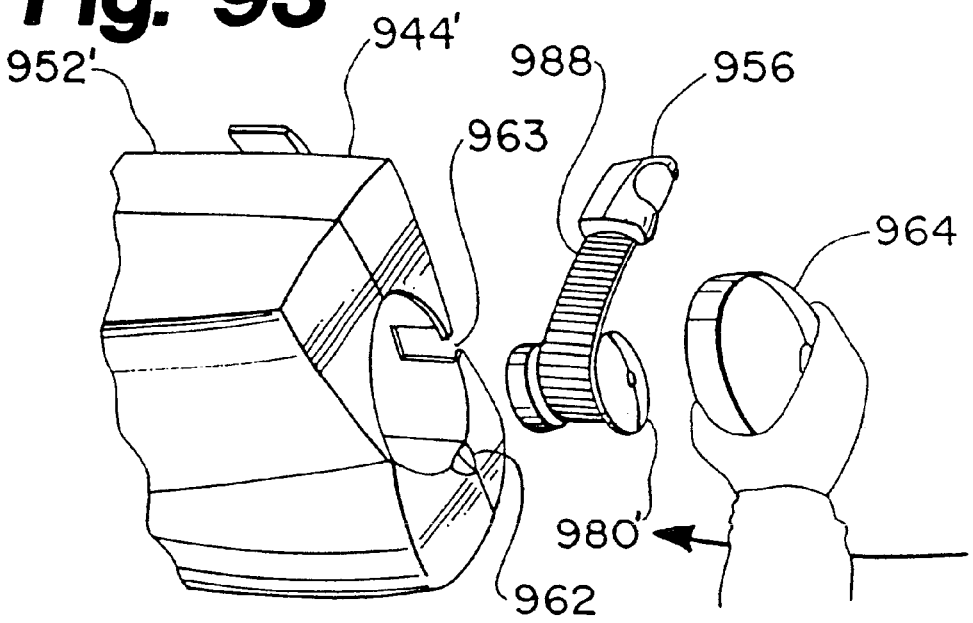
FIG. 93 is a side perspective view of a portable transfer unit.

Exemplary portable transfer unit 944' is depicted in FIG. 93. In this embodiment, receiving cavity 962 is formed in lateral portions of housing 952'. A drive shaft (not shown) is disposed within cavity 962. Spool 980' may be reversibly mounted on the shaft drive. Belt 988 is routed through slot 963 so that buckle 956 may be used to engage a clamp. Cap 964 may be used to cover cavity 962.

Referring again to FIGS. 72–76, bed 942 and exemplary portable transfer unit 944 are depicted. Portable transfer unit 944 is secured to side rail 950 by means such as those described below. Bed 942 is then placed beside a bed or cart onto which a patient is disposed upon a transfer sheet. The transfer sheet is then secured proximate the patient with clamp 946. Belts 954 are then extended from portable transfer unit 944 and attached to clamp 946. Either control unit 966 or 968 is detached from portable transfer unit 944 and used to operate the motor-winch within unit 944 by means such as on/off controls 974. Upon actuation of the motor-winch mechanism, transfer unit 944 begins to wind belts 954 and thereby move clamp 946, the transfer sheet, and the patient toward transfer unit 944. The motor-winch assembly may cease operation when the attendant operates control unit 966, 968 or when an above-described sensing device functions.

During transfer, it is desirable that the longitudinal axis of the patient be generally parallel to the longitudinal axis of the bed or cart onto which transfer is to be effected. If not, the patient may not be transferred completely onto the bed or cart and may require further manual adjustment by the attendant, possibly obviating some of the advantages of this system. Thus, left or right transfer actuator controls 976, 977 may be used. For example, if left control 976 is actuated, the belt 982, attached toward the patient's head, continues to be wound and the other belt 982 either ceases to be wound or is wound more slowly. In a similar manner, when right control 977 is actuated, belt 982, attached closest to the patient's feet, continues to be wound and the other belt 982 either ceases to be wound or is wound more slowly.

When patient transfer is complete, patient transfer system 940 may be disengaged from the transfer sheet and detached from bed 942. Belts 954 may then be retracted until attached clamp 946 is proximate portable transfer unit 944. Control unit 968 (or 966) is then stowed within a niche in portable transfer unit 944. The attendant then grasps handle 960 and carries portable transfer unit 944 and attached clamp 946 to another location (FIG. 95), or shows the unit on the cart or bed for subsequent use.

Figure 76:
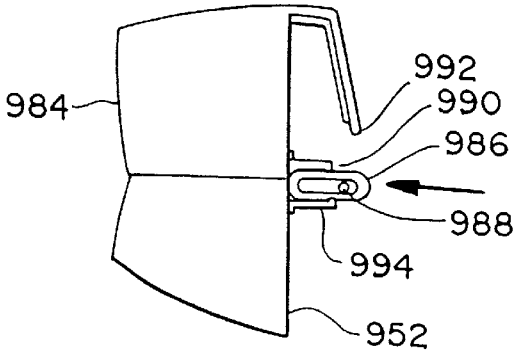
FIG. 76 is a side plan view of any of the portable transfer devices of the present invention depicting a reel for winding a retraction belt, wherein an automatic cutoff device is operationally installed.
Figure 95:
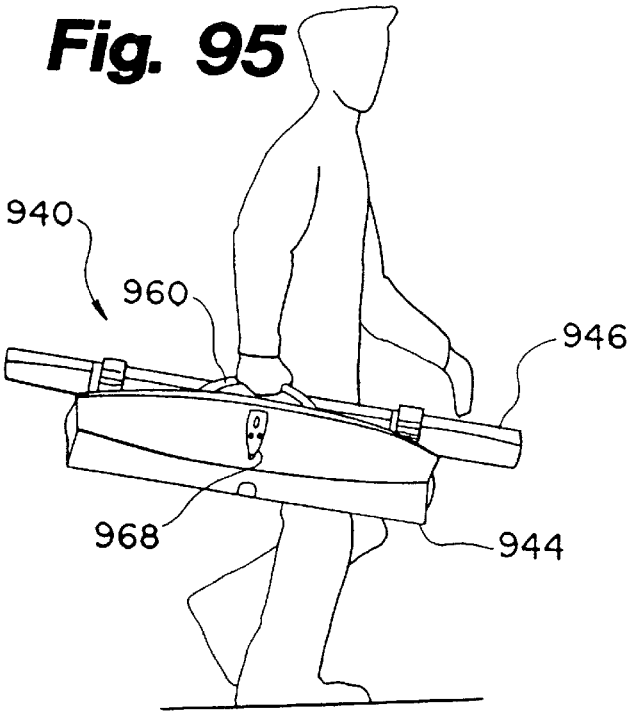
FIG. 95 depicts an attendant carrying a portable transfer unit.

Exemplary portable transfer unit 984 is depicted in FIG. 76. In this embodiment, belt 986 is bound onto spool 988. Spool 988, in turn, is detachably mounted onto bracket 990. Bracket 990 is mounted onto the back of housing 952. Bracket 990 includes upper member 992 and lower member 994. An automatic sensing and motor disconnect may be included in this, as well as other, embodiments. The sensing mechanism detects the presence of either the patient, the clamp, or the terminus of an attached belt. Upon sensing one or more of these, portable transfer unit 984 ceases to wind belt 988, thereby stopping or easing (slowing) patient transfer.

Figure 77:
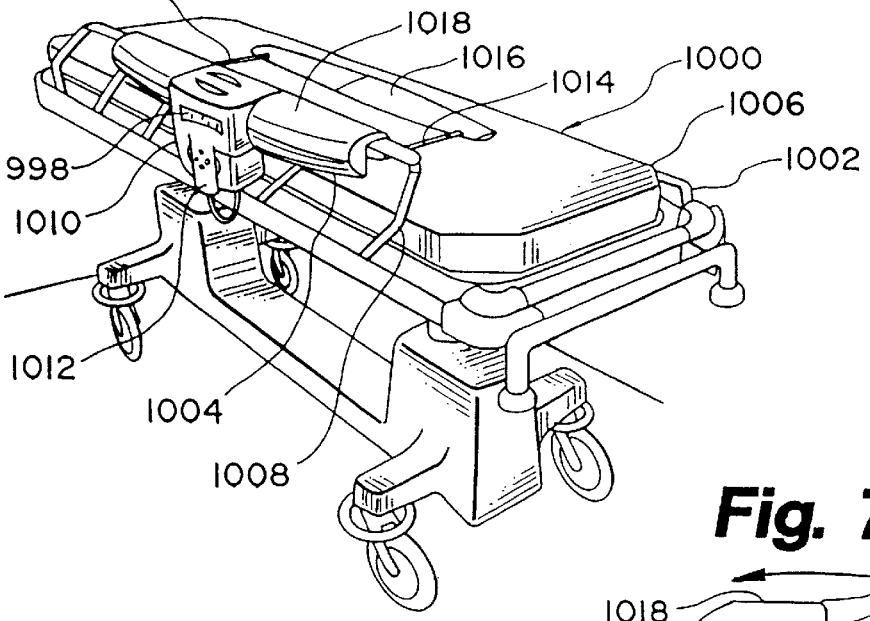
FIG. 77 is another embodiment of a portable transfer device installed onto a bed, and wherein one of the clamps of the present invention is connected thereto by means of belts.

The portable devices, as well as the other devices of the present invention, preferably also contain an automatic recording and/or display mechanism 998, representatively shown in FIG. 77. Mechanism 998 records each patient transfer event. Recording is via a printout on paper or other means. Recording may also comprise storage or transfer of relevant information electronically. The stored information may then be transferred to a computer or other device as desired. Relevant information with regard to a transfer event may include the time of day, the patient's number and name, the attendant's name and number, and the time length of the transfer event. Other items, such as motor performance and torque received by the motor-winch assembly, speed, acceleration, alignment, or other parameters of the patient or the clamp when transferring the patient may also be recorded.

Figure 78:
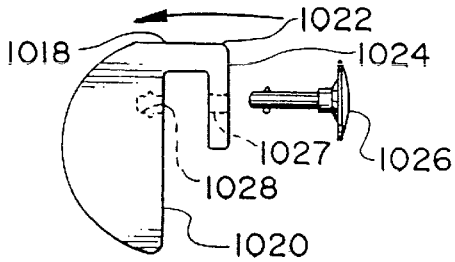
FIG. 78 is a side view of any of the portable transfer devices of the present invention, depicting a mounting bracket and quick release pin.

Referring to FIGS. 77 and 78, exemplary patient transfer system 1000 broadly includes bed 1002 and portable transfer unit 1004. Bed 1002 includes mattress 1006 and side rail 1008. Portable transfer unit 1004 includes housing 1010, control unit 1012, belts 1014 and an engaging mechanism, such as clamp 1016. Belts 1014 and clamp 1016 may include any of the embodiments discussed herein. Portable transfer unit 1004 combines a housing which encloses the motor and winch assembly and which is easily and reversibly mounted onto side rail 1008. Mounting bracket 1018 may be integral to housing 1010 of portable transfer unit 1004. Mounting bracket 1018 readily and securely mounts onto side rail 1008. A side view of one embodiment of mounting bracket 1018 is depicted in FIG. 78. While shown as unitary to the embodiment of FIG. 77, the concept depicted in FIG. 78 is applicable to any of the portable transfer units of the present invention. Mounting bracket 1018 includes engaging side 1020 of portable transfer unit housing 1010, horizontal extension 1022 and substantially vertical member 1024.

In use, portable transfer unit 1004 is situated onto side rail 1008 such that the lower surface of horizontal extension 1022 rests on side rail 1008. Pin 1026 is then inserted in opening 1027, extending through member 1024 and into a slot or receiving orifice 1028, securely fastening therein. Mounting bracket 1018, thereby securely holds portable transfer unit 1004 onto side rail 1008 during a transfer event. Moreover, transfer unit 1004 is easily detachable from side rail 1008 by removing pin 1026.

Figure 94:
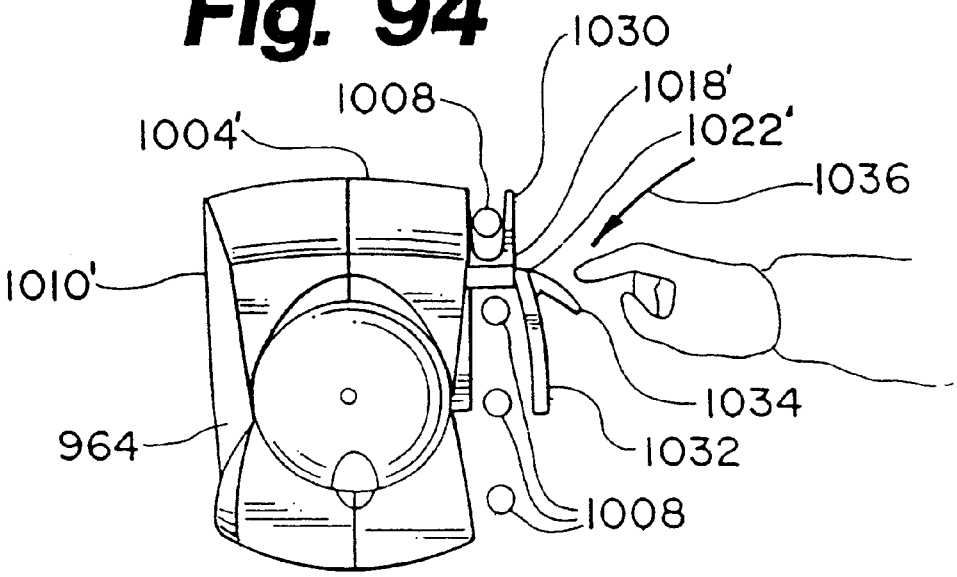
FIG. 94 is a side plan view of the portable transfer unit of FIG. 93.

An end view of another embodiment of a portable transfer unit 1004' is depicted in FIG. 94, where an alternate mounting bracket 1018' is disclosed. Mounting bracket 1018' includes horizontal extension 1022' extending integrally from housing 1010'. Extending generally vertically from horizontal extension 1022' are fixed upper vertical member 1030 and pivotally mounted, lower vertical member 1032. A locking mechanism, actuated by cam lever 1034, is included. To install portable transfer unit 1004' on a bed with side rails 1008, portable transfer unit 1004' is tilted, allowing upper vertical member 1030 to be disposed such that an upper side rail is between member 1030 and housing 1010'. Lower vertical member 1032, extended in an open position, allows portable transfer unit 1004' to be disposed in position and lower side rails 1008 to be disposed proximate housing 1010'. Lower vertical member 1032 is pivoted to a closed position, generally coaxial to that of upper vertical member 1030. Finally, cam lever 1034 is pivoted into a locked position in the direction of arrow 1036.

Figure 79:
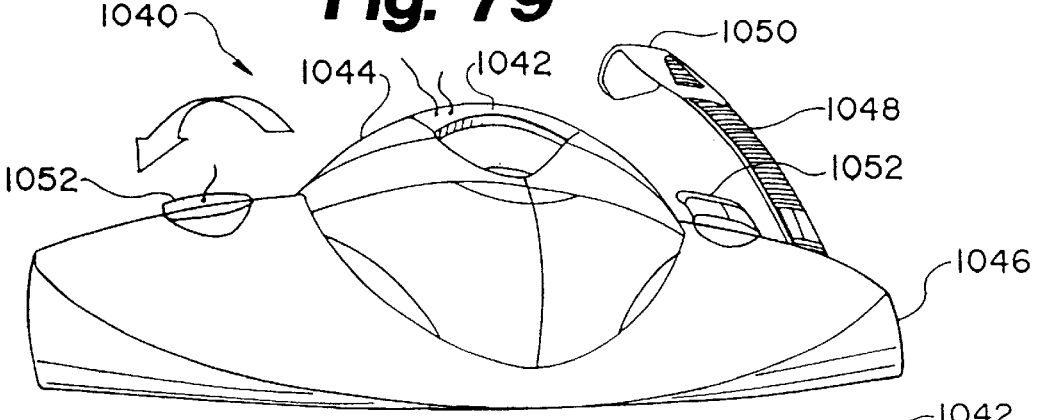
FIG. 79 is a top perspective view of another portable transfer device of the present invention.
Figure 80:
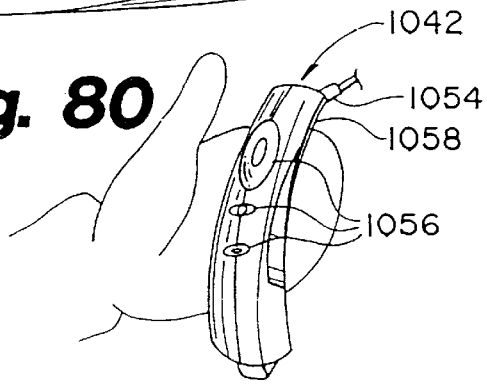
FIG. 80 is a top perspective view of a detachable remote control for any of the portable transfer devices of the present invention.

In FIGS. 79 and 80, another embodiment of a self-contained portable transfer unit 1040 of the present invention is depicted. Portable transfer unit 1040 broadly includes handle-control unit 1042, housing 1044, clamp 1046, belt 1048, hook 1050, and locking devices 1052. Portable transfer unit 1040 is self contained, including a belt, clamp, and enclosed motor-winch assembly. The motor-winch assembly of portable transfer unit 1040 may be totally enclosed within housing 1044. Belts 1048 may be extended to hook onto the framework of a bed or cart or they may be retracted to a position almost completely within housing 1044. Locking devices 1052 may be embodiments previously discussed with respect to the clamps of the present invention. Handle-control unit 1042 may be detached during a transfer event. Handle-control unit 1042 may include controls 1056 disposed within housing 1058. Alternatively, handle-control unit 1042 may include the controls depicted in FIGS. 73, 74 and discussed hereinabove. Cord 1054 physically and electrically connects control unit 1042 to the remainder of portable transfer unit 1040. Cord 1054 may be mounted to a pulley within housing 1044 so that cord 1054 is retracted unless pulled away by a user. Clamp 1046 may open downwardly to admit a transfer sheet therein.

In use, portable transfer unit 1040 is placed onto a bed, onto which a patient to be transferred is disposed upon a sheet. As shown in FIGS. 79–84, locking devices 1052 are unlocked and the jaws of clamp 1046 are separated. A portion of the transfer sheet is placed between the jaws of clamp 1046, the jaws are then closed and locking devices 1052 locked. Belts 1048 are extended away from portable transfer unit 1040, across the bed or cart onto which the patient is to be transferred and hooks 1050 are hooked onto the bed frame. The attendant detaches handle-control unit 1042 and then begins the transfer by actuating the motor-winch assembly. When the patient has been transferred onto the desired bed or cart, the attendant turns the motor-winch off. The transfer sheet is then freed from clamp 1046 and hooks 1050 are unhooked from the bed and retracted within housing 1044. Finally, handle-control unit 1042 is reconnected to portable transfer unit 1040. The attendant then may carry portable transfer unit 1040 away by grasping and holding handle-control unit 1042.

Figure 81:
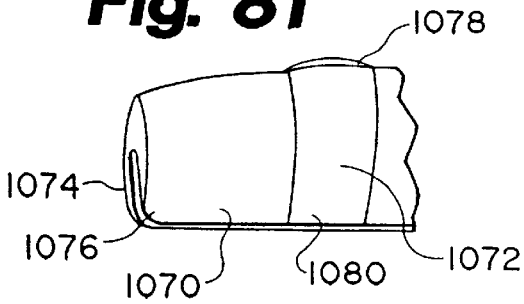
FIG. 81 is a fragmentary top perspective view of a portable transfer device of the present invention, depicting a clip for securing the jaws therein.
Figure 82:
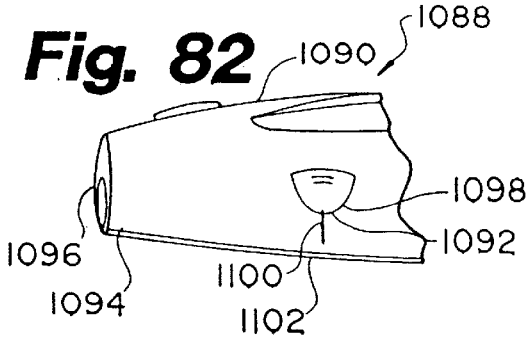
FIG. 82 is a fragmentary top perspective view of a portable transfer device of the present invention, depicting a lock-down device for securing the jaws thereto.

In FIGS. 81 and 82, other embodiments are shown for securing the clamps of the present invention. Referring to FIG. 81, clamp 1070 is secured in a closed position by the operation of clip 1072. Clamp 1070 includes lower pivoting member 1074 and upper clamp member 1076. Clip 1072 includes free end 1078 and pivot 1080. When in an open position, free end 1078 has been pivoted away from the body of clamp 1070 and lower pivoting member 1074 is pivoted away from upper clamp member 1076. Functionally, a transfer sheet (not shown) is placed between lower pivoting member 1074 and upper clamp member 1076. Lower pivoting member 1074 and upper clamp member 1076 are then pressed together. Free end 1078 is then pivoted toward the body of clamp 1070, then snapped around the front thereof. A locking mechanism is thereby actuated, locking lower pivoting member 1074 and upper clamp member 1076 securely together and gripping the sheet therewithin.

Clamp assembly 1088 is shown in FIG. 82 includes clamp 1090 and locking assembly 1092. Clamp 1090 further includes upper pivoting clamp member 1094 and lower clamp member 1096. Locking assembly 1092 includes handle 1098, which actuates the locking mechanism of clamp assembly 1088. Handle 1098 is affixed to the remainder of locking assembly 1092 via an elongated member. Handle 1098 and the elongated member are slidable within slot 1100. When clamp assembly 1088 is in an open position, upper pivoting clamp member 1094 is pivoted away from lower clamp member 1096 and handle 1098 is disposed toward rear edge 1102 of clamp 1090. In use, a transfer sheet is placed between upper pivoting clamp member 1094 and lower clamp member 1096 and clamp members 1094, 1096 are pressed together, firmly securing the transfer sheet within. Handle 1098 is then grasped by the attendant and pushed away from rear edge 1102, thereby activating locking assembly 1092 and securing upper pivoting clamp member 1094 and lower clamp member 1096 together in a secure, closed position.

Figure 83:
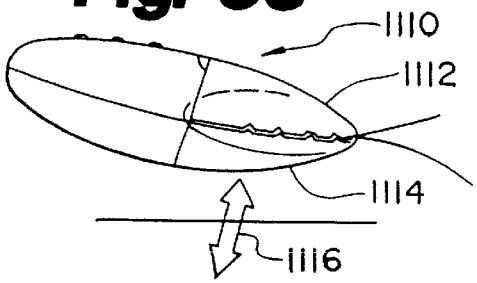
FIG. 83 is a top plan view of a portable transfer device of the present invention, depicting the downwardly opening jaw portion of the clamp thereto.

FIG. 83 is a side view of a self-contained portable transfer unit 1110. Portable transfer unit 1110 may include any of the self-contained portable transfer units described herein. Included are upper clamp member 1112 and lower pivoting clamp member 1114. When pivoted between an open and a closed position, lower pivoting clamp member 1114 may be moved in either direction as indicated by arrow 1116.

Figure 84:
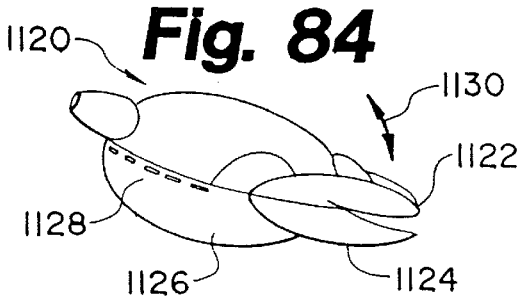
FIG. 84 is a side plan view of a portable transfer device of the present invention, depicting an upwardly opening jaw portion thereof.

FIG. 84 depicts self-contained portable transfer unit 1120. In addition to other features described for the self-contained portable transfer unit embodiments herein, transfer unit 1120 includes upper pivoting clamp member 1122, lower clamp member 1124 and housing 1126. Venting 1128 is present within housing 1126. As indicated by arrow 1130, upper pivoting clamp member 1122 pivots upwardly toward an open position or downwardly toward lower clamp member 1124 when in a closed position. Venting 1128, present in housing 1126, facilitates air exchange and, consequently, enhances cooling of the motor-winch assembly within portable transfer unit 1120.

Figure 85:
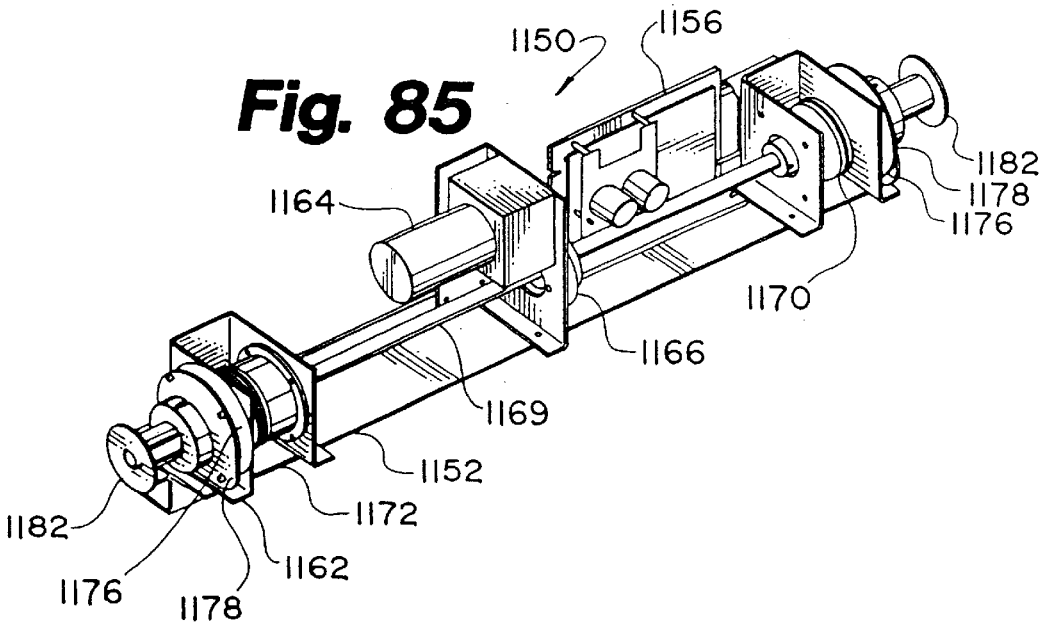
FIG. 85 is a top plan view of a motor and winch system, suitable for any of the transfer devices of the present invention.
Figure 86:
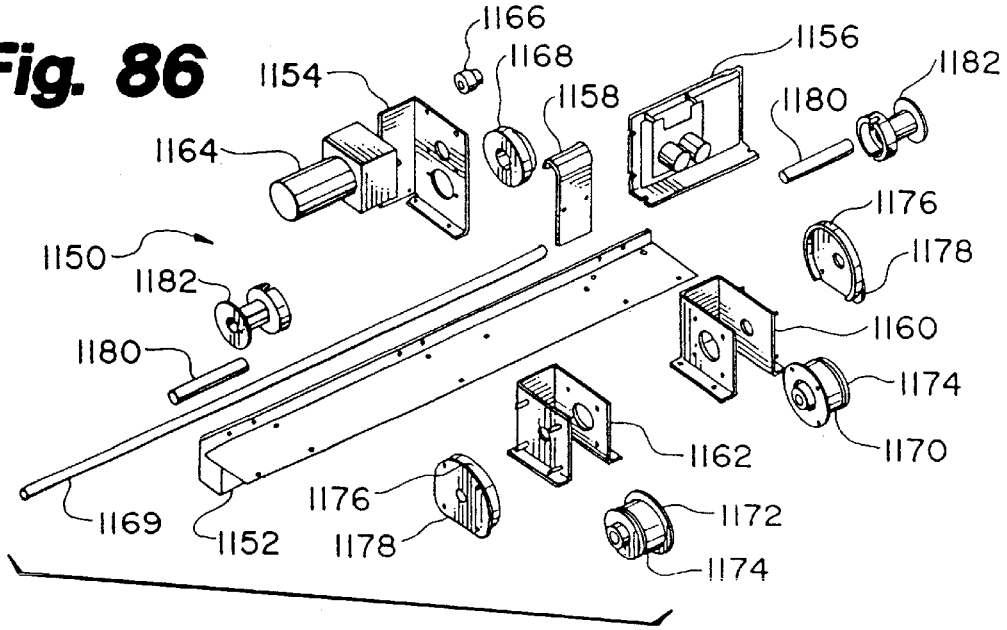
FIG. 86 is an exploded view of the motor and winch assembly of FIG. 85.
Figure 87:
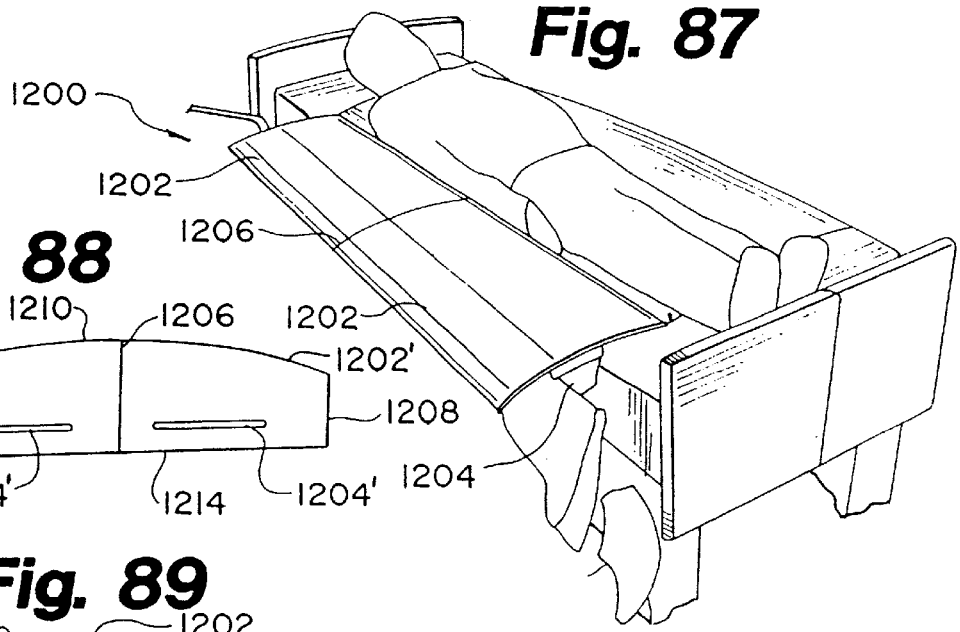
FIG. 87 is a top front perspective view of a transfer bridge spanning a gap between a bed with a patient reclining thereon and a transfer cart.

FIGS. 85 and 86 disclose one embodiment of motor-winch assembly 1150 of the present invention. Motor-winch assembly 1150 broadly includes frame 1152, upon which are mounted motor bracket 1154, control board 1156, hook member 1158, right clutch bracket 1160 and left clutch bracket 1162. Motor 1164 is operationally mounted on an upper portion of motor bracket 1154. Gear 1166 (which in one embodiment is a 42-tooth gear) is attached to a shaft (not shown) extending from motor 1164. Gear 1166, in turn, operably engages gear 1168 which is mounted on shaft 1169. Also mounted on shaft 1169 are right clutch 1170 and left clutch 1172. Right clutch 1170 is disposed within right clutch bracket 1160. Left clutch 1172 is disposed within left clutch bracket 1162. Spring 1174 is disposed about right clutch 1170 and about left clutch 1172. Spring 1174, in turn, is enclosed by spring cover 1176. Spring cover 1176 is attached to spring hub 1178. A spring hub 1178 is affixed to right clutch bracket 1160 and left clutch bracket 1162. Spool 1182 may be detachably disposed on the outboard portion of shaft 1169. Motor-winch assembly 1150 is suitable for providing the necessary power to operate the transfer units described herein.

Optimized patient transfer requires smooth transition of the patient from one platform to another. One means for achieving such optimization is through use of a transfer bridge 1200, shown in FIGS. 87–90. A modified transfer bridge 1200', depicted in FIG. 87, differs from transfer bridge 1200. Transfer bridge 1200 broadly includes one or more sections 1202. A stabilizer 1204 is ideally present on the underside of each section 1202. Where multiple sections are used, such sections 1202 are joined by hinge 1206 (discussed hereinbelow), and stabilizer 1204 extends generally perpendicularly from each section. Functionally, transfer bridge 1200 is placed between a bed or cart onto which a patient is lying and another bed or cart onto which the patient is to be transferred. Stabilizer 1204 is disposed between the platforms, thereby securely holding transfer bridge 1200 in place and preventing transfer bridge 1200 from being displaced by patient contact during a transfer. After use, transfer bridge 1200 is folded along hinge 1206 for storage or transport.

Figure 89:
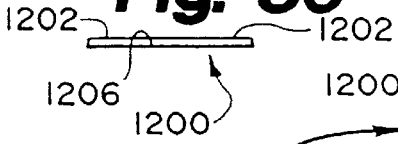
FIG. 89 is a fragmentary side view of the transfer bridge of FIG. 87 or FIG. 88, depicting the hinge thereon.
Figure 90:
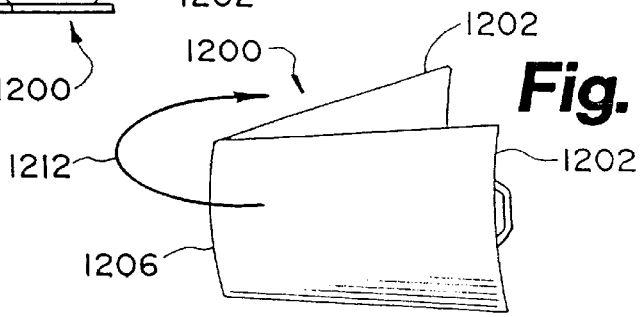
FIG. 90 is a top front perspective of the bridge of FIG. 87 being folded and prepared for either transport or storage.

One embodiment of hinge 1206 is depicted in FIG. 89. Hinge 1206 may be manufactured as a "living hinge," i.e., a hinge made by removing a narrow, linear portion of the material along a portion of transfer bridge 1200 or transfer bridge 1200'.

Figure 88:
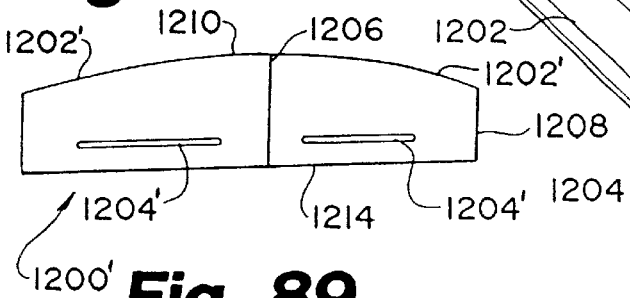
FIG. 88 is a bottom plan view of an alternate embodiment of the transfer bridge of FIG. 87.

Transfer bridge 1200', shown in FIG. 88, includes a plurality of sections 1202' and a stabilizer 1204', mounted on the underside of each section 1202. As in the case of transfer bridge 1200, hinge 1206 is present and divides 1202. Leading edge 1210 is present on the portion of transfer bridge 1200' opposite stabilizers 1204'. Although not depicted, transfer bridge 1200 and 1200' may include one or more carrying handles. The carrying handles may be attachable, unitary to transfer bridge 1200, 1200' or may be cutouts within sections 1202 or 1202'. Preparing transfer bridge 1200' for a patient transfer is essentially done in an identical manner as preparing transfer bridge 1200, the only exception being that leading edge 1210 is oriented toward the patient to be transferred.

Both transfer bridge 1200 and 1200' may be constructed using a smooth polyethylene sheet material, which is generally about 1.5 millimeters in thickness. Alternatively, hinge 1206 may be reinforced with a thin sheet of polyethylene on the underside of transfer bridge 1200, 1200'. Stabilizer 1204' may be centered about 7.5 centimeters from edge 1214. One embodiment of transfer bridge 1200' is about 31 centimeters wide at hinge 1206, tapering to about 25 centimeters in width at each end. The cambered radius for a side section of transfer bridge 1200' is about 105 centimeters. The cambered radius for the leading edge of transfer bridge 1200' is about 225 centimeters. The side camber insures that leading edge 1210 will firmly contact the mattress on which the patient is disposed such that transfer bridge 1200' will not be displaced during a patient transfer. The leading edge camber allows for a gradually increasing amount of patient contact during transfer, rather than immediate total contact. The gradually increasing contact also tends to allow the patient to be pulled atop transfer bridge 1200', rather than abutting and possibly displacing transfer bridge 1200'. Transfer bridge 1200' is advantageously positioned when leading edge 1210 is placed under at least a portion of the patient.

In an average male patient, approximately 90% of the patient's weight resides in the portion between the patient's buttocks and shoulders. Hence, the overall length of transfer bridge 1200 or 1200' should minimally provide support therefor. Accordingly, lengths for transfer bridge 1200 or 1200' may be between 65 and 173, centimeters or about 65, 120 and 173 centimeters.

Figure 91:
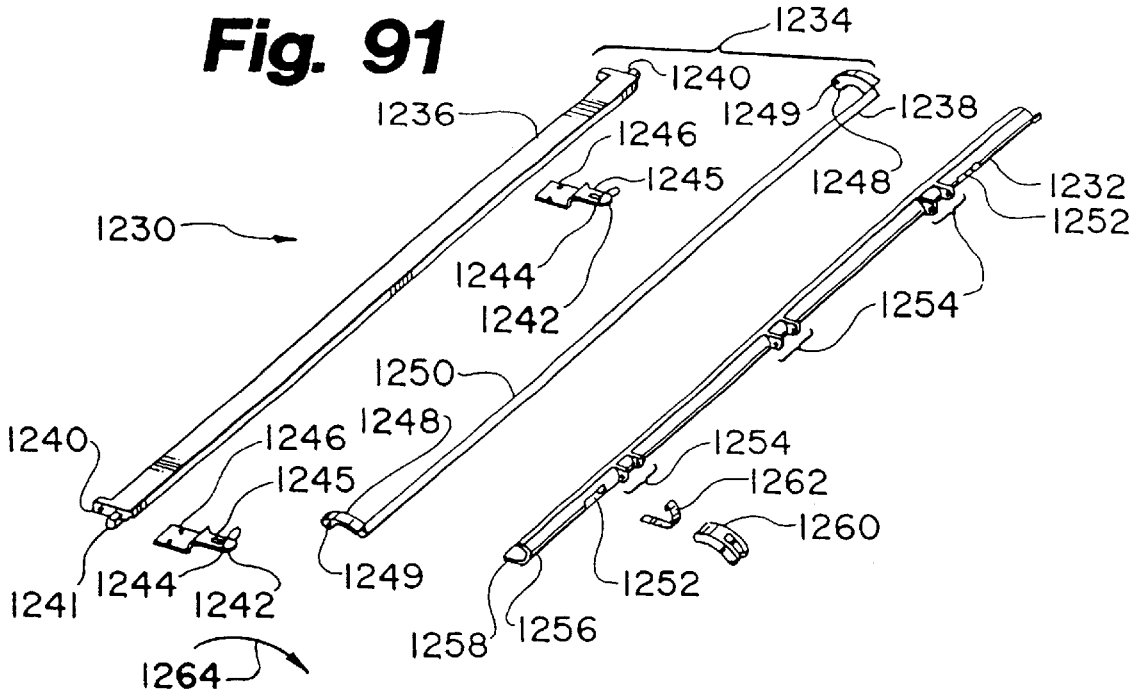
FIG. 91 is an exploded view of a clamp of the present invention.
Figure 92:
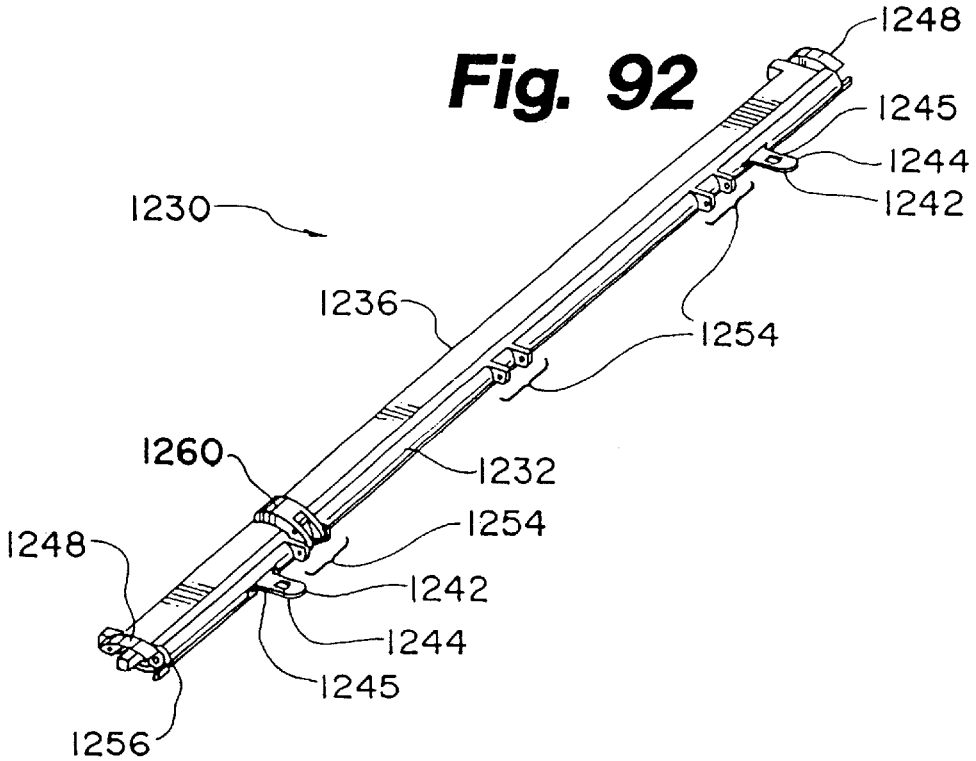
FIG. 92 is a top perspective view of the assembled clamp of FIG. 91.

Clamp 1230 is yet another embodiment of an engaging means for use with this invention. Clamp 1230 is depicted in FIGS. 91 and 92. Clamp 1230 broadly includes U-channel member 1232 and pivot assembly 1234. Pivot assembly 1234, in turn, includes pivot member 1236 and pivot rod 1238. Defined laterally on each end of pivot member 1236 is pivot point orifice 1240. Tab 1241 is laterally present proximate pivot point orifice 1240. Symmetrically affixed to pivot member 1236 is a plurality of belt engaging elements 1242. Each belt engaging element 1242 generally includes tongue section 1244 and planar member 1246. Each tongue section 1244 defines engaging slot 1245. Tongue section 1244 and planar member 1246 are joined in a stair step fashion. A pair of pivot rod brackets 1248 may be laterally attached to pivot member 1236 by means of a rivet or bolt. Orifice 1249 is defined by each pivot rod bracket 1248 and provides the opening through which pivot point 1240 may be disposed. At least one cylindrical member 1250 is affixed to each pivot rod bracket 1248. U-channel member 1232 may include a plurality of slots 1252 and a plurality of brackets 1254. U-channel member 1232 displays leading edge 1256 and inner surface 1258, discussed hereinbelow. Mounted on brackets 1254 is a plurality of cam levers 1260 and springs 1262.

Operationally, a portion of transfer sheet 1263 is wrapped about cylindrical member 1250. Cylindrical member 1250 and the enwrapped portion of transfer sheet 1263 are then pivoted in the direction of arrow 1264 until brackets 1248 rest upon tabs 1241. Slots 1252 on U-channel member 1232 are aligned with belt engaging elements 1242. U-channel member 1232 and pivot assembly 1234 are then pressed together, thus allowing belt engaging elements 1242 to pass through slots 1252 and protrude forwardly therefrom. U-channel member 1232 and pivot assembly 1234 may be biased away from each other by means of a plurality of springs. Another alternative embodiment of clamp 1230 employs a spring (not shown) to bias cylindrical member 1250 in an open position. Cam levers 1260 are then rotated over pivot member 1236, thereby biasing pivot member 1236 against U-channel member 1232 and cylindrical member 1250 firmly against inner surface 1258. Finally, a belt buckle may be affixed to belt engaging elements 1242. Leading edge 1256 of U-channel member 1232 is may be arcuate in cross-section, thereby allowing clamp 1230 to be more positively pulled upon a transfer bridge during a patient transfer, rather than abutting and displacing the transfer bridge.

Referring to FIGS. 96–97, exemplary patient transfer system 1300 enables a single operator to transfer a patient disposed on a sheet from a first horizontal surface to a second horizontal surface. Patient transfer is effected with minimum risk of back injury to the operator. Moreover, patient transfer system 1300 is compact, easily transported to and from the site of a transfer event, and self-contained.

Moreover, patient transfer system 1300 is compact and thus easily fits through hospital and elevator doors and other small spaces. A single attendant may easily roll patient transfer system 1300 to the site of a patient transfer, conduct the patient transfer, then roll patient transfer system 1300 to the site of another transfer or place of storage. Patient transfer system 1300 is self-contained in that every component necessary to transfer a patient disposed on a sheet from a first horizontal surface to a second horizontal surface is self-contained.

As seen in FIGS. 96–99, 134, patient transfer system 1300 broadly includes transfer caddy 1302, transfer bridge 1304, and transfer rod 1306. Transfer caddy 1302, in turn, includes head assembly 1308, hook and web assembly 1310, base assembly 1312 and electrical and switching system 1314.

Figure 98:
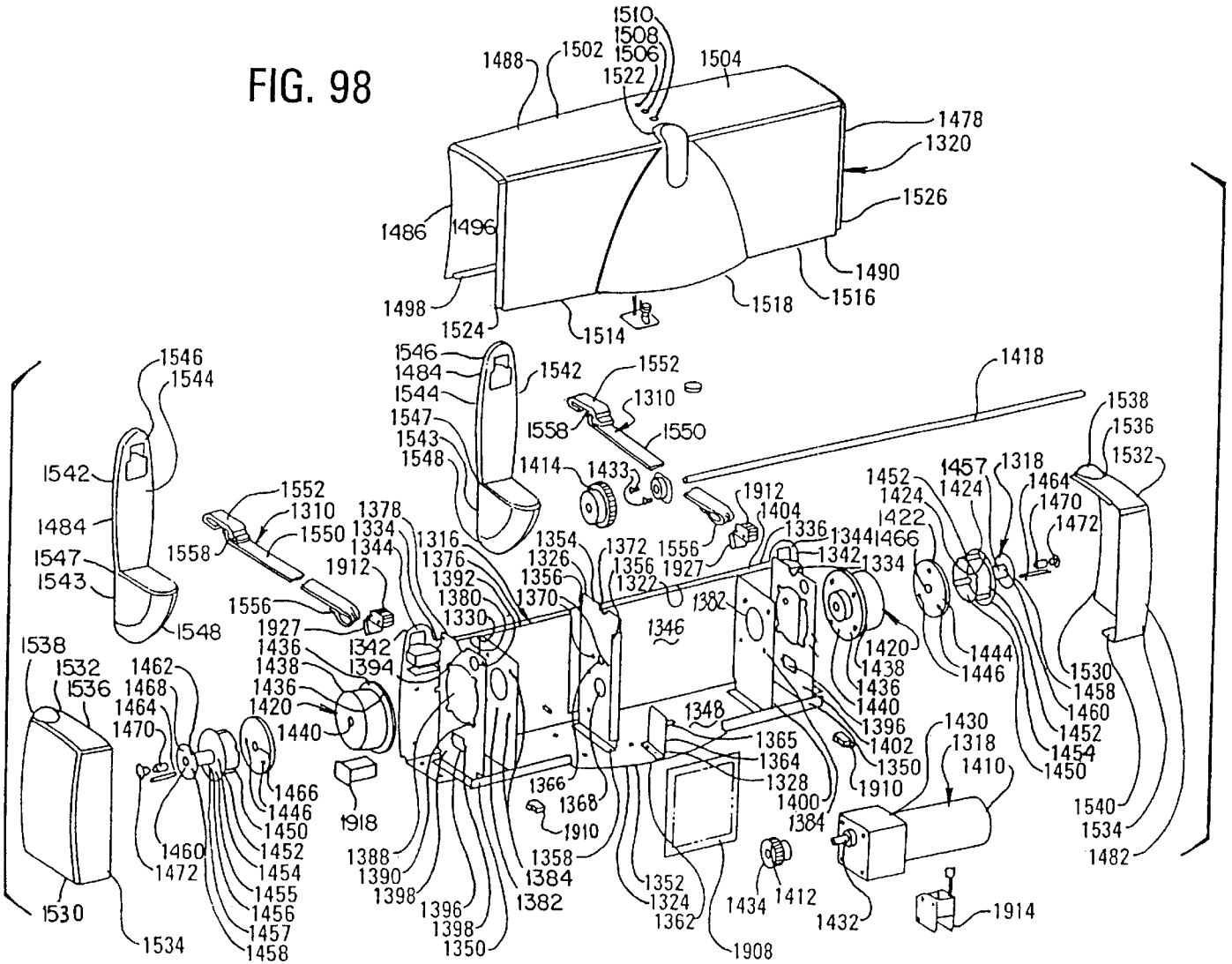
FIG. 98 is an exploded view of the top frame of the present invention.
Figure 114:
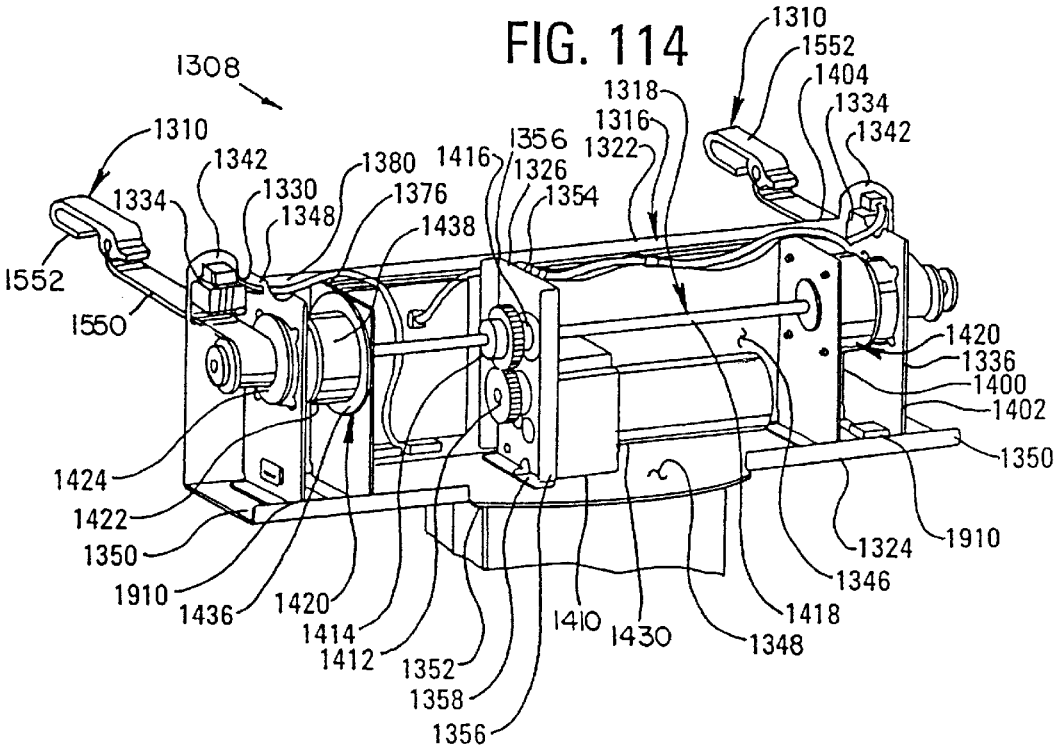
FIG. 114 is a fragmentary elevated perspective view of the head assembly of the lateral patient transfer system with the upper shield removed.

Referring to FIGS. 98, 114, head assembly 1308 includes top frame 1316, power train 1318, and upper shield assembly 1320. Top frame 1316 includes front panel 1322, base panel 1324, motor bracket 1326, retractor bracket 1328, left clutch bracket 1330, a pair of interlock switch brackets 1334, and right clutch bracket 1336.

Front panel 1322 includes lobes 1342 which extend laterally from upper edges of front panel 1322. Lobes 1342 and front panel 1322 cooperate in defining generally rectangular openings 1344. Front panel 1322 presents planar inner surface 1346. Base panel 1324 extends generally transversely from a bottom edge of front panel 1322. Base panel 1324 presents upper surface 1348. A pair of laterally disposed peripheral lips 1350 extend upwardly from a rear edge of base panel 1324. Arcuate extension 1352 is a rearward extension of base panel 1324 and is flanked by peripheral lips 1350.

Motor bracket 1326 includes planar member 1354, a lateral pair of generally perpendicular members 1356, and generally perpendicular lower member 1358. Motor bracket 1326 is affixed to top frame 1316. More specifically, one of members 1356 is affixed to surface 1346 and lower member 1358 is affixed to surface 1348.

Retractor bracket 1328 includes horizontal member 1362 and vertical member 1364. Vertical member 1364 extends upwardly and generally transversely from horizontal member 1362. A generally cylindrical or conical element 1365 extends from vertical member 1364 generally toward right clutch bracket 1336. Retractor bracket 1328 is affixed to top frame 1316 slightly to the right and rearwardly from motor bracket 1326. Motor bracket 1326 defines orifices 1366, 1368, 1370 and cutout 1372. Orifice 1366 is defined generally centrally on planar member 1326. Orifice 1368 is defined generally below orifice 1366. One or more smaller orifices 1370 may also be defined within planar member 1354. Generally arcuate cutout 1372 may be defined proximate a central portion of an upper edge of member 1354.

Left clutch bracket 1330 generally includes inboard planar member 1376, outboard planar member 1378 and connecting member 1380. Front edges of inboard planar member 1376 and outboard planar member 1378 are unitary to connecting member 1380 and are joined at a bend in this embodiment. Inboard planar member 1376 defines central orifice 1382 and one or more smaller orifices 1384. Orifices 1384 may be peripherally disposed with respect to central orifice 1382. Outboard planar member 1378 defines opening 1388, cutouts 1390, opening 1392, cutout 1394, and generally rectangular opening 1396. Opening 1388 is generally circular, with four cutouts 1390 extending generally radially therefrom. Opening 1392 is defined above a rear portion of opening 1388. Generally arcuate cutout 1394 is defined proximate an upper edge of outboard planar member 1378. Rectangular opening 1396 is disposed generally centrally, below clutch opening 1388. A plurality of smaller openings 1398, flanking opening 1396, may also be defined by planar member 1378.

Interlock switch bracket 1334 is disposed proximate openings 1344 and affixed to front panel 1322 proximate surface 1346.

Right clutch bracket 1336 generally includes inboard planar member 1400, outboard planar member 1402 and connecting member 1404. Front edges of inboard and outboard planar members 1400, 1402 may be unitarily joined to connecting member 1404 at a bend. Orifices defined within inboard planar member 1400 and outer planar member 1402 are generally similar to those formed or defined by inboard planar member 1376 and outboard planar member 1338. Therefore, these openings are designated by identical numerals.

Motor bracket 1326 is mounted such that planar member 1354 is generally transverse to panels 1322, 1324. Inboard planar members 1376, 1400, outboard planar members 1378, 1402, and vertical member 1364 are disposed generally parallel to planar member 1354 in this embodiment.

Front panel 1322, base panel 1324, motor bracket 1326, retractor bracket 1328, left clutch bracket 1330, interlock switch brackets 1334, and right clutch bracket 1336 may be formed from a 16–18 gauge sheet metal. However, other suitable materials are known to the art.

Also as seen in FIGS. 98, 114, power train 1318 broadly includes motor 1410, motor gear 1412, shaft gear 1414, shaft bearing 1416, shaft 1418, and pluralities of magnetic clutch assemblies 1420, slip plates 1422, and drum assemblies 1424. Motor 1410 includes housing 1430 and motor shaft 1432. Motor shaft 1432 may define a key way (not shown). A generally coaxial bore 1434 is defined in motor gear 1412. Bore 1434 accommodates motor shaft 1432. Gear 1412 may be further affixed to motor shaft 1432 by means of a key (not shown) inserted in the key way. Motor 1410 may be affixed to motor bracket 1326 by fasteners, such as a plurality of screws. When motor 1410 is attached to motor bracket 1326 and motor gear 1412 is mounted on motor shaft 1432, motor shaft 1432 extends through motor orifice 1368 and motor gear 1412 is disposed outboard planar member 1354. When power train 1318 is assembled, shaft 1418 extends through orifices 1366, 1382, and 1388.

Shaft gear 1414 may be mounted on shaft 1418 in a similar manner as motor gear 1412 is mounted on motor shaft 1432. Shaft gear 1414 may further be disposed on shaft 1418 such that shaft gear 1414 meshes with motor gear 1412. Shaft 1418 extends through shaft bearing 1416 when power train 1318 is assembled. Shaft bearing 1416 may be further affixed to planar member 1354 by fasteners, such as a plurality of screws 1433. In one embodiment, gears 1412, 1414 respectively possess thirty-sixty and forty teeth. Gears 1412, 1414 may be formed from such materials as steel, cast iron, as well as from other materials known to the art. Shaft 1418 may be formed from similar materials as gears 1412, 1414. In this embodiment, motor 1410 is a permanent magnet, parallel shaft, DC brush gear motor, operating at 12 volts DC and generating approximately ⅛ hp. Also in this embodiment, motor 1410 rotates motor shaft 1432 at an output speed of between about 25 and 75 rpm and attains an output torque range of between approximately 300 in-lbs at 25 rpm and 100 in-lbs at 75 rpm. Motor 1410 may be approximately 10" (±0.5") long, 5" (±0.5") high, and 4" (±0.5") wide. An exemplary motor may be obtained from Byson Gear and Engineering Corporation, Downers Grove, Ill.

Each magnetic clutch assembly 1420 includes disk 1436 and cylindrical housing 1438. A generally coaxial bore 1440 extends through magnetic clutch assembly 1420. In this embodiment, bore 1440 has a ½" diameter and disk 1436 has a diameter of approximately 4.9" (±0.5"). Cylindrical housing 1438 has a diameter of approximately 4.2" (±0.5") and a height of approximately 1.8" (±0.5"). An exemplary magnetic clutch develops a torque of 22 lb-ft, and attains a coil power of 28 watts, an armature hub inertia of $161\times10^{-4}$ lb-ft$^2$, a rotor inertia of about $172\times10^{-4}$ lb-ft$^2$, and generates 3 hp at 1800 rpm. Disk 1436 may be mounted to an outboard surface of inboard planar member 1376 by fasteners, such as a plurality of screws. When magnetic clutch assembly 1420 is mounted to inboard member 1376, cylindrical housing 1438 extends through opening 1388. Magnetic clutch assembly 1420 is mounted such that shaft 1418 extends generally coaxially through bore 1440. Shaft 1418 and magnetic clutch 1420 may be affixed by a key-key way combination (not shown). Each slip plate 1422 defines bore 1466, a plurality of peripheral holes 1446, and presents an inboard surface 1444.

Each exemplary drum assembly 1424 includes cylindrical member 1450. Four threaded extensions 1452 may extend peripherally from cylindrical member 1450. Disk 1454 may be unitarily joined to cylindrical member 1450. Disk 1454 presents an outboard surface 1455 and defines a threaded aperture 1456. Cylindrical member 1457 coaxially extends from outboard surface 1455. Outboard disk 1458 extends generally coaxially and radially from the outboard terminus of cylindrical member 1457. Outboard disk 1458 defines an aperture 1460 and presents an outboard surface 1462. Aperture 1460 is generally aligned with threaded aperture 1456 in this embodiment.

Also in this embodiment, a fastener such as a screw extends through each aperture 1446 and is threadably disposed within each threaded extension 1452. Screw 1464 is extended through aperture 1460 and is threadably received within threaded aperture 1456 as will be discussed below. Bores 1466, 1468 are coaxially formed within slip plate 1422 and drum assembly 1424, respectively, such that shaft 1418 is received within bores 1466, 1468. Drag cap spring 1470 is compressibly held in place by drag cap 1472 cooperating with a fastener such as a screw. If a screw is used, the screw is threadably received within an aperture proximate a terminus of shaft 1418.

As seen in FIGS. 96, 98, upper shield assembly 1320 includes upper shield 1478 and respective left, and right end caps 1480, 1482. Upper shield 1478, in turn, includes front panel 1486, upper panel 1488, and rear panel 1490. Front panel 1486 includes conical protrusion 1492. Respective planar members 1493, 1494 flank protrusion 1492 and present an interior surface 1496. Lower lip 1498 extends generally transversely from interior surface 1496, proximate a lower edge thereof. In this embodiment, upper panel 1488 includes planar member 1502 and presents upper surface 1504. Planar member 1502, in turn, defines switch aperture 1506, on-off light aperture 1508, and charge light aperture 1510. Apertures 1506–1510 are generally and centrally aligned transverse a longitudinal axis of planar member 1502. Rear panel 1490 includes respective left and right planar members 1514, 1516. Conical protrusion 1518 unitarily extends from, and is flanked by, left and right planar members 1514, 1516. An upper edge of rear panel 1490 unitarily joins a rear edge of upper panel 1488 at a bend. Upper and rear panels 1488, 1490 cooperate in defining remote aperture 1522. Remote aperture 1522 generally aligns with apertures 1506–1510 and extends downwardly into a portion of conical protrusion 1518.

Another lower lip (not shown) protrudes from an interior surface of rear panel 1490 in a similar manner as lower lip 1498. Extending from respective left and right edges of panels 1486–1490 are left and right peripheral extensions 1524, 1526, respectively. Extensions 1524, 1526 are formed by inward recesses from the exterior edges of panels 1486–1490.

Respective left and right end caps 1480, 1482 are essentially mirror images in this embodiment. Hence, they will be described with like-numbered elements. Each end cap 1480, 1482 includes an outboard member 1530, an upper member 1532 and a rear member 1534. Outboard member 1530 is generally arcuate in cross-section. Upper member 1532 further includes generally planar member 1536 and generally conical element 1538. Element 1538 extends above a forward portion of planar member 1536. Lip 1540 extends forward from a lower edge of rear member 1534.

Referring to FIGS. 98, 114–120, hook and web assembly 1310 includes web 1550 and transfer hook 1552. First and second loops 1556, 1558 are formed within web 1550 by stitching 1560. In this embodiment, transfer hook 1552 is a unitary structure, which includes strap retaining member 1564 and hook member 1566. Strap retaining member 1564, in turn, displays exterior surface 1565 and defines a generally cylindrical bore 1568. A slot 1570 is further defined in a lower portion of strap retaining member 1564. Extending from strap retaining member 1564 is flange 1572. Flange 1572 displays lower surface 1573. Hook member 1566 extends from an upper portion of strap retaining member 1564. Hook member 1566 may be envisioned as including planar member 1574, arcuate member 1575, and terminal lip 1576. Planar member 1574 extends from strap retaining member 1564. Arcuate member 1575 extends from planar member 1574. Terminal lip 1576 extends from arcuate member 1575 toward strap retaining member 1564. Planar member 1574, arcuate member 1575 and terminal lip 1576 display respective exterior surfaces 1577, 1579, 1581 and interior surfaces 1578, 1580, 1582. Terminal lip 1576 displays tip 1583. Viewed cross-sectionally in FIG. 120, lines 1584, 1585 represent sites on interior surfaces 1565, 1580. Plane 1587 extends through point 1585 and is generally perpendicular to surfaces 1578, 1582. Planes 1588, 1589 extend through tip 1583 and line 1584 and are generally parallel to plane 1587. Plane 1590 extends from surface 1578 and plane 1591 extends from surface 1582. Gap 1592 is the distance between planes 1587, 1588; gap 1593 is the distance between planes 1588, 1589; and gap 1594 is the distance between planes 1590, 1591. Plane 1600 extends from surface 1577. Plane 1601 extends from surface 1573 and is generally perpendicular to plane 1600. Plane 1605 extends tangentially from the tip of flange 1572 and is generally perpendicular to planes 1600, 1601. Gap 1607 is the distance between planes 1587, 1595. Plane 1595 is generally perpendicular to surface 1577 and extends through a center of bore 1568. Plane 1596 extends through the center of bore 1568 and bisects slot 1570. Angle 1597 is formed by the intersection of planes 1595, 1596.

Exemplary transfer hook 1552 is about 4.03" (±0.05") in length and about 1.50" (±0.05") wide. Flange 1572 and members 1574, 1576 may be respectively about 0.25" (±0.05") and 0.325" (±0.05") in thickness. Strap retaining member 1564 may be about 0.25" (±0.05") thick, but may be thicker proximate planar member 1574. Respective gaps 1592, 1593, 1594, 1586, 1607 may be about 1.00" (±0.05"), 1.50" (±0.05"), 0.75" (±0.05"), 2.75" (±0.05"), 1.03" (±0.05"). Bore 1568 may be about 0.42" (±0.05") in diameter. Slot 1570 may be about 0.23" (±0.05") wide. Angles 1596, 1603 may be about 20° (±10°) and 80° (±20°), respectively. Both terminal lip 1576 and flange 1572 may be rounded. If so, the edges of terminal lip 1576 may be rounded to a radius of about 0.50" (±0.05") and flange 1572 may be rounded to a radius of about 0.80" (±0.05"). In this embodiment, transfer hook 1552 is made from extruded aluminum.

Webbing 1550 connects to transfer hook 1554 by means of joint connector bolt 1598 and joint connector 1599. Joint connector 1599 disposes within loop 1558. Joint connector 1599 and loop 1558 are placed within bore 1568. Webbing 1550 is extended through slot 1570. To secure the attachment of webbing 1550 to transfer hook 1552, joint connector bolt 1598 is threadably received onto joint connector 1599. Dimensionally, exemplary web 1550 is about 60" in length and about 1.50" in width. However, it should be appreciated that the dimensions of web 1550 may be altered as necessary. Web 1550 may include materials suitable for automobile seat belts.

Figure 117:
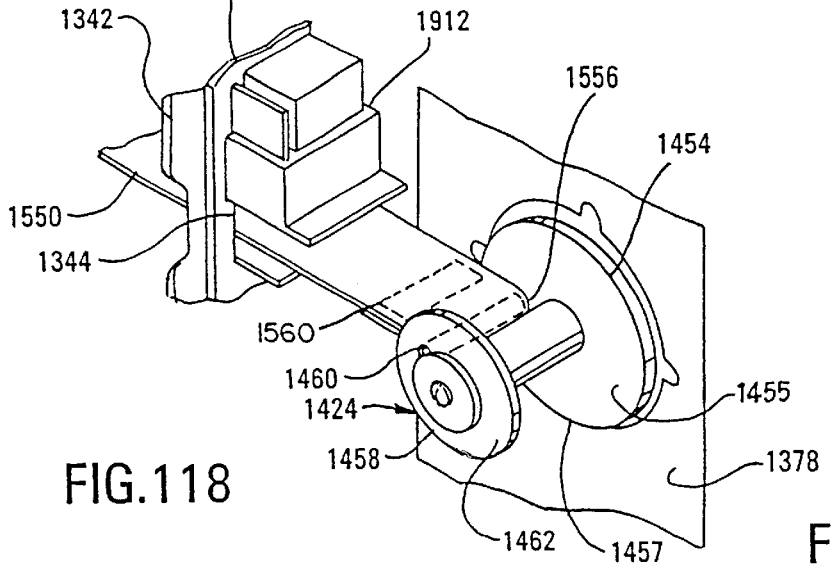
FIG. 117 is a fragmentary elevated perspective view of the webbing attached to the drum of the head assembly and extending through a slot therefor in the top frame and upper shield and further depicting an interlock switch in place thereto.
Figure 118:
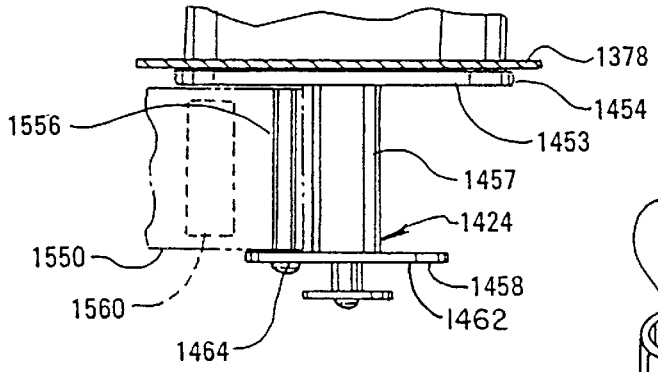
FIG. 118 is a top plan view of a webbing attached to the drum of the transfer system of FIG. 96.
Figure 119:
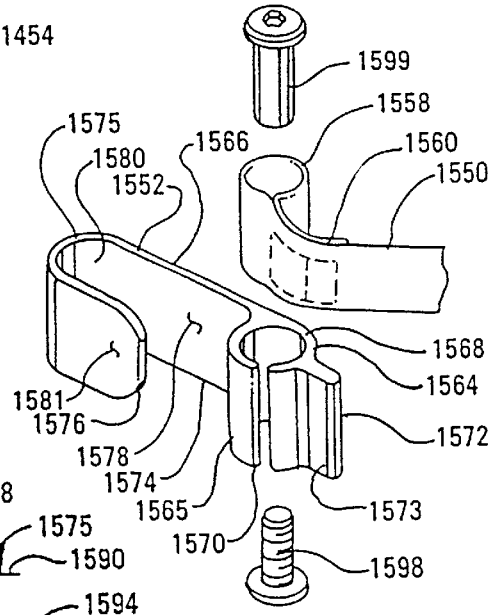
FIG. 119 is a fragmentary elevated perspective view of the transfer hook, joint connector, and webbing of the present invention.
Figure 120:
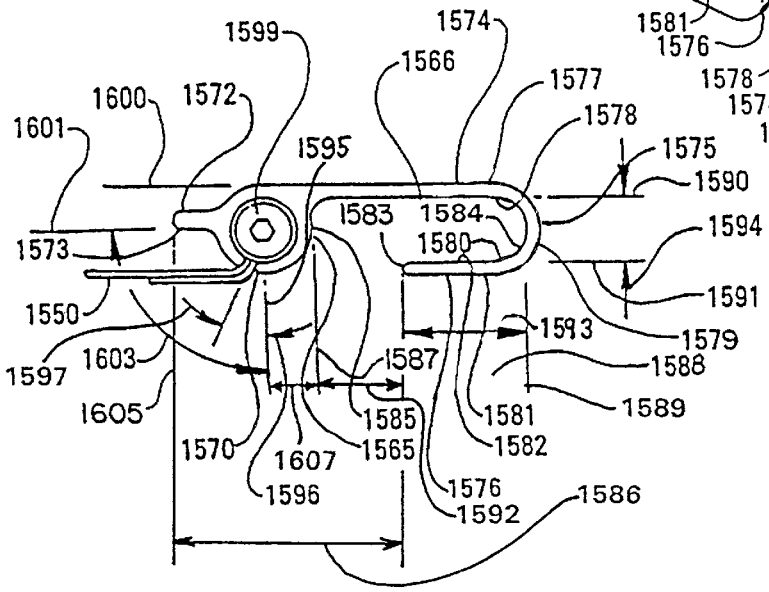
FIG. 120 is a side plan view of the hook, joint connector, and webbing of FIG. 119.

Hook and web assembly 1310 is installed onto drum assembly 1424 as depicted in FIGS. 117, 118. First loop 1556 is extended through opening 1344. First loop 1556 is then aligned with apertures 1456, 1460 (FIG. 98). Screw 1464 is passed through aperture 1460 and first loop 1556, then threadably received within aperture 1456.

Figure 99:
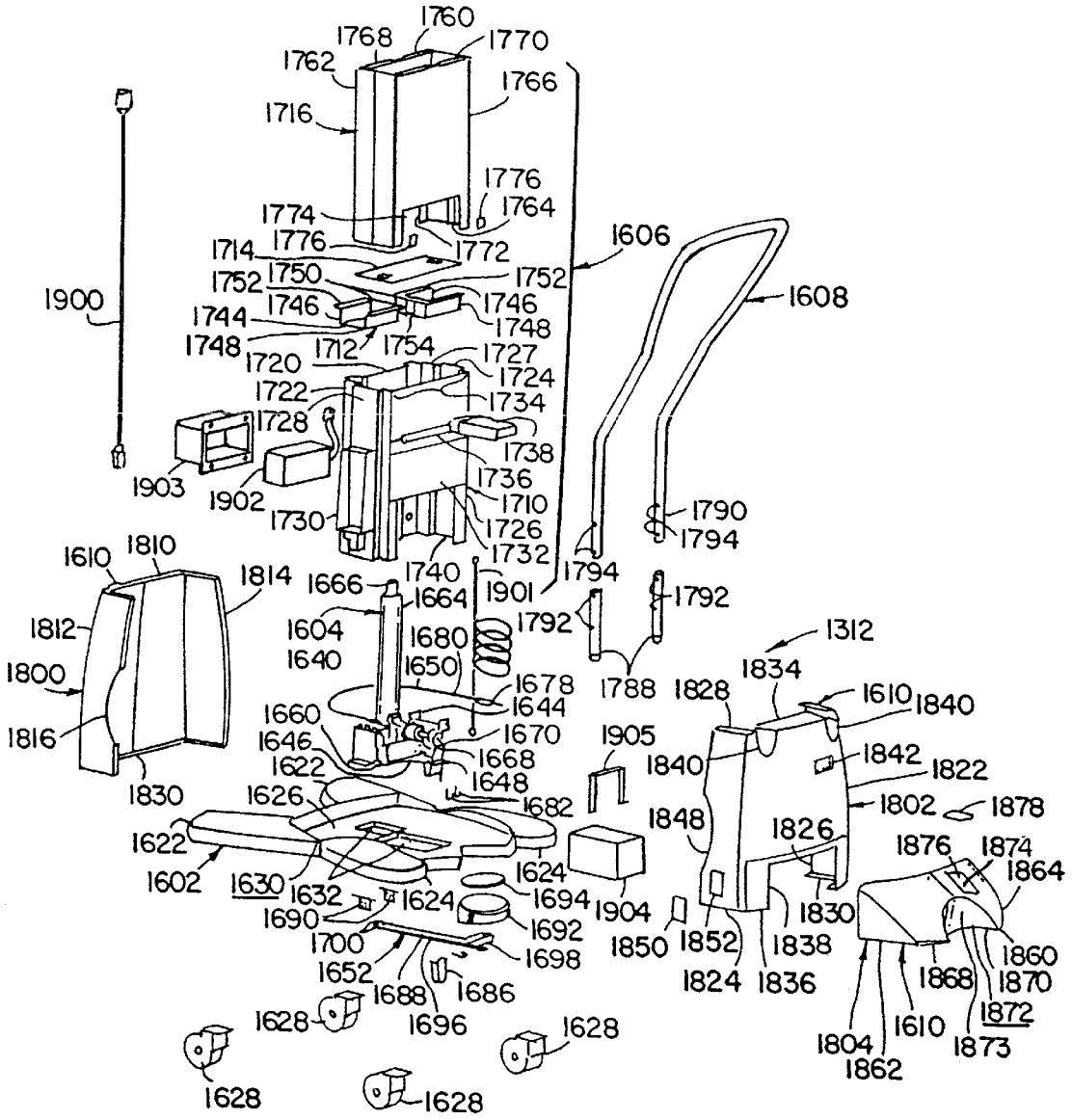
FIG. 99 is an exploded view of the base assembly thereof.

Exemplary base assembly 1312 is depicted in FIG. 99 and broadly includes leg assembly 1602, vertical adjusting means such as actuator assembly 1604, trunk and skirt assembly 1606, handle assembly 1608, and base shield assembly 1610. Leg assembly 1602, in turn, includes two front legs or bumpers 1622 and two rear legs or bumpers 1624 unitarily extending from central portion 1626. A caster 1628 is attached to a lower surface of each bumper 1622, 1624. Central portion 1626 may display a generally planar surface 1630 which is recessed downwardly from bumpers 1622, 1624. Central portion 1626 further defines a plurality of recessed portions 1632, used as discussed below.

Figure 121:
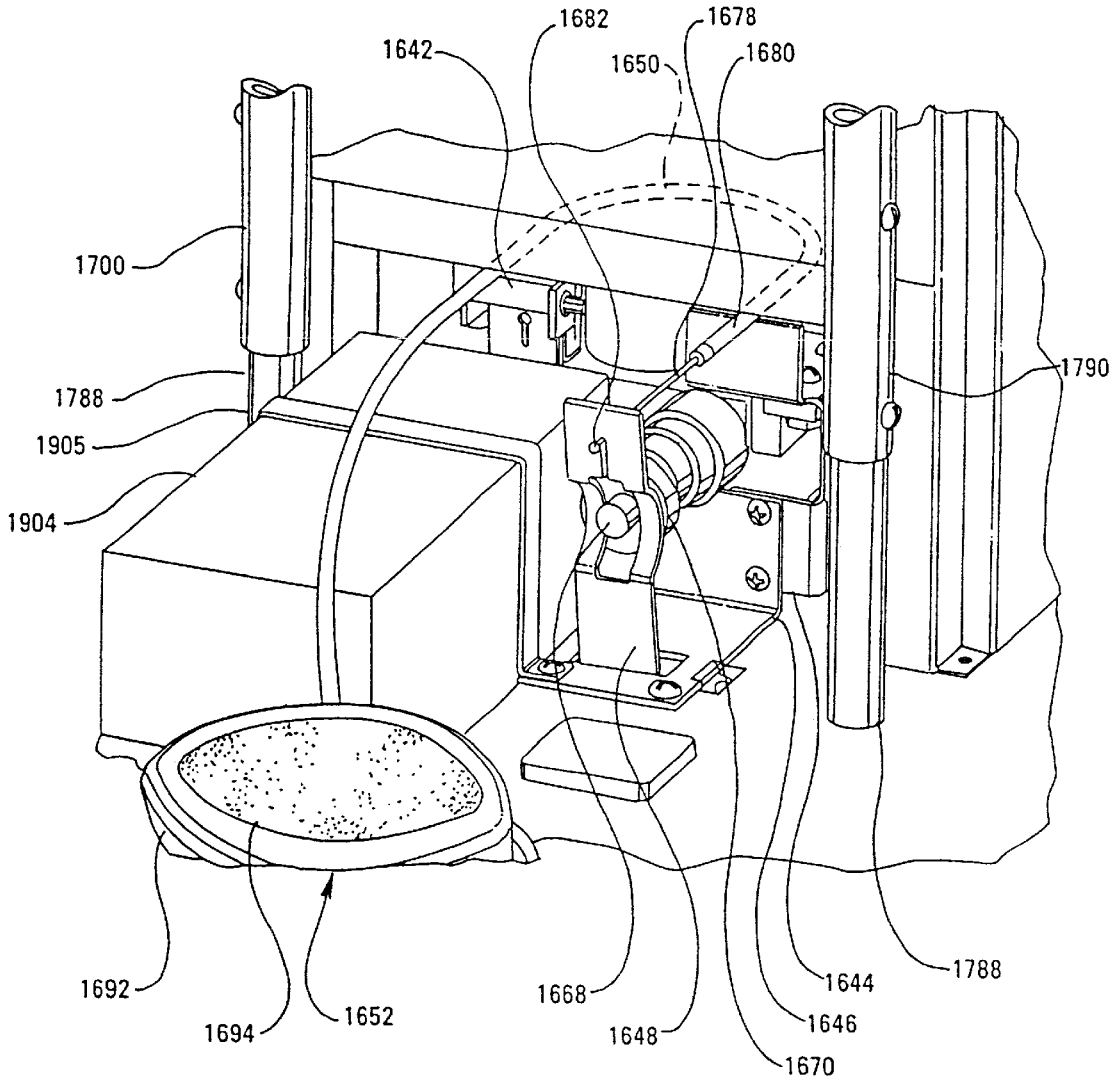
FIG. 121 is a fragmentary elevated right perspective view of the base assembly of the present invention depicting attachment of the cable to the peddle and actuator assembly thereof.
Figure 122:
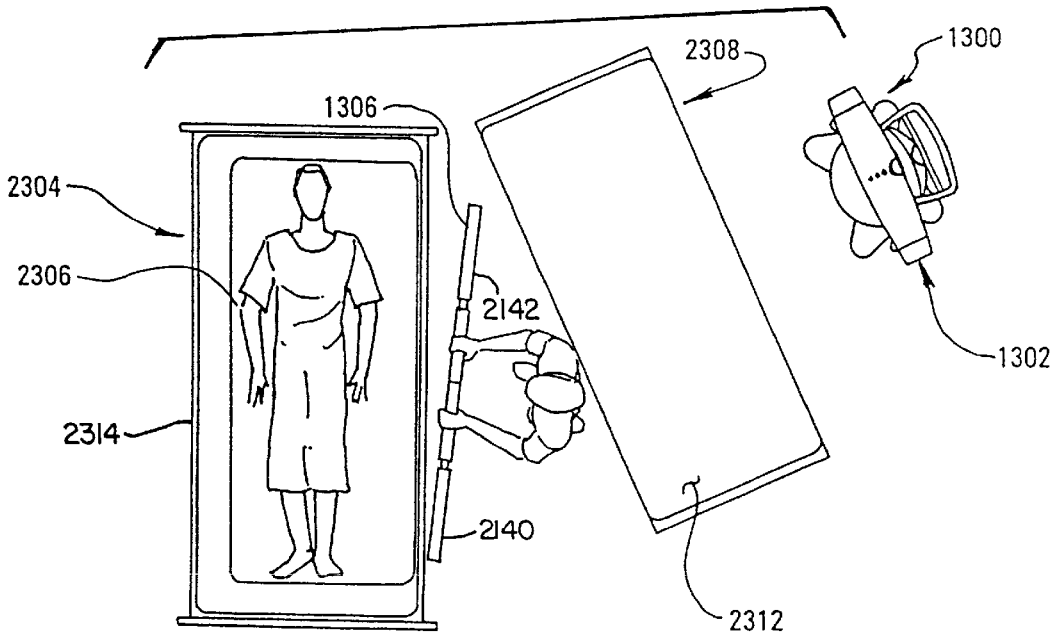
Figure 123:
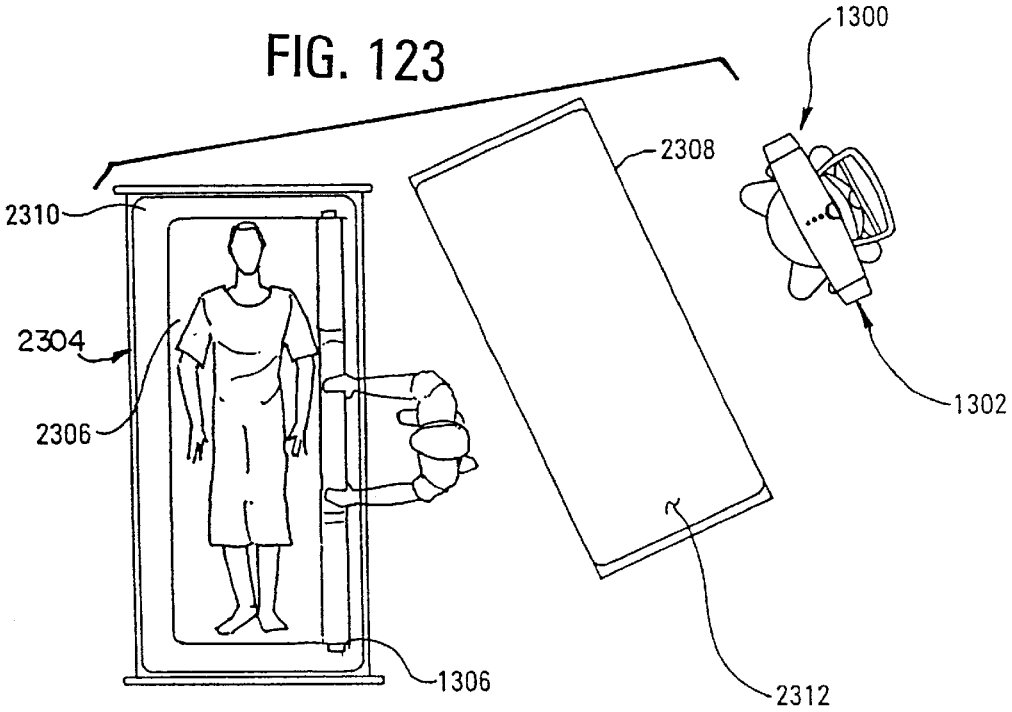
Figure 124:
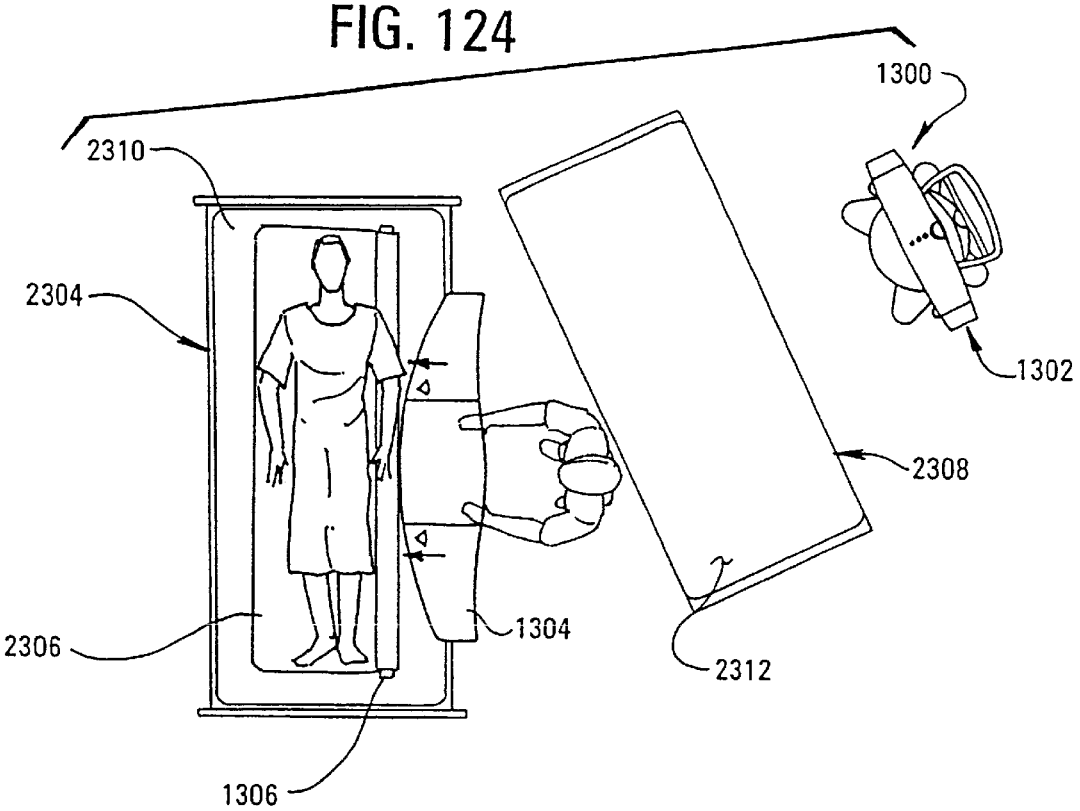
Figure 125:
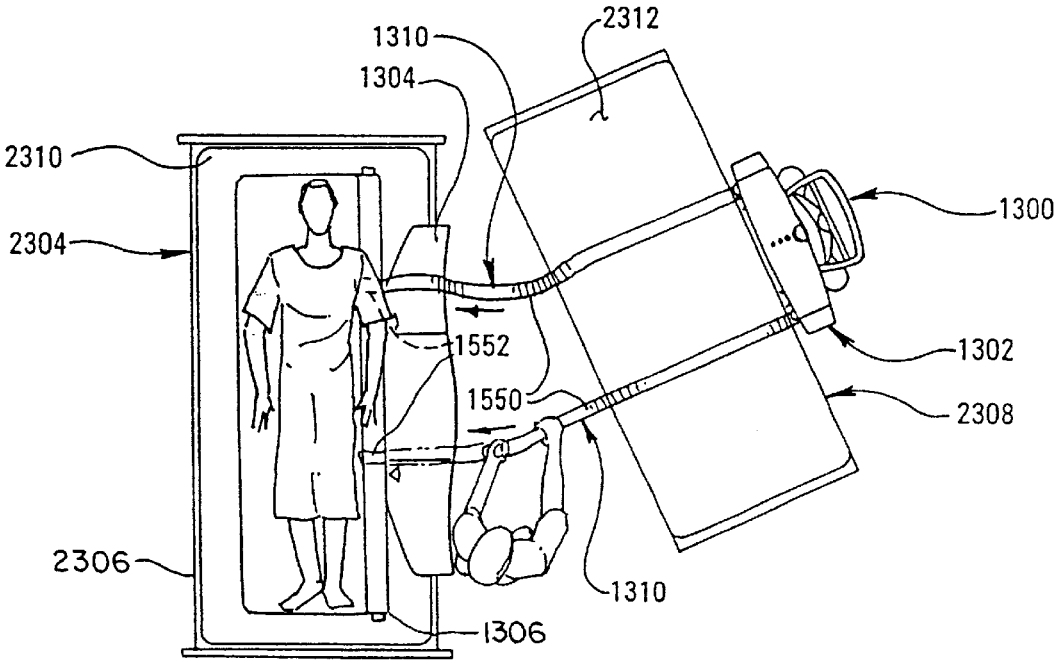
Figure 126:
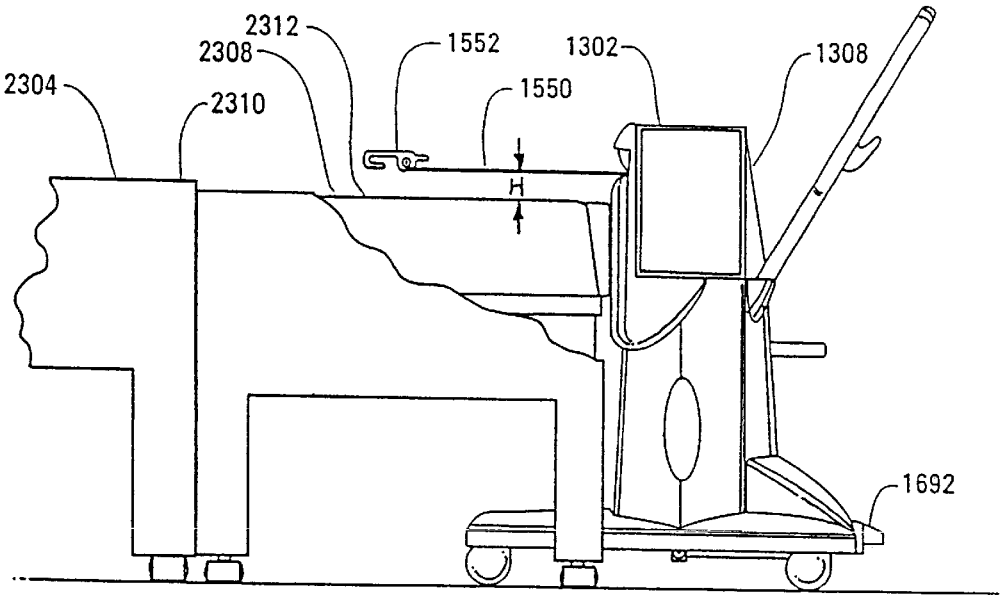
Figure 128:
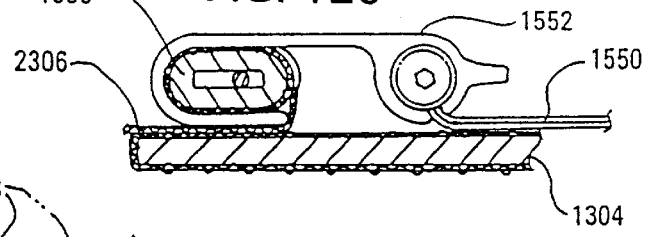
Figure 127:
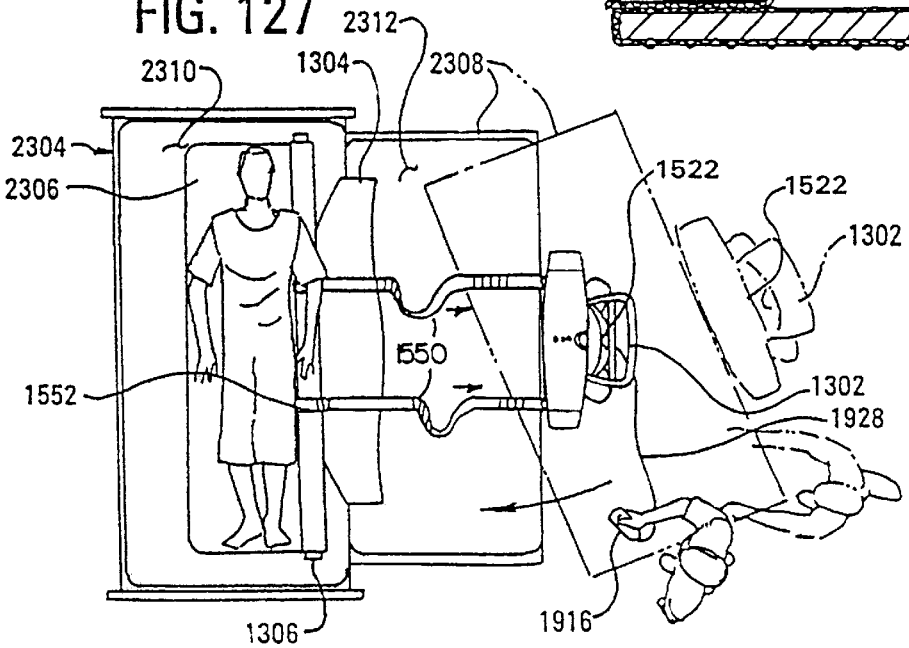
Figure 129:
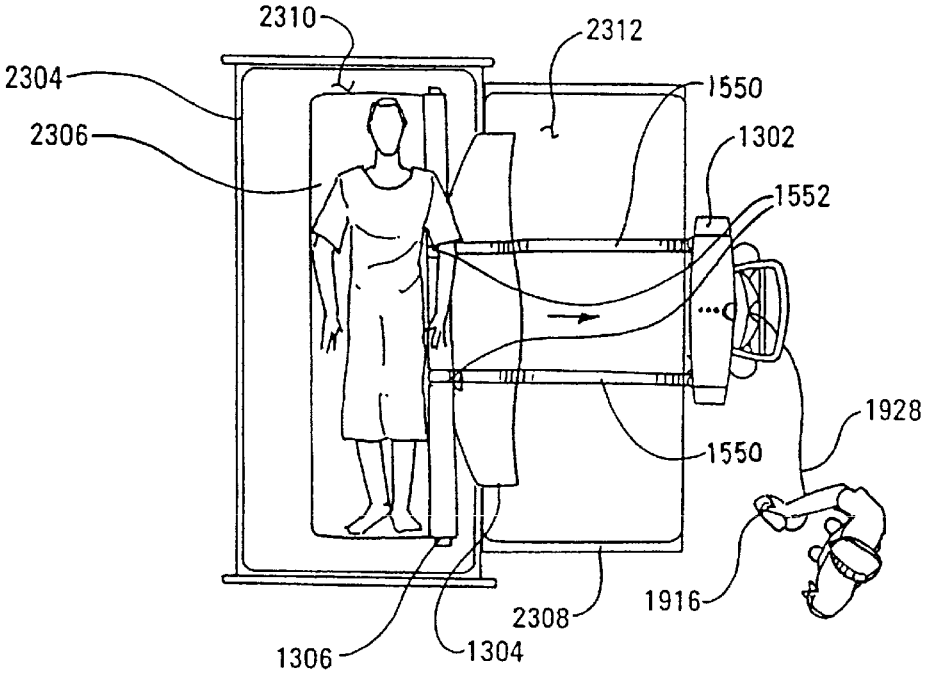
Figure 130:
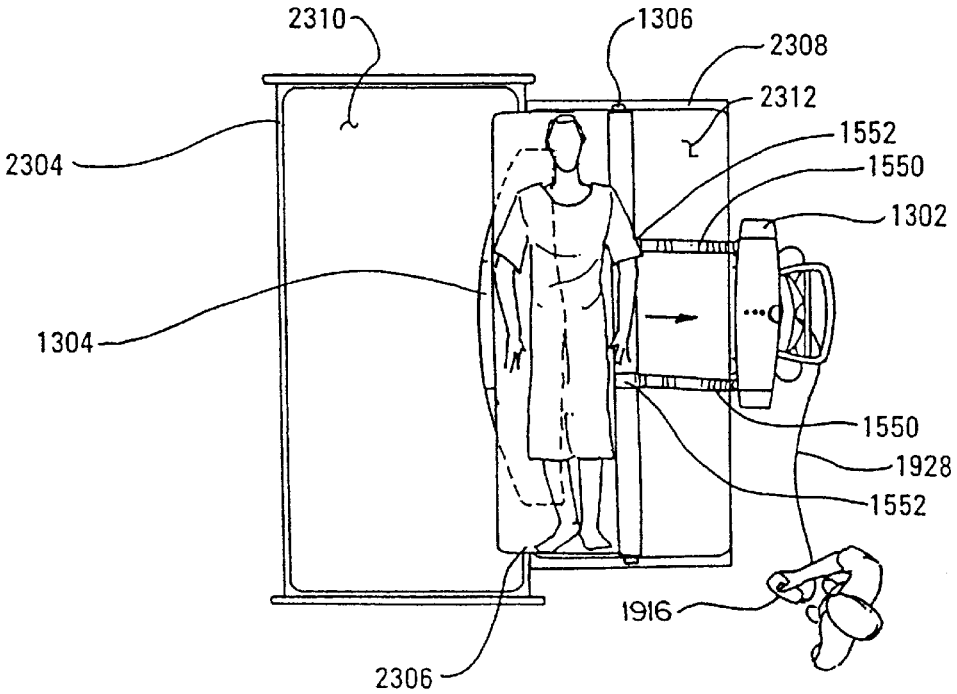
Figure 131:
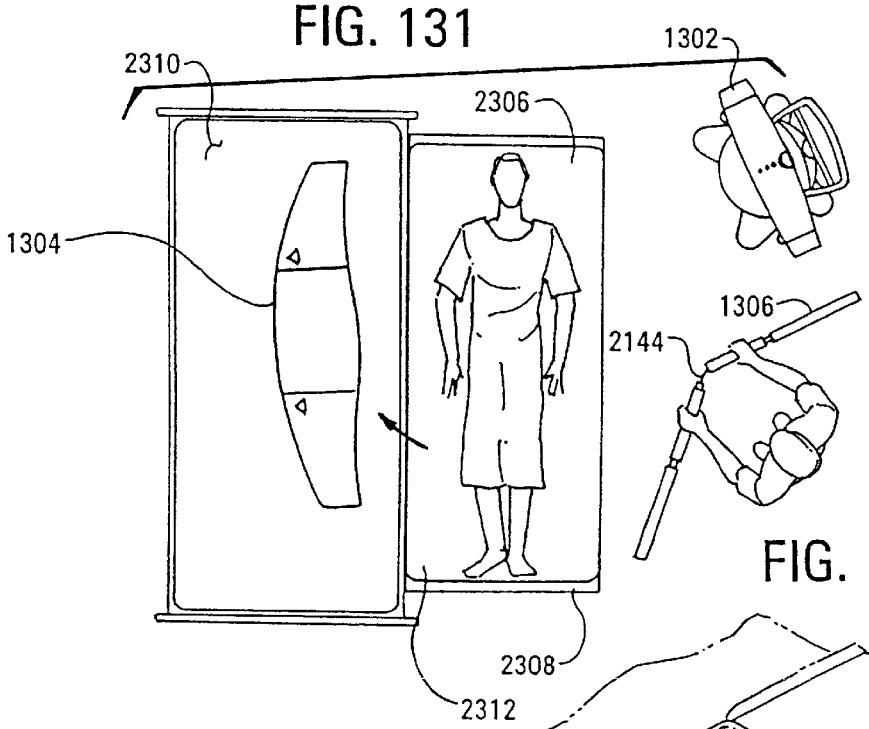

Exemplary actuator assembly 1604 is shown in FIGS. 99, 121 and includes actuator 1640, left actuator support 1642, right actuator support 1644, plunger bracket 1646, plunger pivot arm 1648, actuator cable 1650, and foot pedal assembly 1652. Actuator 1640, in turn, includes base member 1660, actuator body 1664, actuator piston 1666, actuator pump piston 1668, and disk 1670. Actuator body 1664 extends generally transversely from generally horizontal base 1660. The portion of actuator body above base 1660 is generally cylindrical. The portion of actuator body 1664 proximate base 1660 houses a hydraulic reservoir and pump. Actuator piston 1666 is slidingly and coaxially disposed within an upper portion of actuator body 1664. Pump piston 1668 extends from base 1660 generally transversely to actuator body 1664. Disk 1670 is fixed to pump piston 1668 a distance away from a terminus of pump piston 1668. Actuator cable 1650 includes a stiff, flexible wire element 1678 slidingly disposed within jacket 1680. Further included are a plurality of fastening devices, such as ferrules 1682.

Exemplary foot pedal assembly 1652 includes pedal bracket 1686, a plurality of pedal levers 1688, pedal pivot bearings 1690, foot pedal 1692, and foot pedal pad 1694. Pedal lever 1688, in turn, includes lever portion 1696, pedal mounting bracket 1698, and bearing mounting bracket 1700. Pedal mounting bracket 1698 is disposed generally transversely to lever portion 1698 at a first end thereof. Bearing mounting bracket 1700 extends generally transversely from a second end of lever portion 1698. Pedal bracket 1686 attaches to a lower surface of central portion 1626. Pedal lever 1688 is disposed within pedal bracket 1686. Each extension of bearing mounting bracket 1700 is disposed within a pedal pivot bearing 1690. Each pedal pivot bearing 1690 is affixed to a lower surface of central portion 1626. Foot pedal 1692, in turn, is affixed to an upper surface of pedal mounting bracket 1698. Foot pedal pad 1694 is then disposed atop an upper surface of foot pedal 1692.

Referring to FIG. 99, exemplary trunk and skirt assembly 1606 includes trunk 1710, two hat sections 1712, skirt plate 1714, and skirt 1716. Trunk 1710, in turn, includes front panel 1720, left side panel 1722, right side panel 1724, and rear panel 1726. Front panel 1720 is a generally planar member. Left side panel 1722 and right side panel 1724 extend generally transversely from lateral edges of front panel 1720 and include a extended portions 1728, 1729. Extended portions 1728, 1729 are generally rectangular in cross-section. Cord pocket 1730 is attached to an exterior surface of extended portion 1728. Rear panel 1726 extends from rear edges of left and right side panels 1722, 1724. Rear panel 1726 includes planar member 1732. Flange 1734 extends outwardly from an upper edge of planar member 1732. Another flange 1736 extends from an exterior surface of planar member 1732. Bracket 1738 extends rearwardly proximate a right edge of flange 1736. In this embodiment, bracket 1738 is disposed generally transverse to planar member 1732. Cutout 1740 is defined in a lower portion of rear panel 1726 in this embodiment. A cutout may also be defined in a corresponding location of front panel 1720.

Each exemplary hat section 1712 includes base member 1744, front vertical member 1746, rear vertical member 1748, and inboard vertical member 1750. Front, rear and inboard vertical members 1746–1750 extend generally transversely from base member 1744 and join base member 1744 at a bend. A peripheral flange 1752 extends generally transversely from an upper edge of each of vertical members 1746–1750. Inboard vertical member 1750 and an adjoining portion of base member 1744 cooperate to define an inwardly curved surface 1754. Generally planar top skirt plate 1714 coextends with a mated pair of hat sections 1712 when trunk and skirt assembly 1608 is assembled.

Skirt 1716 includes front panel 1760, left side panel 1762, right side panel 1764, and rear panel 1766. Panels 1760–1766 are generally planar. Front flange 1768 and rear flange 1770 extend inwardly from top edges of front panel 1760 and rear panel 1766, respectively. Front panel 1760 and rear panel 1766 further and respectively define cutouts 1772, 1774 on lower-most portions thereof. A multiplicity of wear strips 1776 may be attached to exterior surfaces of panels 1760–1766. In this embodiment, a wear strip 1776 is attached to lower portions of front and rear panels 1762, 1766, proximate cutouts 1772, 1774.

Actuator assembly 1604 and trunk and skirt assembly 1606 are assembled in a cooperative relationship as depicted in FIGS. 99, 121. Left and right actuator supports 1642, 1644 are mated to actuator 1640 and then accommodated in one of recessed portions 1632 within central portion 1626. Left and right actuator supports 1642, 1644 are then affixed to central portion 1626 by threading screws into pre-drilled and pre-threaded holes therefor. Plunger pivot arm 1648 is then seated and pivotally affixed to a recessed portion 1632 on an upper surface of central portion 1626. A portion of pump piston 1668, disposed distally to disk 670, is then mounted to an upper portion of plunger bracket 1646 by being disposed through a slot (not shown) defined therein. One end of wire 1678 is extended through an upper slot defined in plunger bracket 1646. One of ferrules 1682 is then affixed to the end of wire 1678. Trunk 1710 is then lowered into place atop central portion 1626. Two hat sections 1712 are mated around actuator piston 1666 and affixed thereto by fastening means, such as a plurality of bolts threadably mated to nuts. Top skirt plate 1714 is then affixed to mated hat sections 1712 by fasteners such as screws or bolts through predrilled holes within top skirt plate 1714 and peripheral flanges 1752. Top skirt plate 1714 and attached hat sections 1712 are affixed to lower surfaces of flanges 1768, 1770 by such means as screws or bolts. The unattached end of wire 1768 is attached to pedal lever 1688 proximate pedal mounting bracket 1698 and secured thereto by a ferrule 1682.

As also shown in FIGS. 99, 121, handle assembly 1608 includes a plurality of handle supports 1788 and handle 1790. Respective holes 1792, 1794 are defined in handle supports 1788 and handle 1790. A first end of each handle support 1788 is accommodated in a recessed portion 1632 within central portion 1626 and affixed thereto. The free ends of handle 1790 then telescopically fit over exposed second ends of each handle support 1788. Handle 1790 is then affixed to each handle support 1788 by such means as bolts or pins extending through holes 1788, 1790.

Exemplary base shield assembly 1610 broadly includes front base shield 1800, rear base shield 1802, and battery cover 1804. Front base shield 1800, in turn, includes front panel 1810, left side panel 1812, and right side panel 1814. Left and right side panels 1812, 1814 extend generally perpendicularly from lateral edges of front panel 1810. Left side panel 1812 defines arcuate cutout 1816 proximate a rear edge thereof.

Exemplary rear base shield 1802, in turn, includes rear panel 1822 and left and right panels 1824, 1826. Rear panel 1822 is generally outwardly curved in cross-section. Flange 1834 extends from an upper edge of rear panel 1822. A lower portion of rear panel 1822 defines recessed portion 1836. Recessed portion 1836, in turn, defines cutout 1838 centrally proximate a lower edge thereof. A pair of laterally disposed handle moldings 1840 are formed proximate an upper and each lateral edge of rear panel 1822. Rear panel 1822 defines bracket slot 1842. Bracket slot 1842 is disposed such that bracket 1738 will extend therethrough when rear panel 1822 is in place. Left and right panels 1824, 1826 extend respectively from left and right edges of rear panel 1822. Left panel 1824 defines cutout 1848 proximate a front edge thereof and coordinate with cutout 1816 defined on left side panel 1812. Label 1850 may be affixed to a predetermined portion 1852 of left panel 1824 in this embodiment. Label 1850 may display such indicia as operating and safety instructions.

Recessed edge 1828 extends from upper surfaces of panels 1810–1814 and 1822–1826. A flange 1830 extends generally perpendicularly from lower edges of panels 1810–1814 and panels 1822–1826.

Exemplary battery cover 1804 is unitary in this embodiment and includes rear panel 1860 and left and right panels 1862, 1864. Rear panel 1860 may be envisioned as including left and right lobes 1868, 1870. Curved surface 1872 presents vertical wall 1873. Both curved surface 1872 and vertical wall 1873 are defined by lobes 1868, 1870. In this embodiment, four generally vertical walls 1876 extend downwardly from rear panel 1860 to form pocket 1874 in an upper portion of right lobe 1870. When battery cover 1804 is in place, plate 1878 is affixed to the bottom of pocket 1874. Left and right panels 1862, 1864 extend generally perpendicularly from lateral edges of rear panel 1860. Also when battery cover 1804 is in place, forward edges of left and right panels 1862, 1864 are proximate lateral edges of recessed area 1836.

Referring to FIGS. 98, 99, 134, the components of exemplary electrical and switching system 1314 broadly include charger 1902, battery 1904, AC sensor 1906, logic board 1908, interlock switches 1910, proximity switches 1912, remote coil assembly 1914, remote switch 1916, hour meter 1918, and panel 1920. Charger 1902, in this embodiment, receives AC current via power cable 1900 and converts the AC current to DC current for charging battery 1904 via power cable 1901. Charger 1902 is protected by cover 1903. Input ratings for charger 1902 may include 90–264 VAC, line frequencies of 47–63 Hz, and currents between 0.80 A–0.35 A. Output ratings for charger 1902 may include, an initial charge voltage of 14.7 VDC, an end of charge voltage of 13.80 VDC, a current of 2.0 A, and a switchover current of 160 mA. Battery 1904 receives DC current from charger 1902 to operate the electrical components of transfer caddy 1302. Battery 1904 is held in place by bracket 1905. In this embodiment, battery 1904 is a rechargeable sealed lead acid battery with an output rating of 12 V and a nominal capacity of 12 Amp-hours or more. Also in this embodiment, AC sensor 1906 senses whether charger 1902 is plugged into 110 VAC or 220 VAC. This sensing is relayed to logic board 1908. A pair of interlock switches 1910 are present as indicated in FIGS. 98, 114. In this embodiment, proximity switches 1910 are affixed to base panel 1324, proximate left and right end caps 1480, 1482. Proximity switches 1910 disable electrical and switching system 1314 when either left or right end caps 1480, 1482 are not in place.

Figure 115:
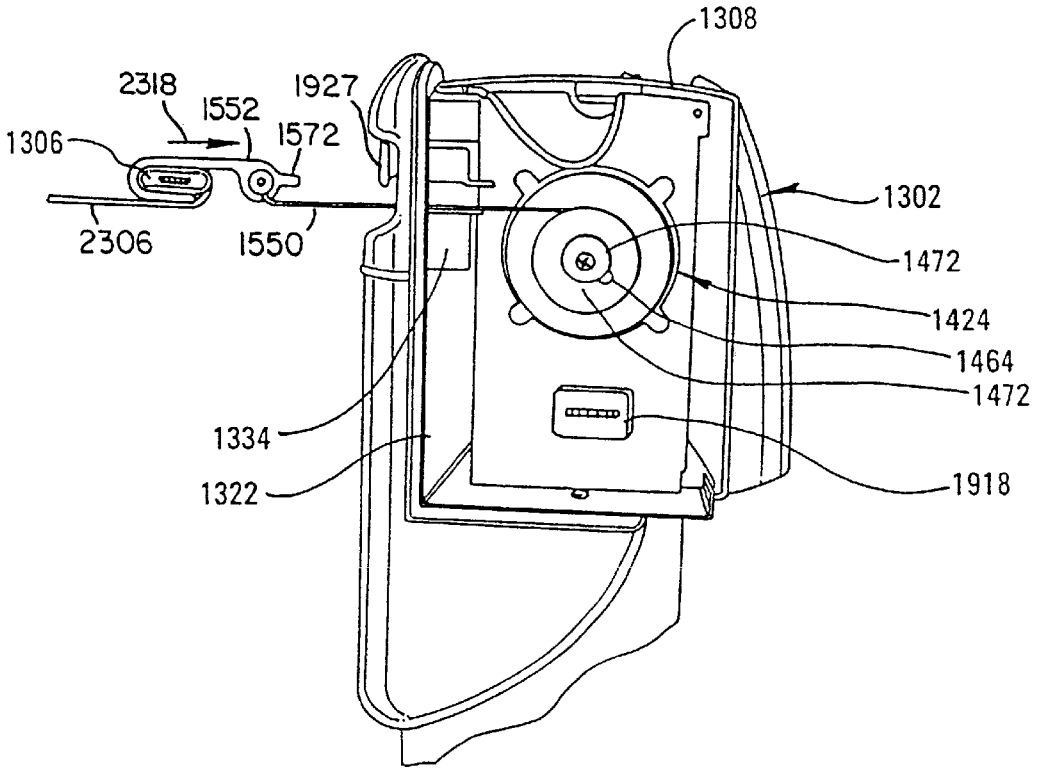
FIG. 115 is a fragmentary side view of the head assembly of the lateral patient transfer system depicting a patient transfer in progress.
Figure 116:
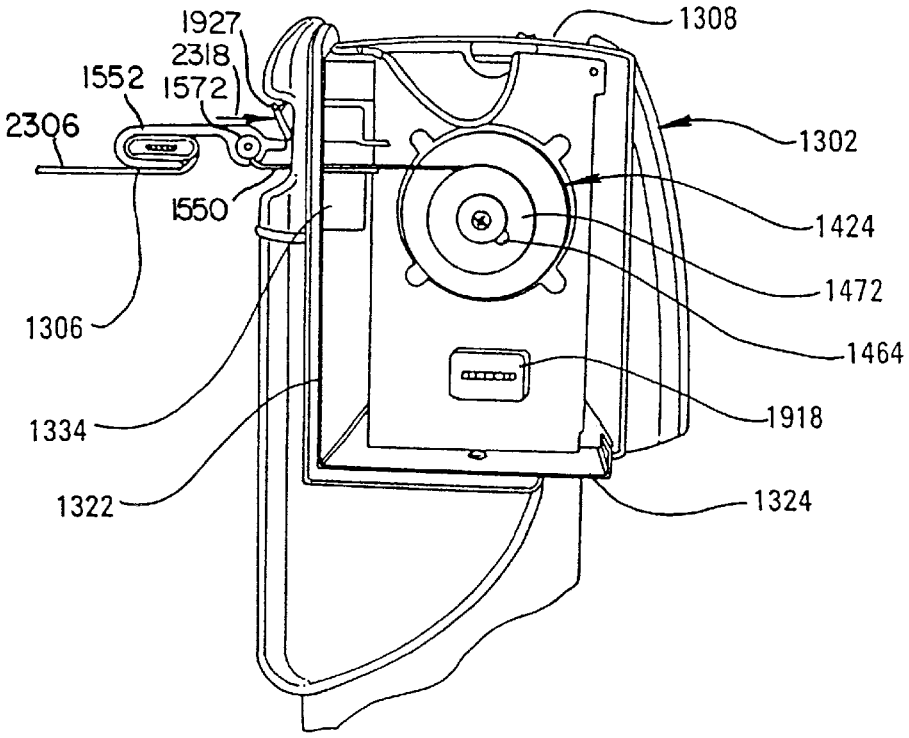
FIG. 116 is a fragmentary side plan view of the patient transfer system depicting completion of a patient transfer event.

As may be seen in FIGS. 115–116, 134, another pair of proximity switches 1912 are disposed proximate each interlock switch bracket 1334. Each proximity switch pair 1912 includes a pair of single switches 1926 and pivot 1927. Each single switch 1926 within switch pair 1912 operates from a separate circuitry. Switches 1926 are actuated by pivot 1927. Exemplary remote coil assembly 1914 feeds out or retracts cable 1928.

Figure 100:
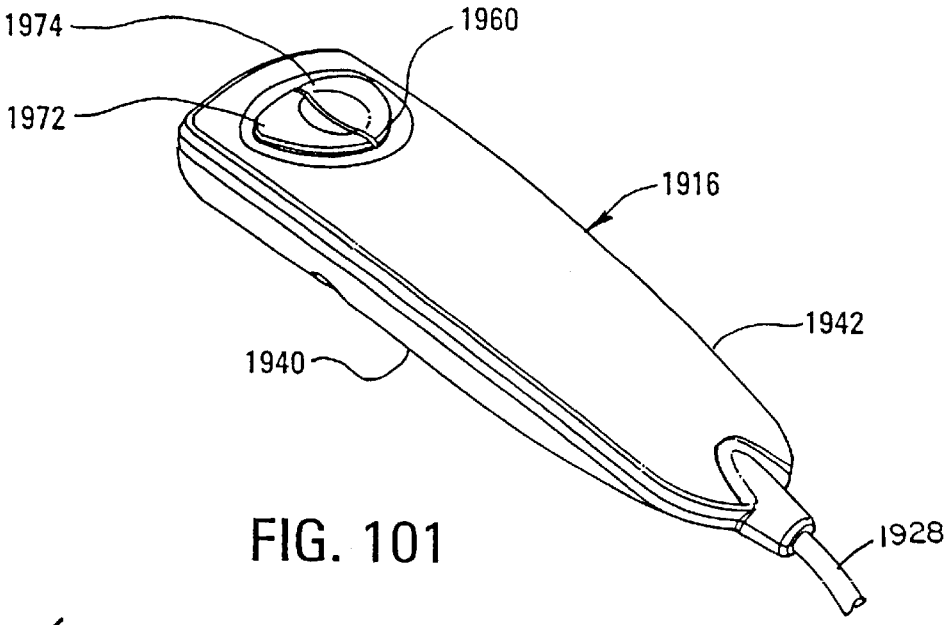
FIG. 100 is a left elevated perspective view of the remote switch of the patient transfer system of FIG. 96.
Figure 101:
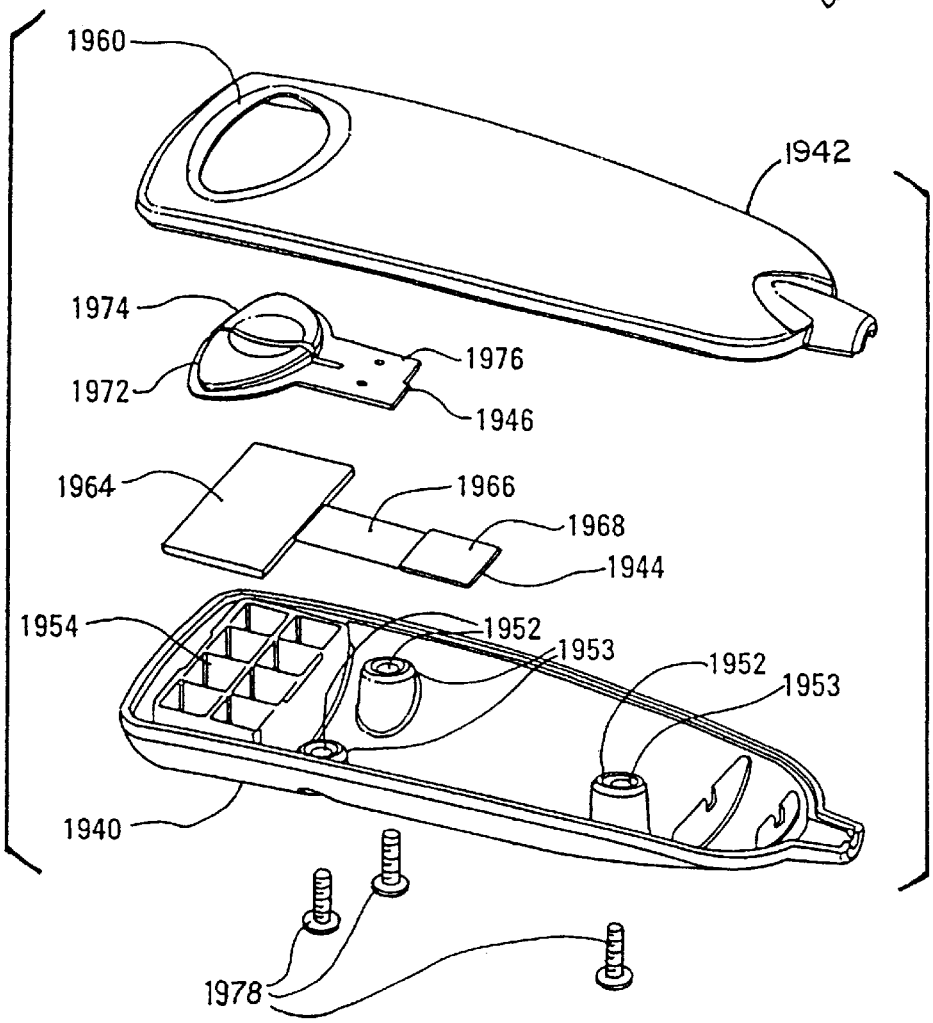
FIG. 101 is an exploded view depicting the components of the switch of FIG. 100.
Figures 102, 103, 104:
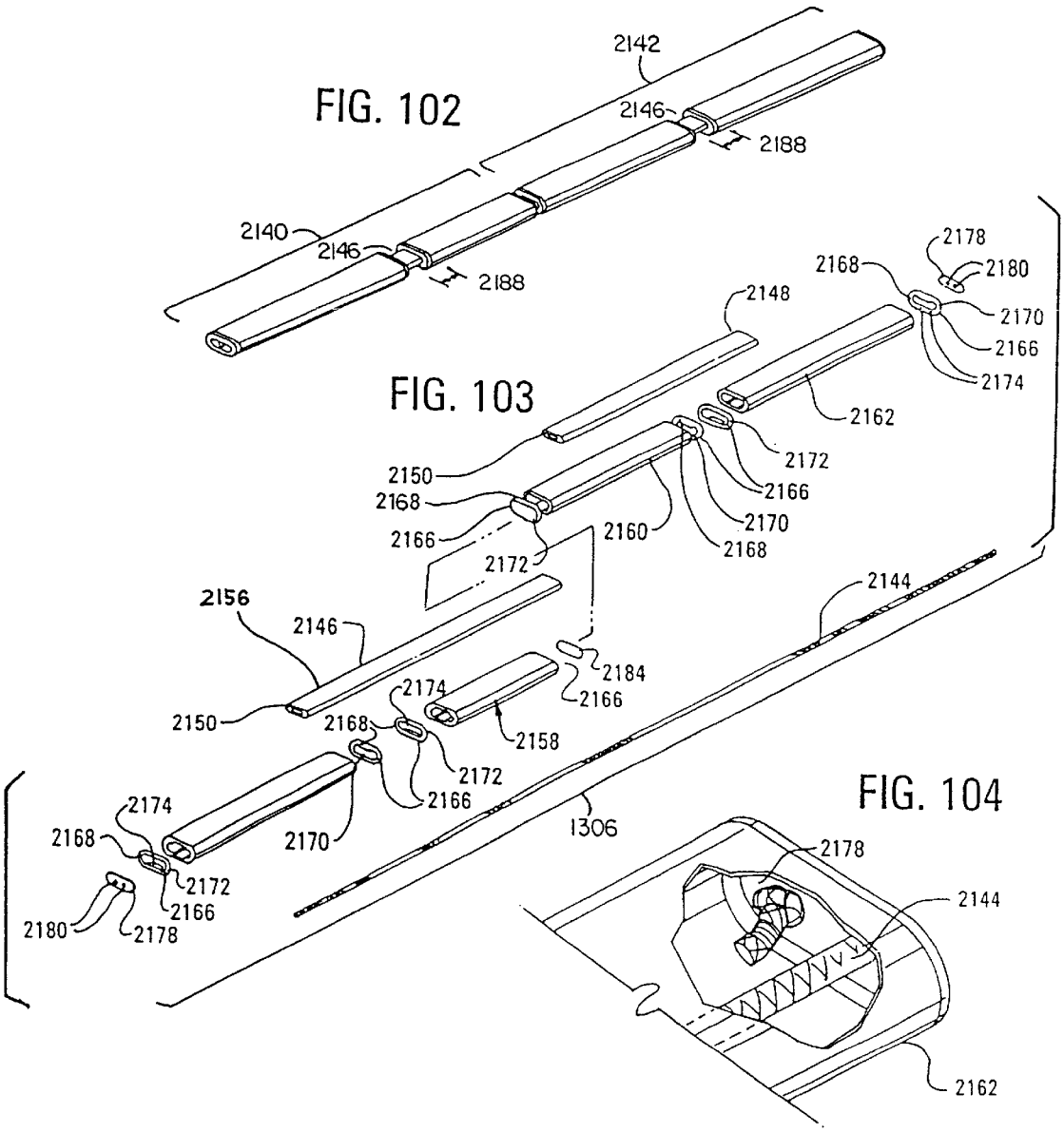
FIG. 102 is an elevated perspective view of a transfer rod of the present invention.
FIG. 103 is an exploded view of the transfer rod of FIG. 102.
FIG. 104 is a fragmentary elevated perspective view depicting how the elastic cord is secured to the cord plate of the transfer rod of FIG. 102.
Figure 105:
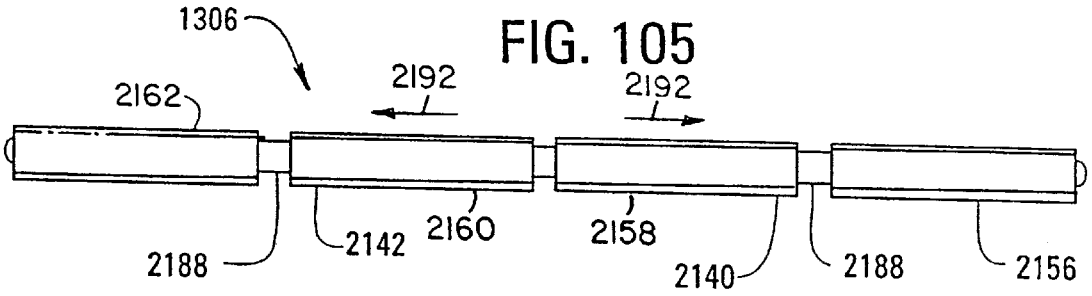
FIG. 105 is a top plan view of the transport rod of FIG. 102 being disassembled for storage or transport.
Figure 106:
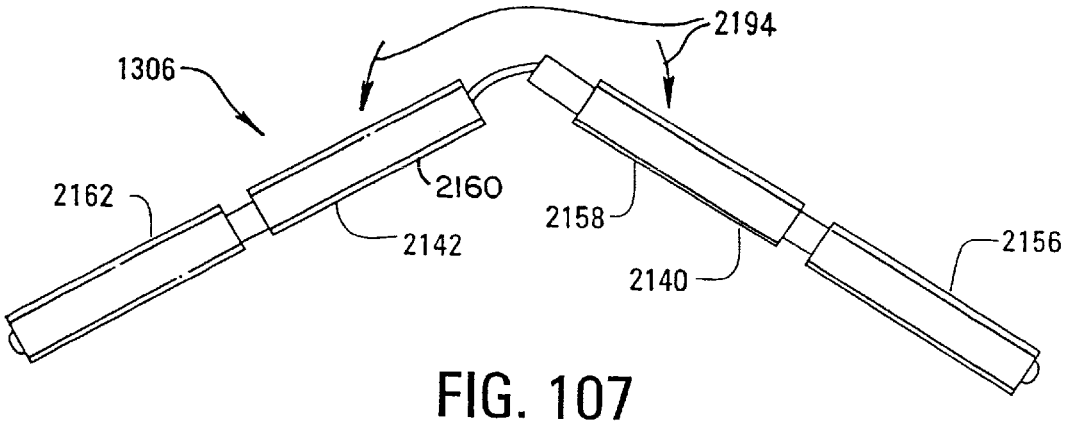
FIG. 106 is a top plan view of the transfer rod of FIG. 105 partially disassembled.
Figure 107:
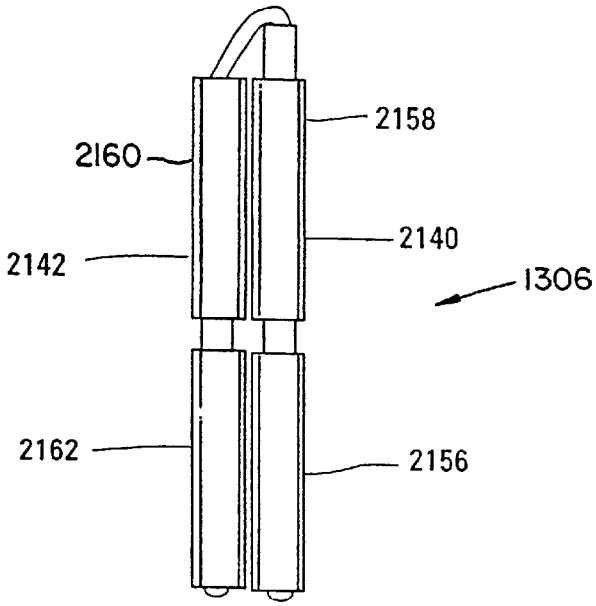
FIG. 107 is a side plan view of the transfer rod of FIG. 102 disassembled and ready for storage.
Figure 111:
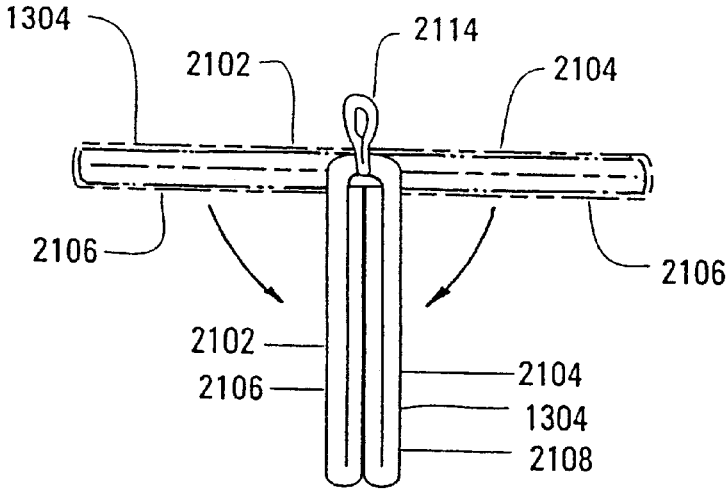
FIG. 111 is a side plan view of the transfer bridge of FIG. 108 being completely folded and ready for storage or transport.
Figure 112:
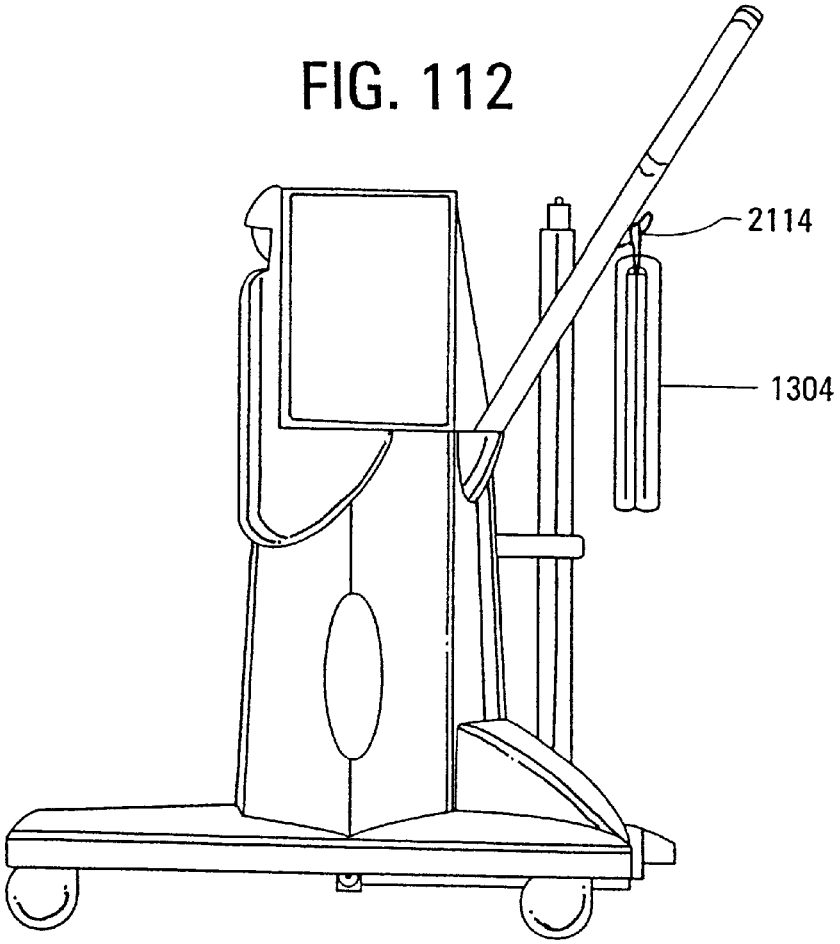
FIG. 112 is a side plan view of the patient transfer system of FIG. 96 depicting the transfer rod and the transfer bridge in storage positions.

Referring to FIGS. 100, 101, 134, remote switch 1916 is in electrical communication with logic board 1908 via cable 1928, and remote coil assembly 1914. Remote switch 1916 includes bottom cover 1940, top cover 1942, membrane switch 1944, and button assembly 1946. A plurality of moldings 1952 and a segmented platform 1954 may be present in bottom cover 1940. Top cover 1942 includes another plurality of moldings (not shown), each molding generally aligned with a molding 1952 in bottom cover 1940. Top cover 1942 also defines switch opening 1960. Switch opening 1960 is defined proximate platform 1954 when top and bottom covers 1940, 1942 are mated. Membrane switch 1944 includes planar member 1964, conductor 1966 and tab 1968. Conductor 1966 generally extends from planar member 1964. Tab 1968 represents a dielectric extension of conductor 1966.

Button assembly 1946 is unitary in construction in this embodiment, and includes left and right lobes 1972, 1974 and base 1976. Left and right lobes 1972, 1974 are joined at base 1976 in this embodiment. In practice, membrane switch 1944 is electrically connected to logic board 1908 via cable 1928. Membrane switch 1944 is then disposed on platform 1954 and button assembly 1946 is disposed atop membrane switch 1944. Top cover 1942 is then mated to bottom cover 1940 and secured thereto by a plurality of fasteners, such as screws 1978. Each screw 1978 extends through bore 1953 of molding 1952 and is threadably received within a complimentary molding formed in top cover 1942.

Referring to FIGS. 96–98, 134, panel 1920 includes power switch 1988, on/off light 1990, and charge light 1992. Electrical and switching system 1314 is activated or deactivated by toggling power switch 1988. On/off light 1990 displays a green color when electrical and switching system 1314 is activated in this embodiment. Charge light 1992 displays an amber light when the available charge in battery 1904 is less than 11.7±0.1 VDC. Charge light 1992 displays a blinking amber light when battery 1904 is being charged by charger 1902.

As seen in FIG. 134, exemplary logic board 1908 includes terminals 2000–2016. Terminal 2000 electrically connects logic board 1908 to left clutch 1420 and to one of redundant proximity switches 1926 of a first proximity switch pair 1912. Terminal 2002 electrically connects logic board 1908 to right clutch 1420 and to one of redundant proximity switches 1926 of a second proximity switch pair 1912. Terminal 2004 electrically connects logic board 1908 to motor 1410. Terminal 2006 electrically connects logic board 1908 to charger 1902, battery 1904, and AC sensor 1906. Terminal 2008 electrically connects logic board 1908 to panel 1920. Terminal 2010 electrically connects logic board 1908 to right interlock switch 1910 and to another redundant proximity switch 1926 of second proximity switch pair 1912. Terminal 2012 electrically connects logic board 1908 to remote switch 1916. Terminal 2014 electrically connects logic board 1908 to yet another redundant proximity switch 1926 of first proximity switch pair 1912 and to left interlock switch 1910. Terminal 2016 electrically connects logic board 1908 to hour meter 1918.

Logic board 1908 controls and monitors the operation of transfer caddy 1302. One function of the operation of logic board 1908 is controlling clutches 1420 and motor 1410 when a transfer event is in progress. Another function of logic board 1908 is monitoring the condition of battery 1904. Still another function of logic board 1908 is monitoring charging of battery 1904 by charger 1902. Yet another function of logic board 1908 is monitoring when charger 1902 is connected to an AC receptacle.

Logic board 1908 controls the operation of clutches 1420 in response to an operator pressing left or right lobes 1972, 1974 of remote switch 1916. Logic board 1908 also actuates motor 1410 when either of clutches 1420 is energized. Logic board 1908 discontinues operation of one of clutches 1420 when a corresponding one of switches 1912, 1914 is activated. The deactivated clutch 1410 is locked-out until remote switch 1916 is cycled off and then on to prevent "chattering" of the clutch when an end of travel is reached. "Chattering" occurs when clutch 1420 is turned off and the tension on web 1550 is thereby released, causing web 1550 to disengage flange 1572 from proximity switch 1912. An end of travel condition is reached when flange 1572 of transfer hook 1552 contacts pivot 1927, thereby engaging proximity switch 1912. Logic board 1908 further prevents operation of either of clutches 1420 or motor 1410 when either interlock switch 1910 is engaged. Either of interlock switches 1910 are engaged when an adjacent end cap 1480, 1482 is not in position. Logic board 1908 further prevents operation of either of clutches 1420 or motor 1410 when charger 1902 is connected to an AC receptacle. Logic board 1908 still further activates the event timer contained within hour meter 1918 when a current above 1A originates from motor 1410. A current above 1A arbitrarily indicates that a transfer is being performed.

Logic board 1908 also functions as a battery condition monitor. Logic board 1908 monitors battery voltage and activates yellow indicator light 1992. Logic board 1908 detects a condition wherein the voltage potential of battery 1904 is less than 11.7±0.1 VDC. Upon detecting this condition, logic board 1908 displays yellow light 1992 until battery 1904 is charged to above this level. If logic board 1908 detects a voltage potential below 11.7±0.1 VDC during a transfer event, there is sufficient energy still contained within battery 1904 to complete the transfer. Logic board 1908 monitors the condition of charger 1902. Logic board 1908 detects when current between charger 1902 and battery 1904 exceeds 0.1 Amps. A current exceeding 0.1 Amps is above the "trickle charge level" charger 1902 typically supplies when battery 1904 is in a charged condition. Logic board 1908 activates light 1992 in response to a current between charger 1902 and battery 1904 exceeding 0.1 A. Logic board 1908 further locks out activation of light 1990 until charging is completed.

When charger 1902 is connected to an AC supply, logic board 1908, via AC sensor 1906, detects this condition for a value between 90–250 Vrms (volt-root mean square). When a value between 90–250 Vrms is detected, logic board 1908 locks out further operation of motor 1410 or clutches 1420. Logic board 1908 further activates light 1990, thus indicating that charger 1902 is connected to an AC supply. If charger 1902 is connected to an AC supply and light 1992 is activated, light 1990 will not be activated until the charging process for battery 1904 is complete.

Power switch 1988 controls power to motor 1410 and clutches 1420. When switch 1988 is toggled to an on position, green light 1990 is activated, indicating that a relay has been energized. This relay (not shown) controls power output to motor 1410 and clutches 1420. However, power for the electronics within logic board 1908 is otherwise not controlled by switch 1988. Thus, the condition of battery 1904 may be continuously monitored.

A transfer bridge, positionable between the horizontal surface on which the patient is disposed and the horizontal surface to which the patient will be transferred, is advantageously employed in the invention. Such an exemplary transfer bridge is depicted in FIGS. 108–110 as 1304. Transfer bridge 1304 includes left and right inboard sections 2102, 2104 and left and right outboard sections 2106, 2108. Each section 2102–2108 displays upper surface 2110 and lower surface 2112. Each section 2102–2108 is hingedly connected to one or more adjacent sections by means of bridgespines 2116. Each bridgespine 2116 includes a flexible low-friction material, such as Cordura®, laid proximate upper surface 2110 and a strip of enhanced friction material, such as Neoprene, placed proximate lower surface 2112, thereby sandwiching the material of each of sections 2102–2108 therebetween. The layers are then stitched together in a manner known to the art. Inboard sections 2102, 2104 are joined together by bridgespine 2116 and include loops 2114. Each loop 2114 may be 0.188" diameter elastic (commonly known as bungee) cord . Each loop 2114 may be approximately 1" in length. Each of sections 2102–2108 may include a material such as polypropylene overlaid with Cordova and reinforced Neoprene. The polypropylene may be 0.125" (±0.05") in thickness. A series of longitudinally oriented ribs 2118 may also be present on lower surface 2112. In this embodiment, sections 2102 and 2104 and sections 2106, 2108 are generally mirror images. Each inboard section may extend outwardly approximately 17.25" (±0.1"). Each outboard section may extend approximately 16.5" (±0.1"). The depth of each inboard section 2102, 2104 may taper generally from a maximum proximate a central bridgespine 2116. The maximum depth of sections 2102, 2104 may be approximately 14.0" (±0.1"). In this embodiment, tapering continues on both the forward and rear edges. Exemplary transfer bride 1304 reaches a minimum depth of about 6.56" (±0.1") proximate each lateral edge of outboard sections 2106, 2108. Each exemplary inboard section 2102, 2104 has a length of about 17.25" (±0.1"). Each exemplary outboard section 2106, 2108 extends about 16.5" (±0.1"). Indicia, such as arrow 2120, may be present on upper surface 2110. In this embodiment, arrow 2120 points toward the patient to be transferred. However, other indicia may be present on surfaces 2110, 2112 as well.

Referring to FIGS. 102–107, exemplary transfer rod 1306 includes first section 2140, second section 2142, and cord 2144. First and second sections 2140, 2142, respectively, include hollow rods 2146, 2148. Each rod 2146, 2148 defines a generally coaxial bore 2150. Bore 2150 is generally oval in cross-section. First section 2140 includes rod covers 2156, 2158. Second section 2142 includes covers 2160, 2162. Each section 2140, 2142 also includes several rod caps 2166. Each rod cap 2166 is generally oval in cross-section and defines opening 2168 therein. Each rod cap 2166 further displays a flat surface 2170 and a rounded surface 2172. A plurality of lips 2174 generally extend transversely from a midpoint of each flat surface 2170. Opening 2168 generally conforms to an outer cross-sectional geometry of rods 2146, 2148. Each transfer rod 1306 may further include a plurality of cord plates 2178. In this embodiment, cord plate 2178 is generally planar and configures to a cross section of rods 2146, 2148. Cord plate 2178 may further define a plurality of openings 2180. A plurality of O-rings 2184 may also be present and, if present, are disposed as described below. In this embodiment, each rod 2146, 2148 is made of material which includes extruded aluminum. Each rod cover is extruded urethane overlaid with a material with a durometer, further enabling rods 2146, 2148 to grip a sheet.

Prior to assembly, a rod cap 2166 is installed in each end of each rod cover 2156–2162. Installation includes contacting each lip 2174 to an interior surface of each rod cover 2156–2162 until flat surfaces 2170 contact the end of each rod cover 2156–2162. Rods 2146, 2148 are then forced inside the assembled rod cover-rod cap combinations, for example by a hydraulic press, such that a gap 2188 is assured therebetween. Gap 2188 will accommodate transfer hook 1552 as discussed below. An O-ring 2184 is then inserted onto rod 2146. Elastic cord 2144 is then installed within bores 2150 of rods 2146, 2148. Each end of cord 2144 is passed through each opening 2180 in a cord plate 2178. A knot is then formed in each free end of cord 2144, thereby holding cord plates 2178 in place by the resulting tension.

In this embodiment, rods 2146, 2148 are about 27" (±0.5") and 20" (±0.5"), respectively, with a cross-sectional width of 1.5" (±0.007") and a cross-sectional height of 0.5" (±0.007"). Bore 2150 has a cross-sectional height of about 0.25" (±0.01") and a cross-sectional width of 0.75" (±0.01"). Rod covers 2156–2162 are about 17" (±0.5"), 10.5" (±0.5"), 14.38" (±0.5"), and 14.38" (±0.5"), respectively, with a cross-sectional width of about 2.0" (±0.03"), and a cross-sectional height of about 1.0" (±0.02").

When assembled, a free end of rod 2146 extends from first section 2140. An inboard portion of rod cover 2160 does not contact rod 2148. Thus, the free end of rod 2146 slidingly fits within rod cover 2160 and results in an assembled transfer rod 1306 of approximately 66" (±1.0") in length.

Assembled transfer rod 1306 is broken down for storage by separating sections 2140, 2142 in the directions indicated by arrows 2192, then by folding sections 2140, 2142 together in the directions indicated by arrows 2194.

FIGS. 122–132, depict exemplary steps in a patient transfer using the lateral patient transfer system of the present invention. A patient is lying on a first support 2304. Disposed between the patient and first support 2304 is sheet 2306. The patient is to be transferred to second support 2308. First support 2304 and second support 2308 display respective upper surfaces 2310, 2312. An attendant has previously transported second support surface 2308 and transfer caddy 1302 into the room. Second support 2308 has been positioned such that it angles away from first support 2304, thereby providing working space for the attendant. The attendant has locked wheels present on first support 2304 where possible. The attendant has further withdrawn transfer rod 1306 from pocket 1874 and mated first and second sections 2140, 2142. Transfer caddy 1302 has been positioned on a side of second support 2308 opposite first support 2304. Side rails on first and second supports 2304, 2308 have been lowered, if present. Transfer rod 1306 is then placed atop sheet 2306 and centered to align generally with the center of the patient's body, as depicted by line 2314. Sheet 2306 is untucked and folded over transfer rod 1306. Transfer rod 1306 is rolled at least once toward the patient. However, transfer rod 1306 may be rolled until transfer rod 1306 and an enwrapped portion of sheet 2306 are as close to the patient as possible. Transfer bridge 1304 is then unfolded and placed under transfer rod 1306. Transfer bridge 1304 is positioned such that the cambered edge is proximate the patient. Indicia such as arrows will point toward the patient to be transferred in some embodiments of transfer bridge 1304. Each hook and web assembly 1310 is unrolled from transfer caddy 1302 and placed upon second support 2308. Hooks 1552 are then emplaced about rods 2146, 2148 and enwrapped sheet 2306 at gaps 2188. Second support 2308 is then brought into contact with first support 2304 as depicted by arrow 2316 in FIG. 127. First and second supports, 2304, 2308 are then docked if possible. Also, wheels on second support 2308 are locked if possible. Finally, supports 2304, 2308 may be adjusted such that surface 2312 is approximately 1" lower than surface 2310. Transfer caddy 1302 is then positioned as close to second support 2308 as possible and aligned with the center of the patient.

Figure 113:
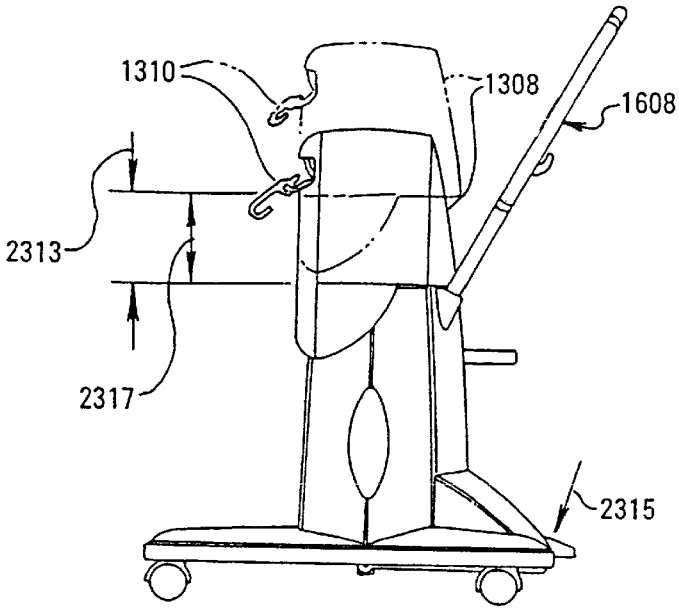
FIG. 113 is a side plan view of the patient transfer system of FIG. 96 depicting vertical adjustment of the head assembly.

The vertical height of head assembly 1308 is then adjusted by foot pedal 1692. Head assembly 1308 may be raised by pumping foot pedal 1692 as shown by arrow 2315. Head assembly 1308 may be lowered by depressing and holding foot pedal 1692 until head assembly 1308 is at the desired vertical height. The desired vertical height of head assembly 1308 is such that a distance H (FIG. 126) is formed between webbing 1550 and surface 2312. Distance H in this example is about 1". As seen in FIG. 113, head assembly 1308 is raised or lowered as indicated by arrows 2313 by foot pedal 1692. In this embodiment, head assembly 1308 may be raised a distance 2317 from its lowest position. Exemplary distance 2317 is about 11" (±2"). Alternately, an electric motor may be used to actuate raising and lowering head assembly 1308, for example, by powering a hydraulic pump.

Returning to FIGS. 122–132, the attendant then removes remote switch 1916 from remote aperture 1522 and withdraws a desired length of power cable 1928. Left and right lobes 1972, 1974 are depressed as needed until the slack in webs 1550 has been taken up and webs 1550 are taut. The transfer event begins when lobes 1972, 1974 are depressed simultaneously and the patient begins to be moved atop transfer bridge 1304 and toward second support 2308. The attendant may insure that transfer bridge 1304 is not displaced by holding transfer bridge 1304 until the patient is atop thereof. Once the patient has been transported generally to a center position on second support 2308, the attendant discontinues depressing left and right lobes 1972, 1974. However, if for some reason the patient transfer continues past this point, a safety mechanism provided in transfer caddy 1302 will automatically discontinue the transfer.

As depicted in FIGS. 115, 116, transfer hook 1552, transfer rod 1306, and an enwrapped portion of sheet 2306 are being retracted toward head assembly 1308. If the patient transfer is not discontinued by an attendant, flange 1572 will contact and displace pivot 1927. Pivot 1927 actuates proximity switch 1912, when displaced and thereby discontinues the transfer.

Once the patient has been transferred to second support 2308, the transfer event is ended. Transfer hooks 1552 are disconnected from transfer rod 1306 and sheet 2306 is then unwrapped from transfer rod 1306. Sections 2140, 2142 of transfer rod 1306 are then separated and returned to their storage position on transfer caddy 1302. Transfer bridge 1304 is removed, refolded, and returned to its storage position on transfer caddy 1302 as well. Side rails are then raised on second support 2308, if present. Transfer caddy 1302 may be then rolled away and transported to another desired location.

The beginning and end of the patient transfer are characterized by an advantageous feature of the present invention. Web 1550 is wound on drum assembly 1424 to effect the transfer. If drum assembly 1424 were directly connected to shaft 1418, rather than to magnetic clutch assembly 1420, the transfer would begin and end abruptly. That is, drum assembly 1424 would begin to wind and cease winding at full speed. Thus, an abrupt and potentially uncomfortable beginning and ending of the patient transfer event might occur. However, addition of magnetic clutch assembly 1420 and slip plate 1422 results in a more gradual acceleration and deceleration in the rotation of drum assembly 1424. Hence, the patient transfer effected by the present invention begins and ends in gradually increasing rates of transfer.

Another embodiment of the invention is depicted in FIG. 135 as exemplary patient transfer system 2330. Exemplary patient transfer system 2330 is similar to patient transfer system 1330 with the exception that extended bumpers 2334 are present in place of bumpers 1484. As seen in FIGS. 98 and 135, bumpers 2334 differ from bumpers 1484 by the presence of extended member 2338. Extended member 2338 mates to front portions of left and right end caps 1480, 1482. Other features of bumper 2334 are similar to those of bumper 1484.

Referring to FIG. 136, a pair of sheet gripping devices 2380 are shown. Each gripping device 2380 includes a pair of extended gripping members 2384 and a connecting member 2386. Gripping member pairs 2384 work together in jaw-like fashion and grip a portion of a transfer sheet in a similar manner to several of the embodiments herein. Connecting member 2386 may include means to mate with transfer hook 1552. Alternately connecting member 2386 may include means to allow web 1550 to attach thereto. In this embodiment each pair of gripping devices 2380 may grip a sheet portion of about 12 inches in length and a combined sheet portion of about 24 inches.

Because numerous modifications may be made to this invention without departing from the spirit thereof, the scope of the invention is not to be limited to the embodiments illustrated and described. Rather, the scope of the invention is to be determined by appended claims and their equivalents.

What is claimed is:

1. A system for enabling a person to singly and ergonomically transfer a patient disposed on a sheet, the system comprising a caddy, the caddy comprising:

means for enabling the person to transport the caddy from a first location to a second location, the transport means being operably disposed proximate the caddy;

a power train;

a hook and web assembly including one or more webs attachable to the power train and one or more transfer hooks attachable to the one or more webs and releasably attachable to the sheet;

a power and switching system in electrical communication with the power train; and means for adjusting a vertical position of the hook and web assembly including an actuator assembly operably adjoined to the hook and web assembly.

2. The system of claim 1, further comprising means for gradually accelerating and decelerating a transfer force exerted by the power train.

3. The system of claim 1, wherein the power train further comprises a motor and a plurality of spools in mechanical communication with the motor.

4. The system of claim 3, in which the plurality of spools is in mechanical and magnetic communication with the motor.

5. The system of claim 4, wherein the power train further comprises a plurality of magnetic clutch assemblies and a plurality of slip plates, each magnetic clutch assembly being in mechanical communication with the motor, each slip plate being in magnetic communication with one of the magnetic clutch assemblies, and each spool being in mechanical communication with one of the slip plates.

6. The system of claim 4, wherein said one or more webs is connectible to one of the spools and said one or more transfer hooks is connectible to one of the one or more webs.

7. The system of claim 6, in wherein the one or more transfer hooks further includes a flange.

8. The system of claim 1, further including means for automatically discontinuing a transfer.

9. The system of claim 8, in which the automatic transfer discontinuing means includes a switch proximate the hook and web assembly.

10. The system of claim 9, in which the switch is engaged by the flange of claim 7.

11. The system of claim 1, in which the vertical position adjusting means includes a hydraulic pump.

12. The system of claim 6, further including a transfer rod that is releasably securable to the one or more transfer hooks.

13. The system of claim 12, wherein the transfer rod further includes means for accommodating the one or more transfer hooks when at least a portion of the sheet is wrapped about the transfer rod.

14. The system of claim 13, wherein the transfer rod further includes at least three rod covers cooperating to define a plurality of gaps, the plurality of gaps being the transfer hook accommodating means.

15. The system of claim 12, wherein the transfer rod further comprises a plurality of joinable sections.

16. The system of claim 15, wherein the transfer rod further comprises means for elasticly connecting the plurality of sections.

17. The system of claim 16, wherein the in which the elastic joining means includes an elastic cord.

18. A movable caddy for enabling a single person to ergonomically turn a patient disposed on a sheet in cooperation with sheet gripping means or to transfer the patient from a first horizontal surface to a second horizontal surface in cooperation with the sheet gripping means, the caddy comprising:

a base assembly including means enabling a single person to transport the caddy from a first site to a second site;

a vertically adjustable head assembly including a power train, the power train including a motor, a plurality of magnetic clutches, a plurality of slip plates, and a plurality of spools, each magnetic clutch being in mechanical communication with the motor, each slip plate being in magnetic communication with one of the magnetic clutches, each spool being in mechanical communication with one of the slip plates, the magnetic clutches and slip plates cooperating to exert a gradually accelerable transfer force; and a hook and web assembly including a plurality of webs and means for gripping the sheet, a first end of each web being windably attachable to one of the spools, said sheet gripping means being attachable to a second end of each of the webs, the sheet gripping means gripping a portion of the sheet and thereby transmitting the transfer force to the gripped sheet.

19. The caddy of claim 18, in which the sheet gripping means includes a plurality of transfer hooks and a transfer rod, each said transfer hook being attachable to a second end of each web and each transfer hook cooperating with the transfer rod to grip the sheet.

20. The caddy of claim 18 wherein the gripping means comprises a plurality of transfer hooks and a transfer rod including means for mating with the plurality of transfer hooks.

21. The caddy of claim 20, in which the transfer hook mating means includes a plurality of gaps defined by the transfer rod, each gap accommodating one of the transfer hooks when the transfer rod is enwrapped with a portion of the sheet.

22. The caddy of claim 21, wherein the transfer rod further comprises a plurality of rod covers, each rod cover displaying an exterior gripping surface.

23. The caddy of claim 20, wherein the transfer rod further comprises a plurality of joinable sections.

24. The caddy of claim 23, in which the sections are telescopically joinable.

25. The caddy of claim 23, wherein the transfer rod further comprises an elastic member connected to each section.

26. A patient transfer caddy for singly and ergonomically transferring a patient disposed on a sheet comprising:

a base assembly including one or more castors for movement of the caddy;

a power train;

a clamping and strap assembly including one or more straps attachable to the power train and one or more clamping devices attachable to the one or more straps and releasably attachable to the sheet;

a power and switching system in electrical communication with the power train; and an actuator assembly operably adjoined to the base assembly and the clamping and strap assembly for adjusting the vertical position of the clamping and strap assembly.

27. The patient transfer caddy of claim 26 wherein the one or more clamping devices are one or more transfer hooks, one or more sheet clamps or a combination thereof.

28. The patient transfer caddy of claim 26 further comprising means for gradually accelerating and decelerating a transfer force exerted by the power train.

29. The patient transfer caddy of claim 26, wherein the power train further comprises a motor and a plurality of spools in mechanical communication with the motor.

30. The patient transfer caddy of claim 29, wherein the plurality of spools is in mechanical and magnetic communication with the motor.

31. The patient transfer caddy of claim 30, wherein the power train further comprises a plurality of magnetic clutch assemblies and a plurality of slip plates, each magnetic clutch assembly being in mechanical communication with the motor, each slip plate being in magnetic communication with one of the magnetic clutch assemblies, and each spool being in mechanical communication with one of the slip plates.

32. The patient transfer caddy of claim 29, wherein the one or more straps of the clamping and strap assembly is connectable to the spools.

33. The patient transfer caddy of claim 28, wherein the one or more clamping devices further includes a flange.

34. The patient transfer caddy of claim 26, wherein the power and switching system further includes means for automatically discontinuing a transfer.

35. The patient transfer caddy of claim 34, wherein the automatic transfer discontinuing means includes a switch proximate the clamping and strap assembly.

36. The patient transfer caddy power and switching system of claim 35, in which the switch is engaged by a flange operably adjoined to the one or more clamping devices.

37. The patient transfer caddy of claim 26, wherein the actuator assembly includes a hydraulic pump.

38. The system of claim 26, further including a transfer rod that is releasably securable to the one or more clamping devices.

39. The patient transfer caddy of 38, wherein the transfer rod further includes means for accommodating the one or more clamping devices when at least a portion of the sheet is wrapped about the transfer rod.

40. The patient transfer caddy of claim 38, wherein the transfer rod further includes at least three rod covers cooperating to define a plurality of gaps, the plurality of gaps adapted to accommodate the one or more clamping devices.

41. The patient transfer caddy of claim 38, wherein the transfer rod further comprises a plurality of joinable sections.

42. The patient transfer caddy of claim 41, wherein the transfer rod further comprises means for elasticly connecting the plurality of sections.

43. The patient transfer caddy of claim 42, wherein the elastic connecting means includes an elastic cord.

44. The patient transfer caddy of claim 27 wherein the one or more sheet clamps comprises:

a generally elongated clamp housing defining a cavity and a substantially longitudinal gap opening into the cavity; and means for clamping a sheet pivotally disposed proximate the gap and cooperating with the clamp housing to reversibly clamp the sheet when a portion of the sheet is inserted through the gap and into the cavity.

45. The patient transfer caddy of claim 44, wherein the clamp housing includes two curved sections and the cavity is defined therebetween.

46. The patient transfer caddy of claim 45, wherein the clamping means includes a releasable catch and the sheet is clamped within the cavity until the catch is released to remove the sheet from the cavity.

47. The patient transfer caddy of claim 44, wherein a transfer rod cooperates with the clamp housing and clamping means to releasably hold the sheet.

48. The patient transfer caddy of claim 44, further comprising means for attaching the one or more sheet clamps to a first end of the one or more straps, a second end of the one or more straps being windably attachable to the power train.

49. The patient transfer caddy of claim 27 wherein the one or more sheet clamps comprises:

first and second clamping members in a pivotal relationship, the first clamping member displaying an elongated gripping surface cooperating with a corresponding and elongated gripping surface displayed by the second clamping member to grip the sheet when the first and second clamping members are in a closed position; and a securing mechanism in mechanical communication with the first and second clamping members, the securing mechanism reversibly securing the first and second clamping members into the closed position.

50. The patient transfer caddy of claim 49, wherein the one or more sheet clamps further includes a substance with increased tack disposed on at least one of the gripping surfaces.

51. The patient transfer caddy of claim 50, wherein the tacky substance is rubberized.

52. The patient transfer caddy of claim 49, wherein the first clamping member is a base member and the second member is an upper member that contacts the base member when the clamping device is in a closed position.

53. The patient transfer caddy of claim 49, in which the first and second clamping members are biased toward an open position.

54. The patient transfer caddy of claim 49, wherein the securing mechanism includes a locking mechanism.

55. The patient transfer caddy of claim 54, the securing mechanism further includes one or more locking levers.

56. The patient transfer caddy of claim 49, further comprising a belt attachment site present on the first or second clamping members.

57. A method of moving a patient disposed on a sheet comprising the steps of:

positioning proximate to a patient support a patient transfer caddy comprising:

a base assembly including one or more castors for movement of the caddy;

a power train;

a clamping and strap assembly including one or more straps attachable to the power train and one or more clamping devices attachable to the one or more straps and releasably attachable to the sheet;

a power and switching system in electrical communication with the power train; and an actuator assembly operably adjoined to the base assembly and the clamping and strap assembly for adjusting the vertical position of the clamping and strap assembly;

reversibly securing a portion of the sheet in said one or more clamping devices; and actuating said power train thereby retracting the one or more straps and moving the patient.

58. The method of claim 57, wherein the moving of said patient is from one patient support to a second patient support.

59. The method of claim 57, wherein the patient transfer caddy pulls the patient up on the patient support.

* * * * *

UNITED STATES PATENT AND TRADEMARK OFFICE

CERTIFICATE OF CORRECTION

PATENT NO. : 6,378,148 B1
DATED : April 30, 2002
INVENTOR(S) : Thomas W. Votel

It is certified that error appears in the above-identified patent and that said Letters Patent is hereby corrected as shown below:

Column 46,
Line 27, delete “in” before “wherein”.
Line 52, “elasticly” should be -- elastically --.
Line 54, “in which the” should be deleted.

Column 48,
Line 26, insert -- claim -- before the number “38”.
Line 38, “elasticly” should be -- elastically --.

Signed and Sealed this

Twelfth Day of August, 2003

JAMES E. ROGAN
*Director of the United States Patent and Trademark Office*